US010774730B2

(12) United States Patent
Riley

(10) Patent No.: US 10,774,730 B2
(45) Date of Patent: Sep. 15, 2020

(54) SYSTEMS AND METHODS OF FORCED AIR INDUCTION IN INTERNAL COMBUSTION ENGINES

(71) Applicant: NAUTILUS ENGINEERING, LLC, Wichita, KS (US)

(72) Inventor: Matthew Riley, Derby, KS (US)

(73) Assignee: NAUTILUS ENGINEERING, LLC, Wichita, KS (US)

( * ) Notice: Subject to any disclaimer, the term of this patent is extended or adjusted under 35 U.S.C. 154(b) by 177 days.

(21) Appl. No.: 15/036,222

(22) PCT Filed: Nov. 10, 2014

(86) PCT No.: PCT/US2014/064866
§ 371 (c)(1),
(2) Date: May 12, 2016

(87) PCT Pub. No.: WO2015/073380
PCT Pub. Date: May 21, 2015

(65) Prior Publication Data

US 2016/0258347 A1 Sep. 8, 2016

Related U.S. Application Data

(60) Provisional application No. 62/060,977, filed on Oct. 7, 2014, provisional application No. 61/993,646, filed
(Continued)

(51) Int. Cl.
*F02B 25/06* (2006.01)
*F02B 33/04* (2006.01)
(Continued)

(52) U.S. Cl.
CPC ..... *F02B 33/04* (2013.01); *F01M 11/08* (2013.01); *F01M 13/028* (2013.01); *F02B 33/26* (2013.01); *F02B 33/28* (2013.01)

(58) Field of Classification Search
CPC ..... F02B 33/04; F02B 33/26; F02B 33/28; F01M 11/08; F01M 13/028; F01M 2011/021; F02C 6/12
(Continued)

(56) References Cited

U.S. PATENT DOCUMENTS 199,794 A 1/1878 Clark
1,683,039 A * 9/1928 Jack ..... F01M 13/04 123/572
(Continued)

FOREIGN PATENT DOCUMENTS

DE 19738248 A1 * 12/1998 ..... F01M 13/04
JP 03100323 A * 4/1991 ..... F02B 33/26
(Continued)

OTHER PUBLICATIONS

Written Opinion of the International Searching Authority; International Application No. PCT/US2014/064866, dated Feb. 27, 2015.
(Continued)

*Primary Examiner* — Hung Q Nguyen
*Assistant Examiner* — Anthony Donald Taylor, Jr.
(74) *Attorney, Agent, or Firm* — Kutak Rock LLP

(57) ABSTRACT

Apparatuses, systems and methods for utilizing crankcase compression air to effect forced air induction (i.e. "boost") into the combustion chamber of an internal combustion engine is provided. In some embodiments, the apparatuses are a supercharger apparatus that is attached to an existing engine. In other embodiments, the supercharger components are located within the structure of a novel engine itself. An embodiment of the apparatus includes a conduit that includes three inlets: 1) an inlet that is capable of being placed in fluidic communication with the crankcase chamber of an engine; 2) an inlet that is capable of being placed in fluidic communication with an intake to a combustion
(Continued)

chamber of the engine; and 3) an inlet in fluidic communication with the atmosphere.

23 Claims, 43 Drawing Sheets

Related U.S. Application Data on May 15, 2014, provisional application No. 61/975,209, filed on Apr. 4, 2014, provisional application No. 61/929,866, filed on Jan. 21, 2014, provisional application No. 61/924,160, filed on Jan. 6, 2014, provisional application No. 61/921,604, filed on Dec. 30, 2013, provisional application No. 61/903,114, filed on Nov. 12, 2013.

(51) Int. Cl.
*F01M 11/08* (2006.01)
*F01M 13/02* (2006.01)
*F02B 33/26* (2006.01)
*F02B 33/28* (2006.01)

(58) Field of Classification Search
USPC ..... 123/573
See application file for complete search history.

(56) References Cited

U.S. PATENT DOCUMENTS 1,735,694 A * 11/1929 Remington ..... F02M 35/022 123/573
2,539,896 A * 1/1951 Dalrymple ..... F04B 39/16 417/255
2,832,324 A * 4/1958 Barber ..... F02B 3/02 123/298
3,973,532 A * 8/1976 Litz ..... F01M 1/06 123/317
4,879,974 A * 11/1989 Alvers ..... F02B 75/021 123/51 A
5,138,989 A * 8/1992 Fraidl ..... F02B 31/085 123/193.5
5,239,972 A * 8/1993 Takeyama ..... F01M 13/0416 123/41.86
5,291,866 A * 3/1994 Kosa ..... F01L 3/205 123/317
5,309,718 A * 5/1994 Loving ..... F23R 3/16 431/353
5,450,835 A * 9/1995 Wagner ..... F01M 13/04 123/573
5,542,402 A * 8/1996 Lee ..... F01M 13/04 123/573
5,586,540 A * 12/1996 Marzec ..... F02B 33/40 123/559.1
5,678,525 A * 10/1997 Taue ..... F01M 1/12 123/317
5,839,887 A 11/1998 Duret
6,123,061 A * 9/2000 Baker ..... F01M 13/021 123/573
6,338,328 B1 * 1/2002 Mower ..... F02B 33/26 123/317
6,439,208 B1 * 8/2002 Jones ..... F02B 33/40 123/559.1
6,546,907 B2 * 4/2003 Liu ..... F01M 1/04 123/196 R
6,994,078 B2 * 2/2006 Roberts ..... F02M 25/06 123/572
7,128,061 B2 * 10/2006 Middlebrook ..... F04D 25/02 123/559.1
7,182,057 B2 * 2/2007 Sato ..... F02F 1/4235 123/193.5
7,246,612 B2 * 7/2007 Shieh ..... B01D 45/16 123/572
7,382,061 B2 * 6/2008 Ferraro ..... F01D 15/10 290/52
8,132,546 B2 * 3/2012 Surnilla ..... F01L 9/04 123/21
8,201,544 B2 * 6/2012 Cattani ..... F02B 37/005 123/572
8,807,097 B2 * 8/2014 Schwandt ..... F01M 13/04 123/41.86

FOREIGN PATENT DOCUMENTS

JP 8200270 A * 8/1996 ..... F04C 29/02
WO 2015073380 A1 5/2015

OTHER PUBLICATIONS

"International Preliminary report on Patentability received for PCT/US2014/064866 dated May 26, 2016".

* cited by examiner

FIG. 5
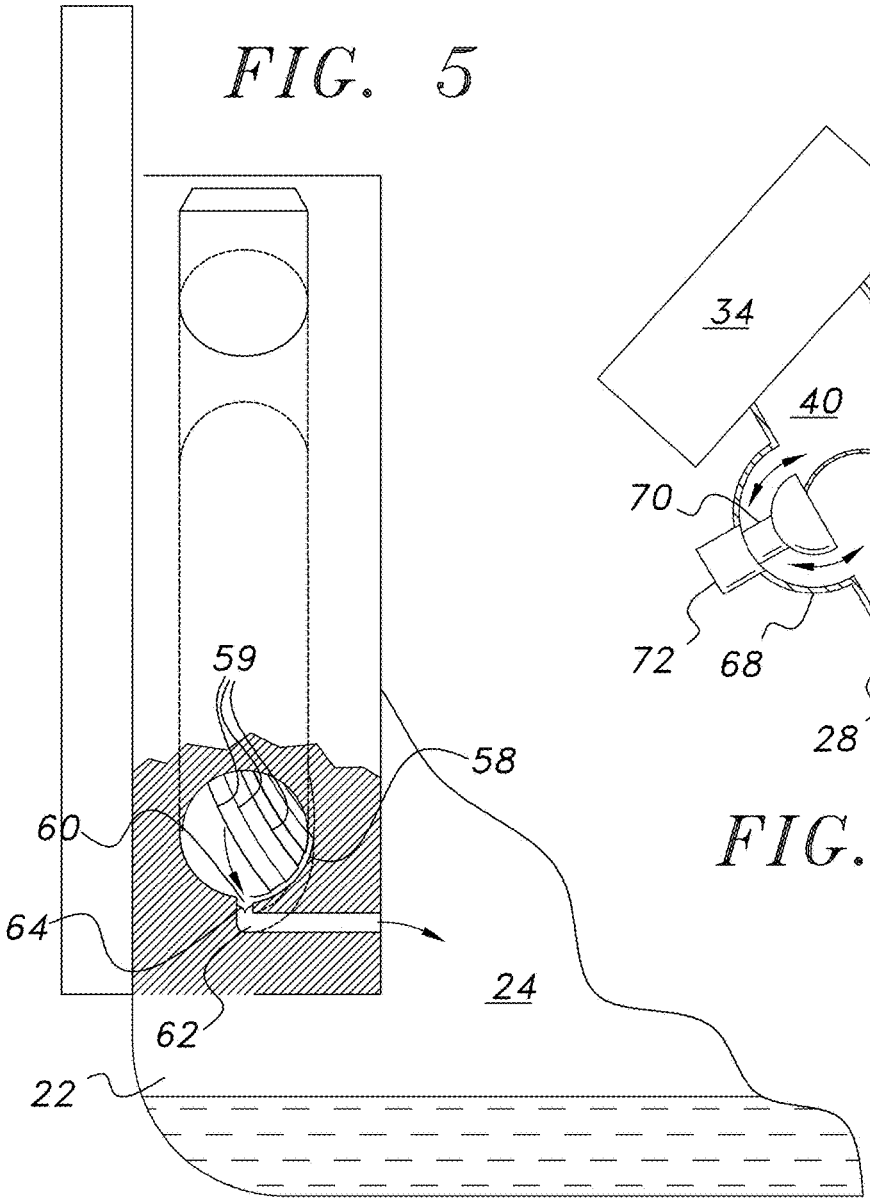
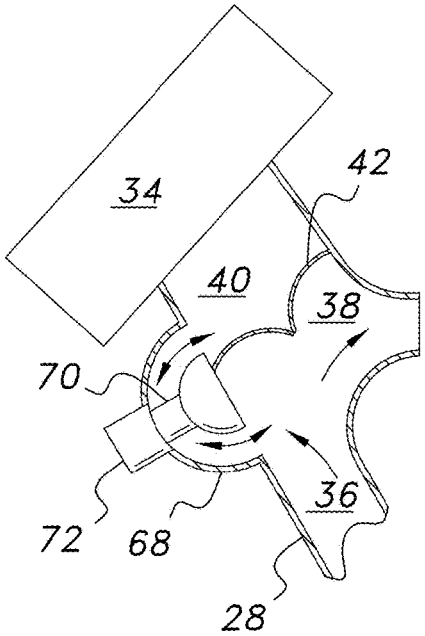
FIG. 7
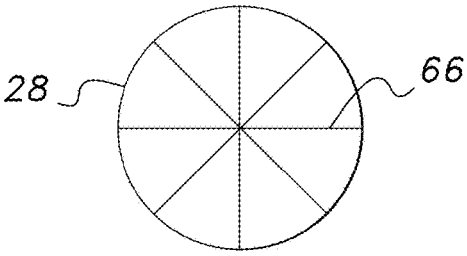
FIG. 6
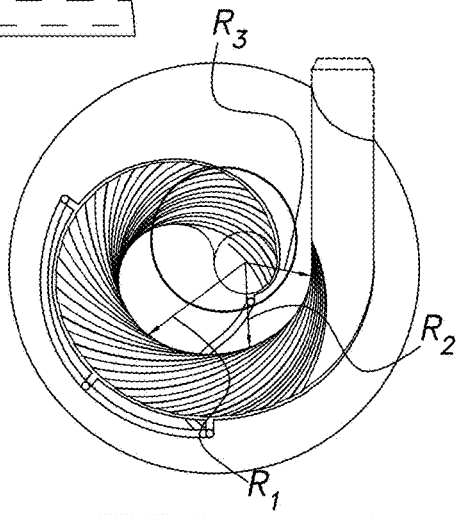
FIG. 10

PARTS LIST

| ITEM | QTY | PART NUMBER | DESCRIPTION |
|---|---|---|---|
| 1 | 1 | fulcrum pin | |
| 2 | 1 | pusher-rod | |
| 3 | 1 | set-pin | |
| 4 | 1 | shaft | |
| 5 | 1 | cam | |
| 6 | 1 | SPRING1 | |
| 7 | 1 | Solenoid | |
| 8 | 1 | SPRING1_MIR | |

HIGH PRESSURE IN OIL GALLERY
OIL RETURN GALLERY
SPARK PLUGS
OIL GALLERY, ONE WAY RETURN CHECK VALVE
HIGH PRESSURE IN CRANK CASE

PRE-INTAKE PORTS
EXHAUST PORTS
OIL RETURN GALLERY

OIL RETURN GALLERY
HIGH PRESSURE IN OIL GALLERY
9.7

OIL RETURN GALLERY
SECONDARY CENTERPUSH
PRIMARY CENTERPUSH
15.0

22.1
20.2

SYSTEMS AND METHODS OF FORCED AIR INDUCTION IN INTERNAL COMBUSTION ENGINES

CROSS-REFERENCE TO RELATED APPLICATIONS

This application is a United Sates National Stage of Patent Cooperation Treaty Application No. PCT/US2014/064866 filed Nov. 10, 2014, which claims priority to U.S. Provisional Patent Application Serial Nos.: 61/903,114, filed Nov. 12, 2013; 61/921,604, filed Dec. 30, 2013; 61/924,160, filed Jan. 6, 2014; 61/929,866, filed Jan. 21, 2014; 61/975,209, filed Apr. 4, 2014; 61/993,646, filed May 15, 2014 and 62/060,977, filed Oct. 7, 2014, the entire disclosures of which are incorporated herein by reference.

FIELD OF THE INVENTION

The present inventive concept relates generally to apparatuses, systems and methods for effecting forced air induction of combustion air into an internal combustion engine. More particularly, the present inventive concept is concerned with apparatuses, systems and method for utilizing crankcase compression of air to effect forced air induction of combustion air into one or more cylinders of an internal combustion engine.

BACKGROUND OF THE INVENTION

Virtually since the invention of the internal combustion engine, people have been trying to boost power and/or efficiency. One option for adding power to an engine is to increase the size. Unfortunately, bigger engines weigh more and cost more to build and maintain. Thus, an often more desirable option for adding power is to make a normal-sized engine more efficient. This can be accomplished by forcing more air into the combustion chamber. Forcing more air into the combustion chamber allows for more fuel to be added as well. This results in a larger explosion in the combustion chamber and greater horsepower.

A well-known method for achieving forced air induction is to add a supercharger onto an engine. A supercharger is any device that pressurizes the air intake for the engine above atmospheric pressure. Superchargers compress the air entering the engine above atmospheric pressure without creating a vacuum. This forces more air into the engine, providing a "boost." The additional air in the boost allows more fuel to be added to the charge, and the power of the engine is increased.

Most superchargers are powered mechanically by a belt or a chain-drive from the engine's crankshaft. Alternatively, a special type of supercharger called a turbo-supercharger (commonly referred to as a "turbocharger") is powered by the mass-flow of exhaust gases driving a turbine. All such devices are generally fairly complex in design, increasing costs and routine maintenance requirements. In addition, such devices typically tend to extend into the engine bay of the vehicle in which the engine is located. Such space is usually at a premium for most vehicles. Thus, bulky, complex superchargers are undesirable, impractical, or even not possible in many applications.

More recently, attempts have been made to develop superchargers that utilize compression of air/fluid from within the engine crankcases chamber to assist in the forced air induction into the combustion chamber of an engine. Nevertheless, prior art systems that utilize the crankcase chamber to increase boost have encountered several disadvantages. For example, utilizing pressure generated from the crankcase chamber often causes droplets of lubricant or fuel from within the crankcase chamber to be directed into the combustion chamber. Such droplets tend to burn incompletely, leading to increased emissions of hydrocarbons, smoke, volatile organic compounds, and carbon monoxide, as well as formation of objectionable carbon deposits on the combustion chamber, piston ring, piston, and valve surfaces. Some prior art engines/superchargers utilizing crankcase compression of air to increase boost included oil separators to eliminate or reduce migration of lubricant droplets into the induction air. Nevertheless, prior to the advent of the instant inventive concept, such systems have required additional complexity and cost, and increases demands on space.

Therefore, it would be beneficial to provide apparatuses, systems and/or methods for increasing boost within an engine combustion chamber that is less complex, more cost efficient and/or requires less space than those of the prior art.

SUMMARY OF THE INVENTION

The present inventive concept comprises apparatuses, systems and methods for utilizing crankcase compression air to effect forced air induction (i.e. "boost") into the combustion chamber of an internal combustion engine. It will be appreciated that in some embodiments, the instant inventive concept is embodied in a supercharger apparatus that is capable of being attached to an existing engine. While in other embodiments, the inventive concept is embodied within the structure of a novel engine itself.

An apparatus of some embodiments of the inventive concept includes a conduit that includes three inlets: 1) an inlet that is capable of being placed in fluidic communication with the crankcase chamber of an engine; 2) an inlet that is capable of being placed in fluidic communication with an intake to a combustion chamber of the engine; and 3) an inlet in fluidic communication with the atmosphere. In some embodiments, at least a portion of the conduit includes a generally curved shape that functions as a centrifuge to remove higher density material (e.g. lubricant, fuel or other debris) from the air as it travels through the conduit from the crankcase chamber toward the combustion chamber. A one way valve is located at the inlet to the atmosphere to allow air to flow into the conduit from the atmosphere, while at the same time prevent air from flowing back into the atmosphere from the conduit. As the piston of the engine reciprocates, air within the conduit reciprocates or oscillates upwards (toward the combustion chamber intake) and downward (back into the crankcase chamber). As the air in the conduit oscillates downward, fresh air is drawn into the conduit through the atmospheric intake. Then as the air in the conduit oscillates upwards, that air acts to compress and boost the fresh air into the intake of the combustion chamber.

As is discussed above, some embodiments of the inventive concept utilize centrifugal force to remove lubricant/fuel or other contaminants from the air as it travels from within the crankcase chamber to the intake of the combustion chamber. In some embodiments the centrifugal force is obtained by directing the air flow path from the crankcase chamber through a portion of a conduit that is at least partially curved. The curvature of the conduit results in higher density material, such as lubricant or fuel (or other contaminants), to be forced toward the outer circumference or arc of the curve and to exit the conduit through one or more return conduits or ports located along such outer circumference of the conduit. In some embodiments, one or more channels are formed in the conduit to direct lubricant or fuel (or other contaminants) into the return ports. In some embodiments, the at least partially curved conduit is curved in a manner to generally correspond to a logarithmic spiral, such as that of a nautilus shell. Nevertheless, it will be appreciated that in some such embodiments, the curvature will vary at least partially from the logarithmic spiral, while in other embodiments the curvature will not follow a logarithmic spiral at all. For example, in some embodiments, the curvature follows the logarithmic spiral closer to the interior, but becomes more compressed (e.g. does not grow logarithmically) towards the interior of the spiral so as to maximize the centrifugal benefits within a smaller footprint.

It will be appreciated that in some embodiments, the conduit of the instant inventive concept is located at least partially within the crankcase chamber. In some such embodiments, the at least partially curved portion of the conduit is located within the crankcase chamber, with another section that extends through a port in the crankcase chamber to the exterior of the crankcase and ultimately communicating with the intake into the combustion chamber of the engine. In other embodiments, the conduit is at least generally located at the exterior of the crankcase chamber with a crankcase intake portion of the conduit in fluidic communication with a port extending into the crankcase chamber. In some embodiments of the inventive concept, the crankcase intake portion of the conduit includes a diameter that is slightly smaller than the diameter of the conduit. This constriction increases vacuum developed during flow of air within the conduit which enhances the evacuation of lubricant, fuel or other debris through the return conduits and into the crankcase chamber.

In some embodiments of the inventive concept, the combustion chamber intake portion of the conduit is slightly smaller than the atmospheric intake portion of the conduit.

In some embodiments of the inventive concept, one or more throttles are utilized to control engine speed. In some embodiments, particularly in engines utilizing a carburetor or throttle body fuel injection, a throttle valve is included at the atmospheric intake of the conduit and another valve is located at the intake to the combustion chamber of the engine. In some such embodiments, a by-pass valve is located at the atmospheric intake to selectively allow air from within the conduit to flow out of the atmospheric intake, placing the engine in a naturally aspirated state in which boost pressure created is reduced and/or eliminated entirely. The throttle valve at the combustion chamber intake is utilized in such embodiments to permit operation in and out of forced induction mode versus naturally aspirated mode. It will be appreciated that in some embodiments a throttle valve is located only at the atmospheric intake of the conduit, while in other embodiments, a throttle valve is located only at the combustion chamber intake.

In some embodiments, the volume of the conduit is determined based upon the volume of air in the crankcase under the piston. In some such embodiments, the volume of the conduit below the combustion chamber intake is generally equal to the volume of air that is compressed by the piston during its down stroke. This allows the oscillating air within the conduit to function to compress the fresh air charge drawn in from the atmospheric intake efficiently, while at the same time preventing air from the crankcase from being directed into the combustion chamber. In other embodiments, the volume of the conduit below the combustion chamber intake is less than the volume of air that is compressed by the piston during its down stroke, such that at least some air from the crankcase is directed into the combustion chamber. It will be appreciated that in some embodiments the volume of the conduit is varied or determined to operate with a specific crankcase volume below the piston, while in other embodiments the volume of the crankcase (below the piston) itself is a function of the volume of the conduit. In some embodiments the volume of the conduit is varied to provide a specific amount of desired boost. In some embodiments the volume of the crankcase (below the piston) is minimized to result in increased pressure within the conduit.

In some embodiments of the inventive concept the air flow path through the conduit is entirely open and unobstructed at all times by any solid mechanical object located in the flow path, with the exception being in some embodiments a check valve (reed valve, other one-way, or two-way controllable valve structure now known or hereinafter developed) that prevents any (or partially restricts) air flow from the conduit out of the atmospheric intake.

In an engine in which the inventive concept is implemented, the piston periodically compresses crankcase chamber gasses while the usual combustion functions occur above the piston. In some embodiments, the underside of the piston is used for breathing, as is typical in two stroke engines. Air displaced below the piston shuttles between the crankcase chamber and the induction conduit leading to a cylinder induction port (combustion chamber intake). In some embodiments, this pathway contains a spiraled cyclonic oil separator, but no barrier from the crankcase to the intake port. In other embodiments, other types of oil separators are utilized. On each piston up stroke, induction air is drawn into the induction conduit, but (in some embodiments) stops short of entering the crankcase. On each piston down stroke, crankcase air enters the induction conduit, propelling newly drawn in combustion air towards the induction port leading to the combustion chamber, the crankcase air itself (in some embodiments) stopping short of entering the combustion chamber. Hence two stroke breathing is achieved with minimized oil and blow-by fouled crankcase air to enter the combustion chamber. It will be appreciated that the term "oil separator" as referenced herein refers to a structure that removes any of oil, other liquids, contaminants, particles or solids from otherwise combustible air.

Crankcase air and freshly drawn induction air share the same flow path without an intervening mechanical barrier, yet without contamination of the freshly drawn induction air by oil entrained within crankcase air. The flow path includes a first section in fluid communication with the crankcase chamber, a second section in fluid communication with the first section and with an intake port of the engine, and a third section in fluid communication with the first section, the second section, and the atmosphere outside the engine. A check valve in the third section enables incoming air to flow from the third section into the first section and the second section, and prevents captured air from flowing ineffectually back into the third section while under pressure from the crankcase during cylinder charging. The system in some embodiments includes an oil separator for removing oil droplets which could contaminate fresh induction air. In some embodiments, the oil separator does not introduce a mechanical obstruction into the air flow path.

The foregoing and other objects are intended to be illustrative of the inventive concept and are not meant in a limiting sense. Many possible embodiments of the inventive concept may be made and will be readily evident upon a study of the following specification and accompanying drawings comprising a part thereof. Various features and subcombinations of inventive concept may be employed without reference to other features and subcombinations. Other objects and advantages of this inventive concept will become apparent from the following description taken in connection with the accompanying drawings, wherein is set forth by way of illustration and example, an embodiment of this inventive concept and various features thereof.

BRIEF DESCRIPTION OF THE DRAWINGS

A preferred embodiment of the inventive concept, illustrative of the best mode in which the applicant has contemplated applying the principles, is set forth in the following description and is shown in the drawings.

FIG. 5 is a schematic detail cross-section taken along line 5-5 of FIG. 4*a*, showing an exaggerated representative view of one side of the conduit including oil branch channels converging upon an oil collection channel;

FIG. 6 is a schematic detail cross-section taken along line 6-6 of FIG. 4*a;*

FIG. 7 is a partial schematic detail view of an optional bypass feature incorporated into the crankcase air compression supercharger shown in FIG. 2;

FIG. 10 is a schematic detail cross-section taken along line 12-12 of FIG. 4;

FIG. 14*a* shows a first cylinder in an intake cycle and the second cylinder in a power stroke cycle, with all valves controlled by a single cam or other suitable control mechanism.

FIGS. 15*a* through 15*r* show views of a first cylinder in various stages of 4 cycle operation in connection with the various alternative 4 cycle stages of the second cylinder, with all valves controlled by a single cam or other suitable control mechanism.

FIG. 18*a* shows a first (left) cylinder in power stroke and the second cylinder in an intake stroke cycle, with (in some embodiments) all valves controlled by a single cam or other suitable control mechanism. Note that the turbo itself, an exhaust path through the turbo turbine, and any associated manifolding, are not shown; only turbo compressor ports are shown through the induction conduit (compressor intake port) and back into the intake area (compressor discharge port).

FIG. 18*a*-1 is an enlarged partial view of the engine of FIG. 18*a*, showing valves and turbo ports in detail. Note that the turbo itself, an exhaust path through the turbo turbine, and any associated manifolding, are not shown; only turbo compressor ports are shown through the induction conduit (compressor intake port) and back into the intake area (compressor discharge port).

DETAILED DESCRIPTION

As required, a detailed embodiment of the present inventive concept is disclosed herein; however, it is to be understood that the disclosed embodiment is merely exemplary of the principles of the inventive concept, which may be embodied in various forms. Therefore, specific structural and functional details disclosed herein are not to be interpreted as limiting, but merely as a basis for the claims and as a representative basis for teaching one skilled in the art to variously employ the present inventive concept in virtually any appropriately detailed structure.

It will be appreciated that the drawings included herein are intended for representative purposes only of the inventive concept, and therefore in some instances may not be shown to scale and/or may otherwise include representative depictions of components and/or their arrangements that may vary significantly from the respective component designs and/or arrangements included in three-dimensional models or manufactured apparatuses in which the inventive concept is implemented. Such variations will be readily apparent to those of ordinary skill in the art.

Figure 1:
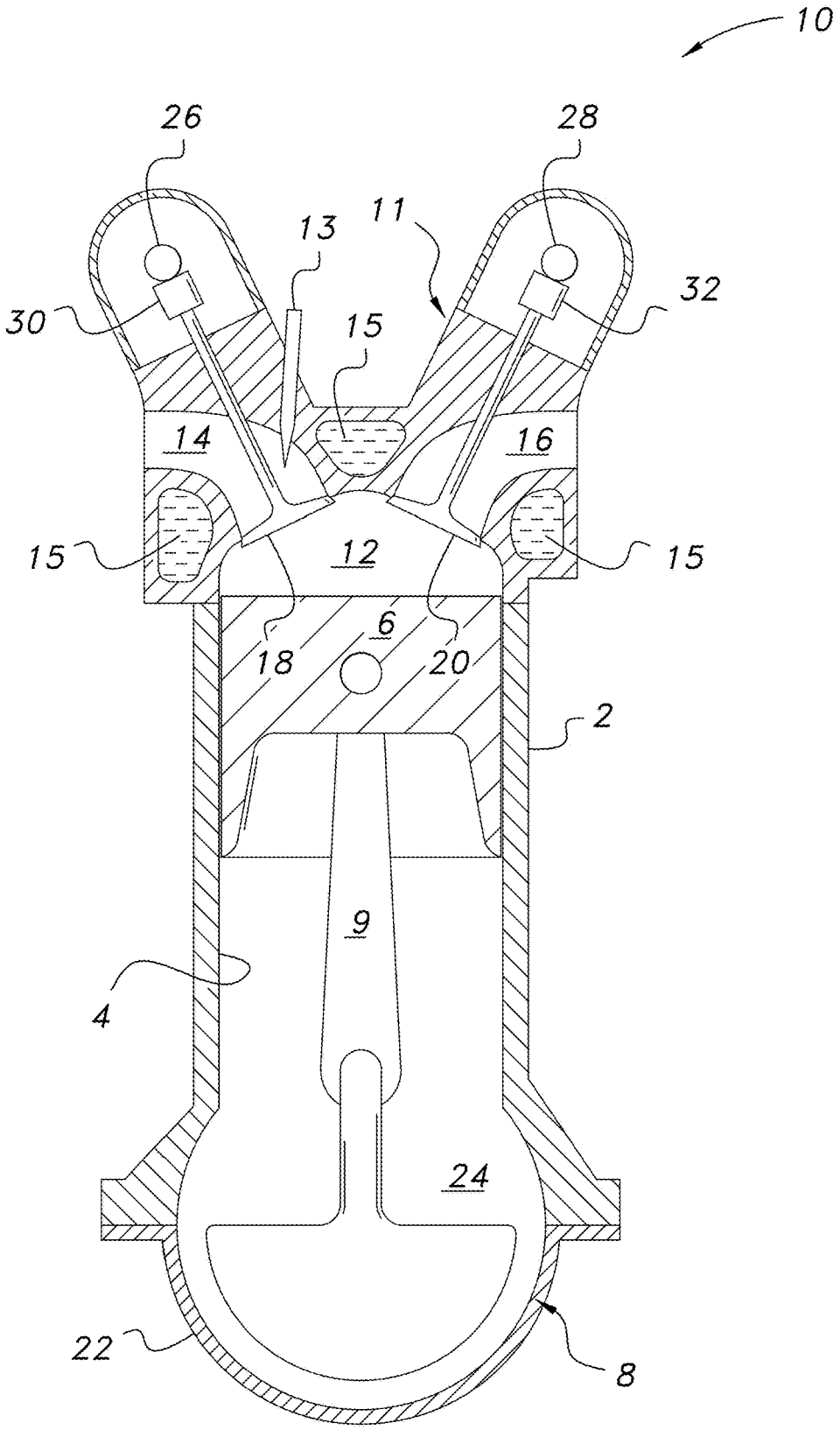
FIG. 1 is a schematic frontal elevation section view of a representative conventional engine in which a crankcase air compression supercharger according to the present inventive concept may be implemented.

Referring first to FIG. 1, according to at least one aspect of the disclosure, there is shown a conventional internal combustion engine 10, which includes an engine block 2 having at least one cylinder 4 therein. As employed herein, the term "cylinder" is used in its ordinary meaning with respect to internal combustion engines, and should not be interpreted to imply that the cylinders be cylindrical according to a geometric meaning. Some internal combustion engines (not shown) have had cylinders which are elliptical in cross section for example. Therefore, configurations other than geometrically cylindrical configurations are encompassed by the term "cylinder" herein.

A piston 6 is reciprocatingly disposed in the cylinder 4. A crankshaft 8 is rotatably supported to the engine block 2. In some embodiments, this will be accomplished conventionally, for example utilizing main bearings (not shown). A linkage 9 connects each piston (e.g., the piston 6) to the crankshaft 8. The linkage is configured to cause the crankshaft 8 to rotate responsively to reciprocation by the piston 6 within the cylinder 4. In some embodiments, the linkage comprises one connecting rod for each piston 6, such as the connecting rod 9. In other embodiments other linkages will be provided, such as yokes (not shown), and more complex linkages, such as for example that utilized in the Atkinson engine (not shown). A cylinder head 11 is configured to close each cylinder, such as the cylinder 4, at that side of the piston 6 opposite the crankshaft 8.

A combustion chamber 12 is located between each piston (e.g., the piston 6) and the cylinder head 11. An intake port 14 is configured to conduct air into the combustion chamber 12 from the atmosphere outside the internal combustion engine 10. An exhaust port 16 is configured to selectively establish fluid communication between the combustion chamber 12 and the atmosphere outside the internal combustion engine 10.

At least one intake valve 18 is associated with the piston 6 and with the combustion chamber 12. Although one intake valve 18 is shown, the disclosure contemplates that in some embodiments plural intake and/or plural exhaust valves (plural valves are not shown) are utilized. The intake valve 18 is configured to selectively establish fluid communication between its associated combustion chamber 12 and its associated intake port 14, and to prevent fluid communication between the associated combustion chamber 12 and its associated intake port 14. An exhaust valve 20 is associated with the piston 6 and with the combustion chamber 12. The exhaust valve 20 is configured to selectively establish fluid communication between its associated combustion chamber 12 and its associated exhaust port 16, and to prevent fluid communication between the associated combustion chamber 12 and its associated intake port 14.

It will be appreciated that the depiction of the internal combustion engine 10 (particularly of FIGS. 1-18) is schematic for purposes of illustrating the inventive concept, and should not be literally construed. The intake and exhaust valves 18, 20 will be understood to be actuated by elements such as respective camshafts 26, 28 through respective tappets 30, 32 to enable operation according to a conventional four-stroke cycle, the engine 10 of FIG. 1 being a four-stroke engine. In addition, in one actual manufactured embodiment of the engine 10 of FIG. 1, intake port 14 and exhaust port 16 are both located in the front of the engine, rather than on opposing sides as shown in FIG. 1. Those skilled in the art will appreciate that systems such as lubrication, ignition, emissions controls, starting system, generator system, and fuel supply systems (none shown) and other components are or may be necessary or desirable for operability of the internal combustion engine 10. Hence not all engine support systems and components are shown. Although the entire fuel system is not shown, the engine 10 is of the port injected type, having a port mounted fuel injector 13. Notwithstanding, it will be appreciated that other types of fuel systems, including throttle body and carburetors, are utilized in alternative embodiments of the inventive concept. Similarly, although the entire cooling system is not shown in FIG. 1, the cooling system is represented by liquid coolant passages 15. It will be appreciated that other embodiments of the inventive concept include alternative cooling systems, including, but not limited to, air cooling systems.

A crankcase 22 is configured to establish a crankcase chamber 24 around the crankshaft 8 and to close the crankcase chamber 24 to the atmosphere outside the internal combustion engine 10. In the embodiment shown in FIG. 1, a removable crankcase cover (not shown) is included on the front of the crankcase chamber 24 to enclose fully the crankcase chamber.

Figure 2:
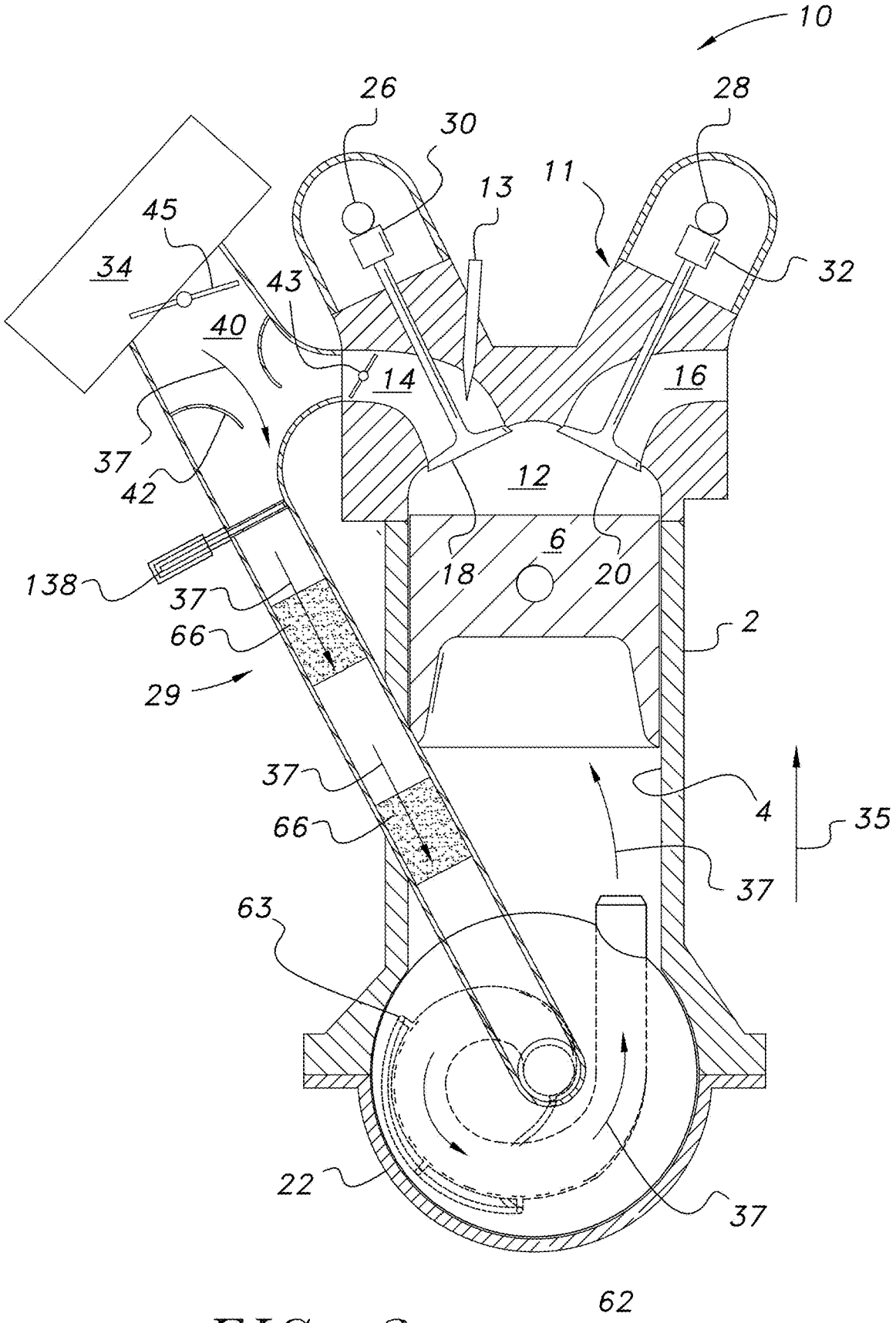
FIG. 2 is a schematic representation similar to that of FIG. 1, that shows an embodiment of a crankcase air compression supercharger of the inventive concept superimposed over basic engine components, and more particularly illustrates intake of combustion air from the external atmosphere with some components shown in FIG. 1 omitted for clarity of view.

FIG. 2 shows an embodiment of a crankcase air compression supercharger 29 superimposed onto the disclosed internal combustion engine 10. The supercharger includes an induction conduit associated with the cylinder 4. In FIG. 2, fresh induction air is drawn into the internal combustion engine 10 using crankcase suction (or alternatively stated, partial vacuum). The induction conduit is configured to enable atmospheric air to enter the induction conduit, to flow towards the crankcase chamber 24 from an air inlet or air horn (represented by an air filter 34), and to flow into the intake port 14, propelled by atmospheric air pressure acting against reduced pressure or partial vacuum developed within the crankcase 24 due to upwards piston motion (upwards motion is represented by the arrow 35). Air flow from the air filter 34 towards the crankcase chamber 24 is indicated by arrows 37.

Figure 4A:
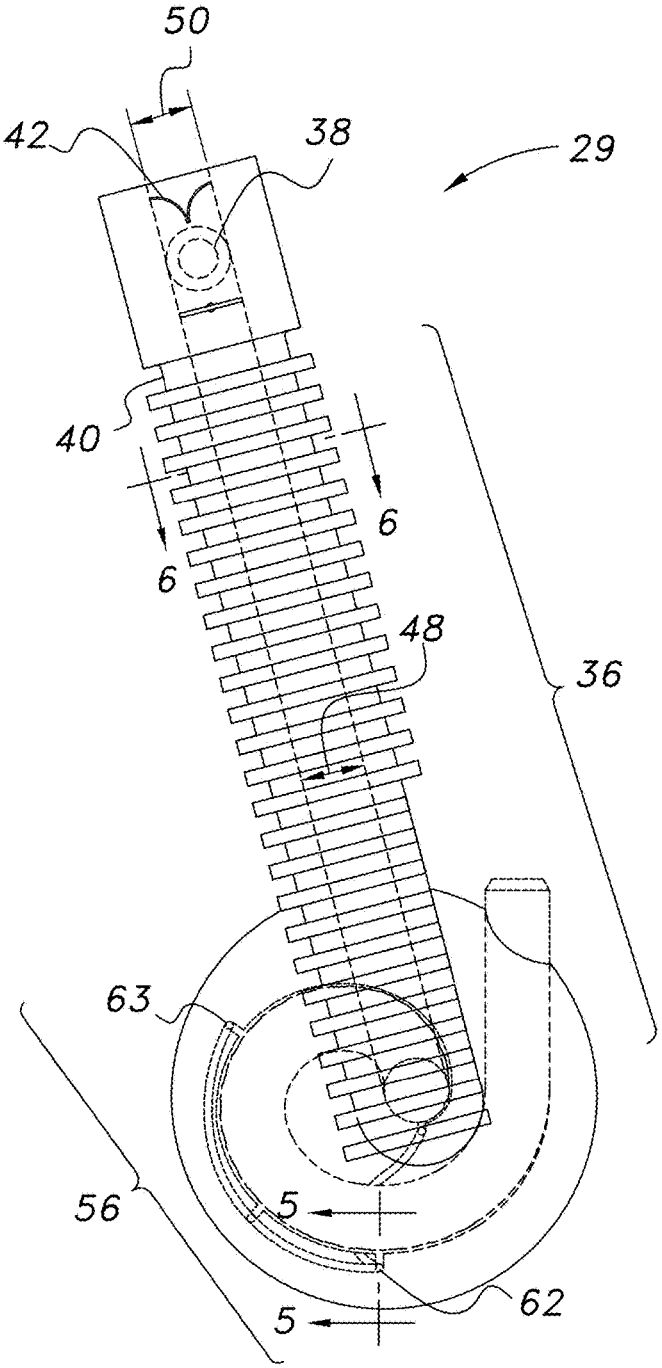
FIG. 4*a* is a frontal elevation view of the crankcase air compression supercharger of FIG. 4.
Figure 4:
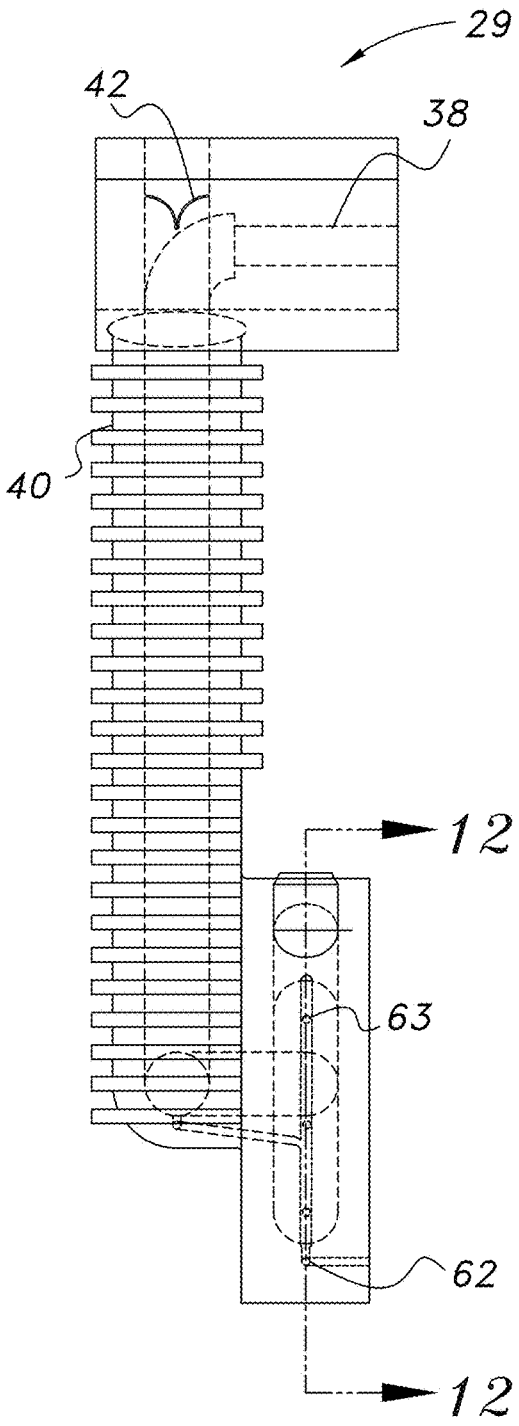
FIG. 4 is a side view of the crankcase air compression supercharger of FIG. 2, shown removed from the engine.

The crankcase air compression supercharger 29 including the induction conduit is shown schematically in FIGS. 4 and 4*a*, isolated from other engine components. As employed herein, the term "induction conduit" may literally include a solid conduit surrounding a void defining a flow path, or alternatively, may refer only to the flow path itself, depending upon context. Where the induction conduit is understood to include a solid conduit defining the flow path, the induction conduit will further be understood to take any of several possible forms. For example, some embodiments of the induction conduit will comprise tubing bent generally into the shape shown in FIG. 4. Alternatively, other embodiments of the induction conduit will be machined or otherwise formed from a casting, will be built up from a deposition process, or will include a combination of these. In other embodiments, the induction conduit will be formed to comprise a plurality of separable components rather being a single monolithic entity.

Regardless of its construction, and referring to FIGS. 2, 4 and 4*a*, the induction conduit includes a first section 36 in fluid communication with the crankcase chamber 24 (FIG. 2), a second section 38 in fluid communication with the first section 36 and with the intake port 14, and a third section 40 in fluid communication with the first section 36, the second section 38, and the atmosphere outside the internal combustion engine 10. It will be appreciated that in some embodiments the third section 40 will not communicate directly with the open atmosphere outside the internal engine 10; rather, intermediate components such as a carburetor, if provided (not shown), a throttle body if provided (not shown), and the air filter 34, for example, intervene between the third section 40 and the open atmosphere.

Figure 12:
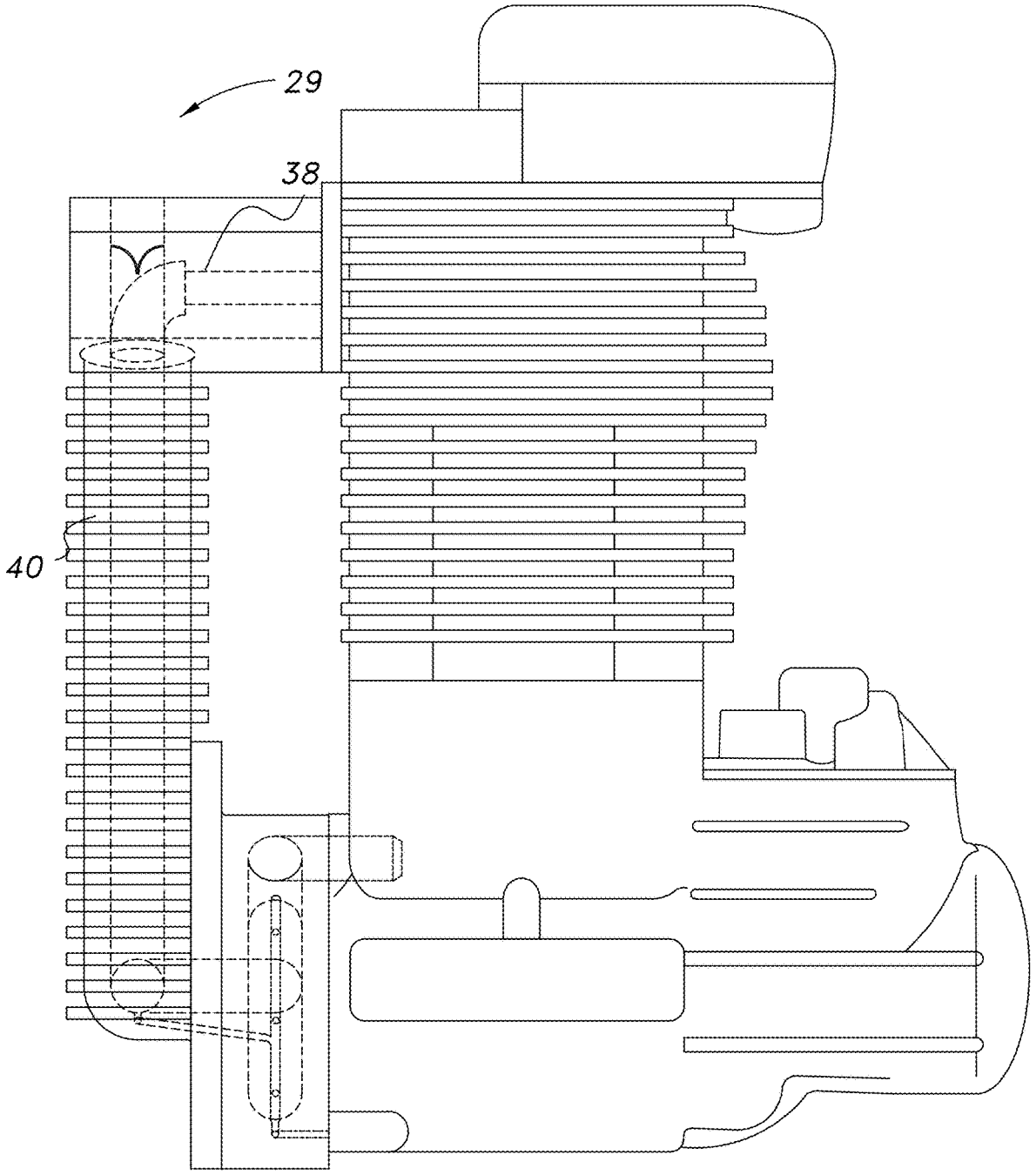
FIG. 12 is a representative side view of an engine in which an alternative embodiment of a crankcase air compression supercharger of the inventive concept is implemented.

In the embodiment shown in FIGS. 4 and 4*a*, the induction conduit is formed by machining or casting. In the embodiment shown, the supercharger includes a generally solid cylindrical base in which the second section 38 of the induction conduit is located. The cylindrical base formed from two separate pieces of material, generally divided along line 12-12 of FIG. 4, and held together by an O-ring and/or other components. In the embodiment shown in FIG. 2, the cylindrical base is designed to fit within the engine crankcase in place of the crankcase cover in the manner illustrated in FIG. 11. In another embodiment, as illustrated in FIG. 12, the cylindrical base is mounted to the exterior of the crankcase cover with a connecting tube extending from the crankcase intake of the induction conduit through a port in the crankcase cover and into the crankcase. In addition, in the embodiment shown in FIG. 12, a return conduit 62 extends from the induction conduit through another port in the crankcase cover to allow lubricant and fuel or other debris that has been filtered in the manner discussed below to be returned to the crankcase.

A check valve 42 (FIG. 2) separates the third section 40 from the first section 36 and the second section 38. The check valve 42 is a unidirectional valve configured to enable air to flow from the third section 40 into the first section 36 and the second section 38, and to prevent air from flowing from the first section 36 and the second section 38 into the third section 40. The valve 42 shown in the embodiment of FIG. 2 is a reed valve. In other embodiments alternative one-way valves are utilized, including but not limited to a poppet valve or other type of valve under affirmative control of an engine management computer or processor (not shown). When the piston 6 is on an upstroke, as indicated by the arrow 35 in FIG. 2, a strong partial vacuum develops therebeneath. Orientational terms such as upstroke, downstroke, and reference to the piston 6 descending refer to ordinary engine operation, and are not to be interpreted to refer to actual orientation of the internal combustion engine 10 and literal direction of piston travel. It will be appreciated that the internal combustion engine 10 will be arranged with the directions of piston travel to be at any desired orientation to a vertical direction. Therefore, upstroke refers to a compression stroke or an exhaust expulsion stroke in a four-stroke engine. In a two-stroke engine, the upstroke is the compression stroke.

Responsively to the upstroke of the piston 6, air in the induction conduit flows into and through the third section 40 into the first section 36, indicated by arrows 37. It will be appreciated that in the embodiment shown the air flowing in the first section 36 as shown does not necessarily comprise freshly drawn atmospheric air. Rather, a certain amount is that air occupying the crankcase chamber 24, which moves in a bidirectional, oscillating or reciprocating path partially through the first section 36 responsive to piston reciprocation. The applicant has found surprisingly that with appropriate arrangement of the induction conduit, little if any of this air mixes with freshly drawn atmospheric air. The freshly drawn atmospheric air passes through the third section 40, and into the first section 36, but does not pass entirely through the first section 36 into the crankcase chamber 24. Such flow characteristics are accomplished by controlling the volume of the induction conduit such that it is generally equal to the volume of air compressed by the piston during its down stroke.

In the embodiment shown the first section 36 includes a cross sectional area represented by a transverse dimension 48 shown in FIG. 4*a*. Dimension 48 is a diameter in embodiments in which the first section 36 is a circular cross section such as that shown in FIG. 4*a*. Nevertheless, it will be appreciated that other cross-sectional shapes will be utilized in alternative embodiments without departing from the spirit and scope of the inventive concept. The third section 40 includes a cross sectional area represented by a transverse dimension 50 in FIG. 4*a*. Dimension 50 is a diameter in embodiments in which the third section 40 has a circular cross section such as that shown in FIG. 4*a*. Nevertheless, it will be appreciated that other cross-sectional shapes will be utilized in alternative embodiments without departing from the spirit and scope of the inventive concept. In the embodiment shown, second section 38 includes a cross sectional area that is generally less in magnitude than the cross sectional areas of the first section 36 and the third section 40. This provides for increased boost pressure as the fresh air is being forced into the combustion chamber.

In the embodiment shown, the induction conduit is entirely open throughout the first section 36 and the second section 38 is continuously open from the first section 36 to the second section 38, such that during normal operation the flow path is unobstructed at all times by any solid mechanical object occupying the first section 36 and the second section 38. The check valve 42 is located in the third section 40.

In the embodiment shown the effective cross sectional area of the intake port 14 will be varied as desired by a throttle such as a butterfly valve 43, which is located within the intake port 14 as illustrated. In alternative embodiments, the throttle is located within the second section 38 of the induction conduit 29 (this option is not shown). Similarly, effective cross sectional area of the third section 40 will be varied as desired by a throttle, such as a butterfly valve 45. It will be appreciated that in other embodiments the number of butterfly valves 43 or 45 will be greater than one as desired.

Figure 3:
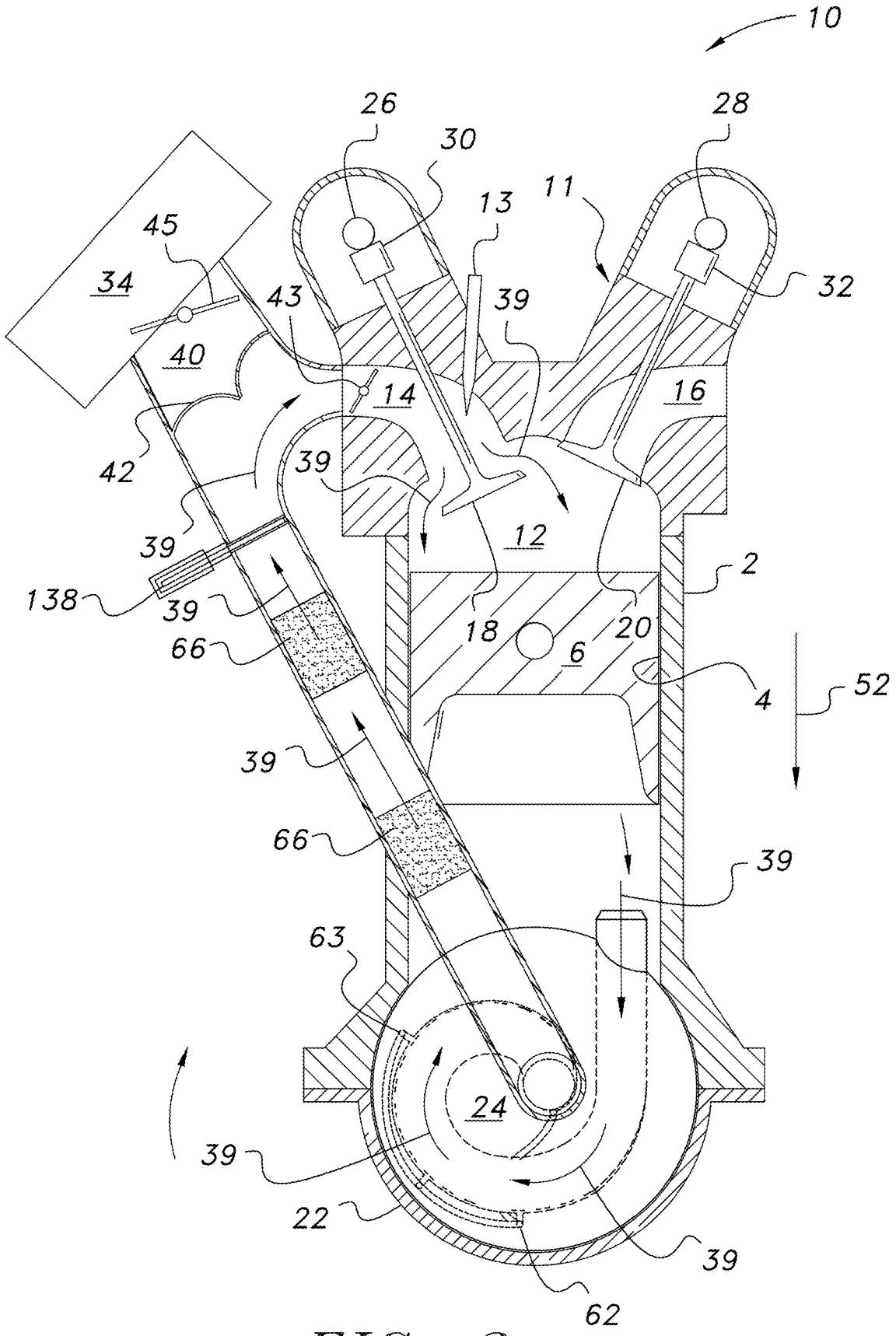
FIG. 3 is a schematic representation similar to FIG. 2, that illustrates propulsion of air into a combustion chamber of the engine in accordance with the teachings of the inventive concept.

FIG. 3 depicts induction air being forced into the combustion chamber 12 utilizing crankcase compression. When the piston 6 descends during a downstroke, indicated by an arrow 52, air within the crankcase chamber 24 is compressed. Responsively, compressed air passes into the first section 36 of the induction conduit, and then past the open intake valve 18 into the combustion chamber 12, moving in a direction indicated by arrows 39. The check valve 42 is closed during the downstroke to prevent ineffectual loss of propelled air to the third section 40.

As a result of the above described operation, air is drawn into the induction conduit by piston action and is propelled into the intake port 14 without requiring a mechanical barrier between crankcase chamber air fouled with oil or lubricant particles, and induction air. As employed herein, the terms "oil" and "lubricant" are used interchangeably. In the embodiment shown, very little if any of the oil droplets from the atmosphere of the crankcase chamber 24 enter induction air propelled into the combustion chamber 12. It will be appreciated that in some embodiments some gaseous components of the atmosphere of the crankcase chamber 24 will join induction air entering the combustion chamber 12 without departing from the spirit and scope of the instant invention.

The embodiment of the inventive concept shown further limits passage of oil droplets into the combustion chamber by incorporating an oil separator in the induction conduit. Nevertheless, it will be appreciated that other embodiments of the inventive concept include other oil separation apparatuses and/or methods now known or hereinafter developed. As seen in FIG. 3, when air from the crankcase chamber 24 flows through the first section 36, it will be subjected to cyclonic or centrifugal action which causes oil droplets entrained in the air to be separated. To this end, the supercharger 29 includes an oil separator in at least one of the first section 36 and the second section 38. It will be appreciated that other embodiments of the inventive concept utilize alternative centrifugal oil separators now known or hereinafter developed (although in some embodiments it may be desirable or necessary to modify such oil separators to allow for bidirectional air flow through the separator). In the embodiment shown, the oil separator includes a separation flow path for air being subjected to oil separation (indicated in FIG. 4*a* as a curved portion 56 of the first section 36). Because it is part of the first section 36, the separation flow path is entirely open and unobstructed at all times by any solid mechanical object (not shown). Because the separation flow path is curved, centrifugal or cyclonic separation readily occurs as air is accelerated through the separation flow path.

In the embodiment shown, the separation flow path is in the first section 36. This is a convenient location which for example enables the curved separation flow path to encircle the crankshaft 8 or alternatively, to occupy available space in the crankcase chamber 24. Locating the oil separation portion of structure in the crankcase chamber 24 reduces the amount of open space within the crankcase chamber 24. Moreover, reducing open space enhances effectiveness of pressure developed by reciprocation of the piston 6.

Figure 5A:
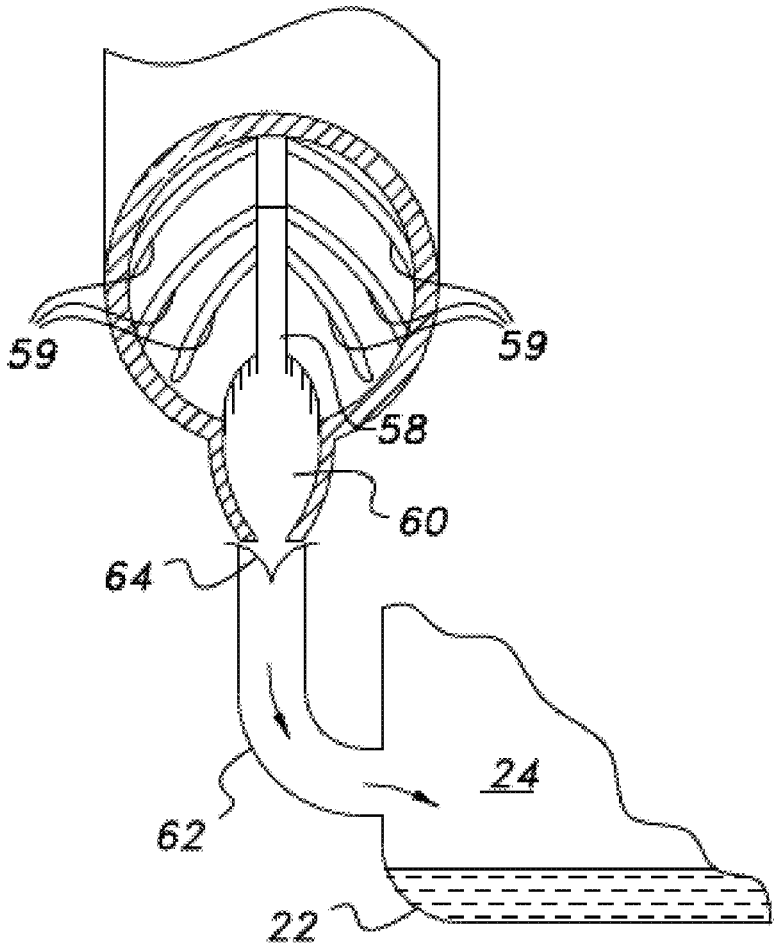
FIG. 5*a* is a representative detail cross-section taken along line 5-5 of FIG. 4*a* with portions surrounding the conduit removed for clarity purposes, illustrating all oil branch channels converging to the centrally located oil collection channel.
Figure 8:
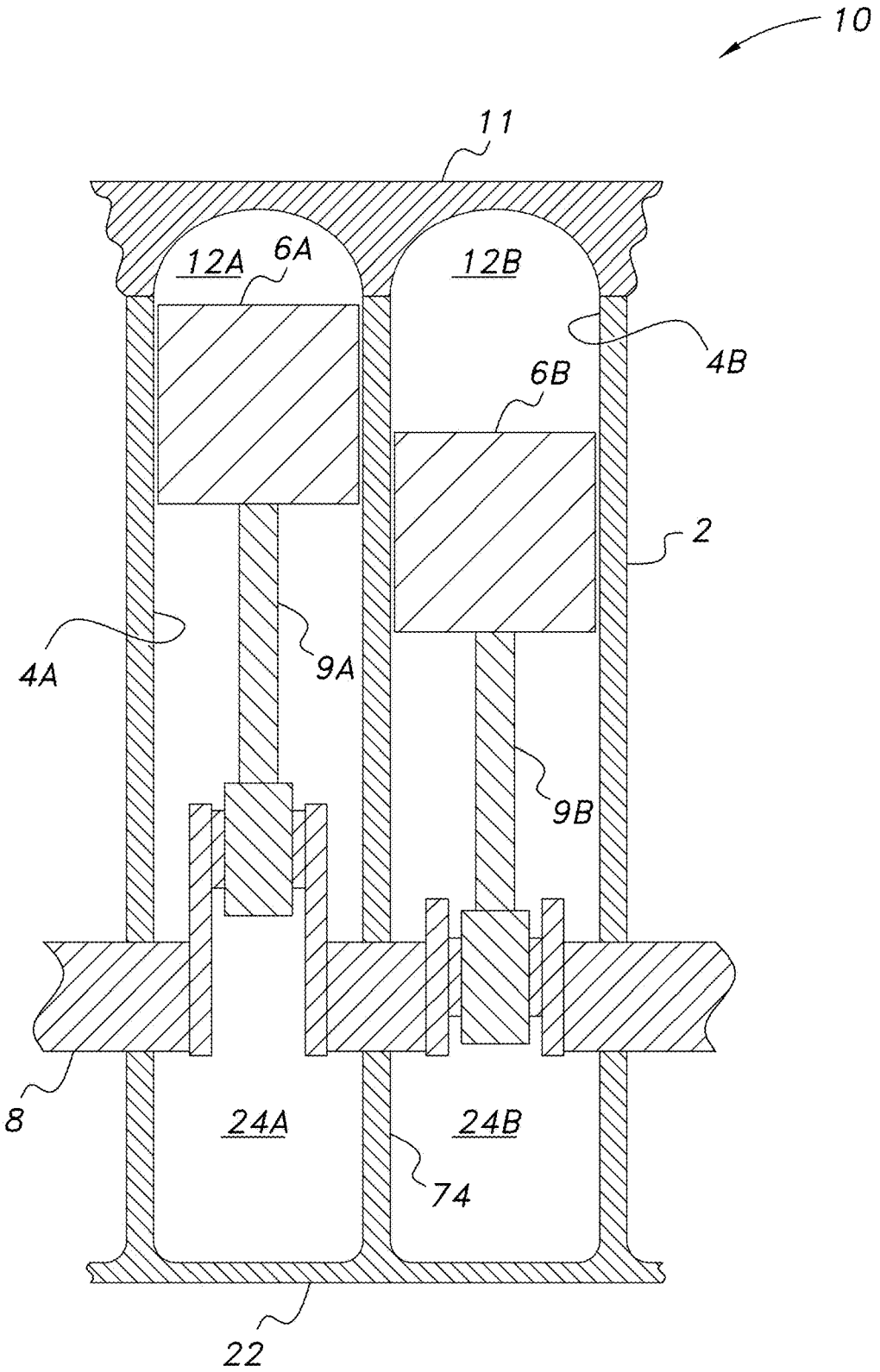
FIG. 8 is a frontal elevation cross-section view of a multi-cylinder engine in which a crankcase air compression supercharger according to the present inventive concept may be implemented.
Figure 15A:
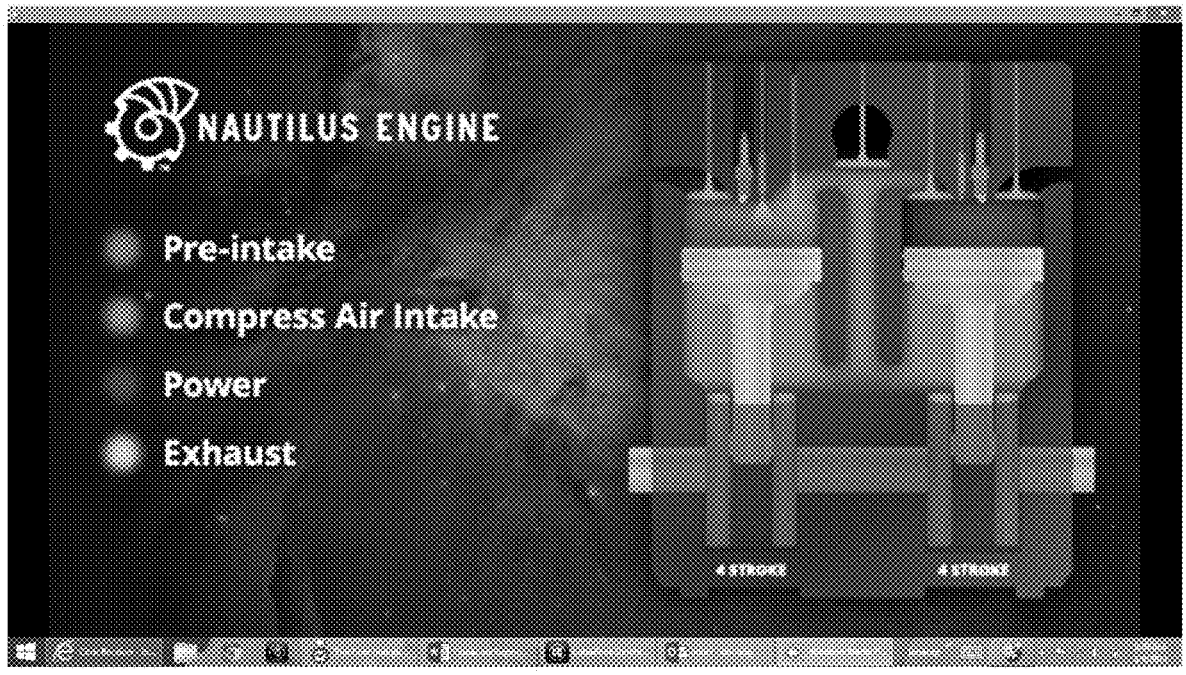
FIGS. 15*a* through 15*r* include various views of another embodiment of an engine of the inventive concept that includes two cylinders in which one cylinder assists the other cylinder with boost. In the embodiment shown in FIGS. 15*a* through *r* the curved portion/centrifuge of the induction conduit is oriented in a generally horizontal arrangement between a pair of cylinders.
Figure 15B:
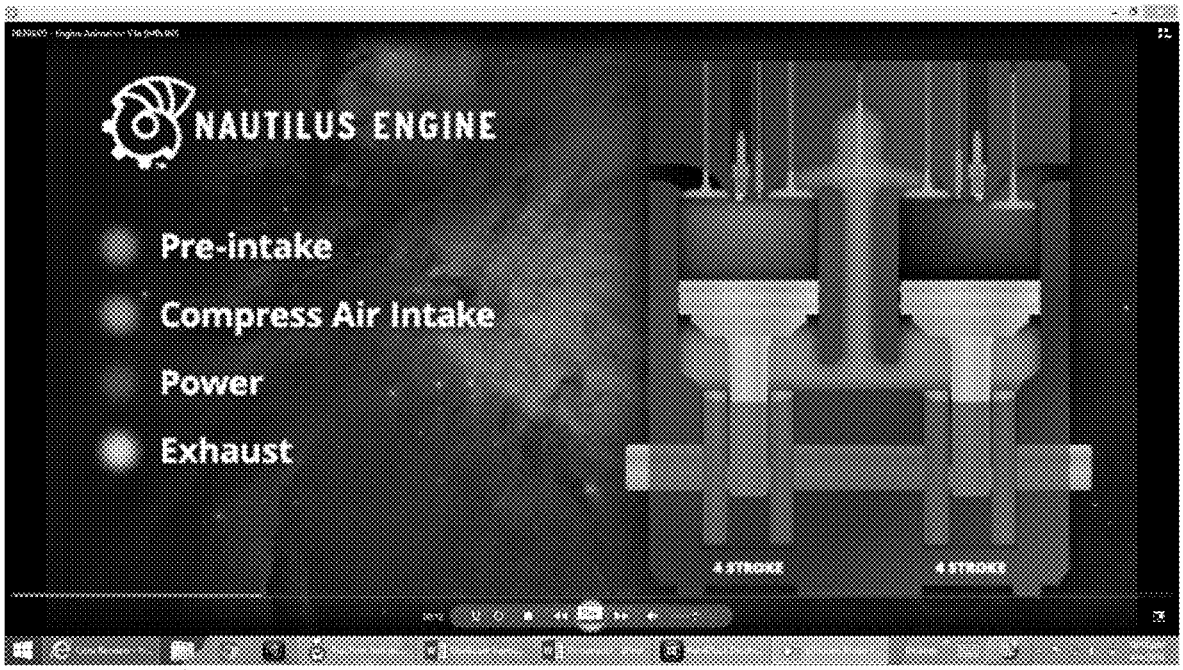
Figure 15C:
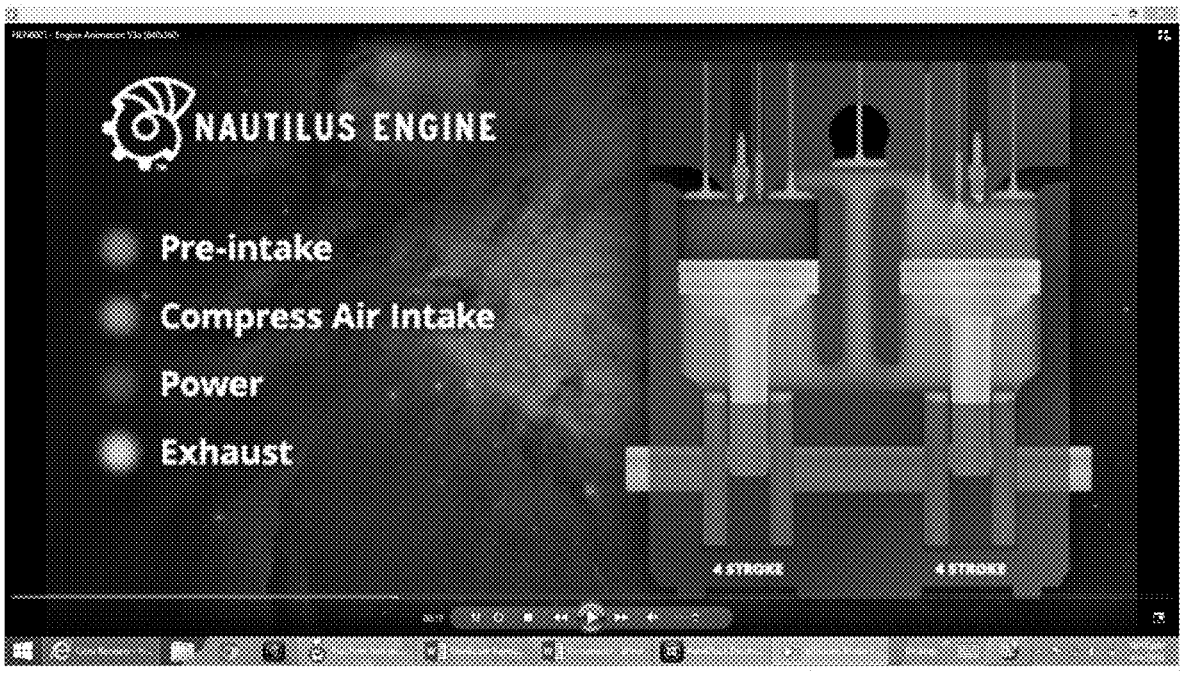
Figure 15D:
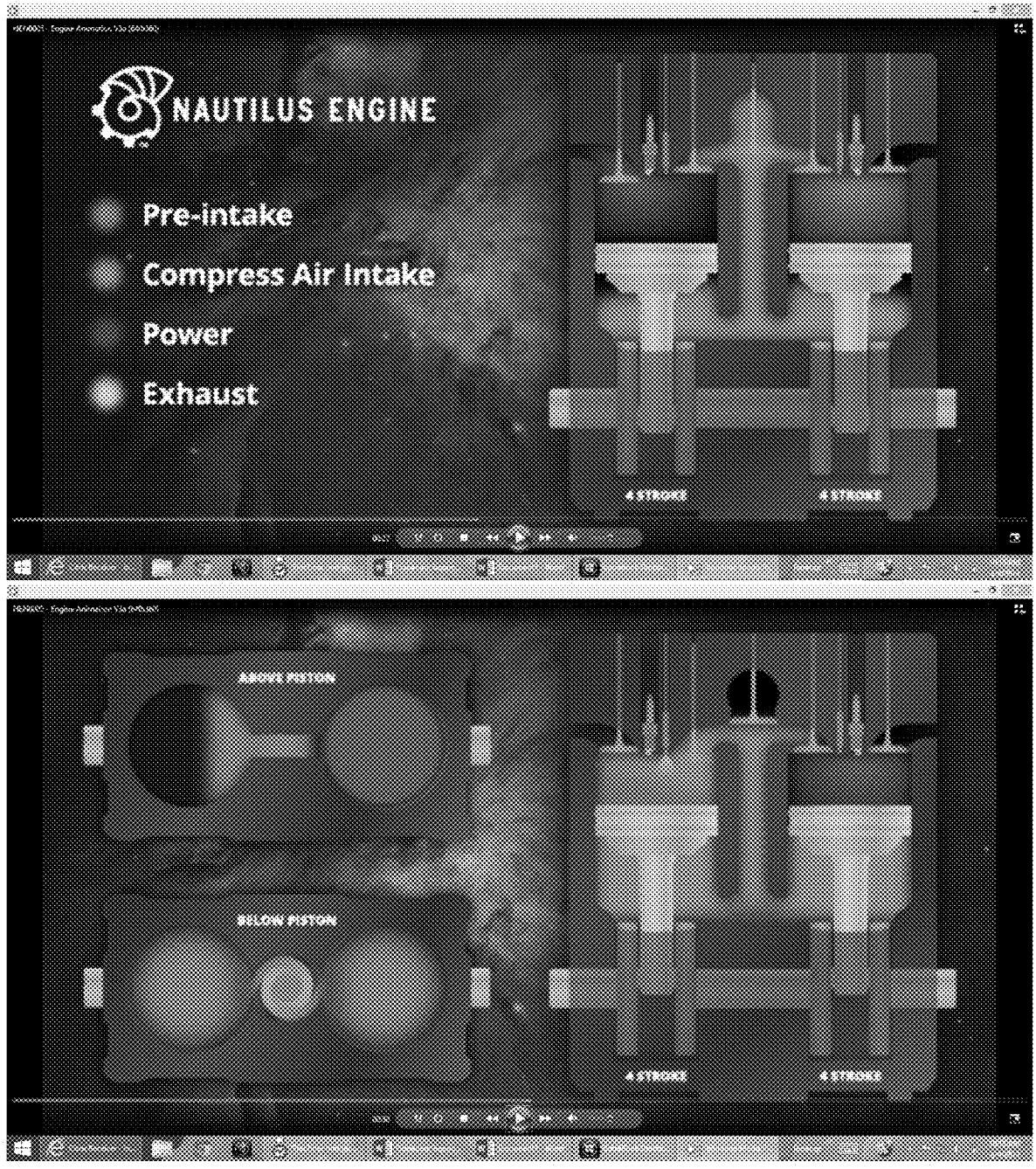
Figure 15E:
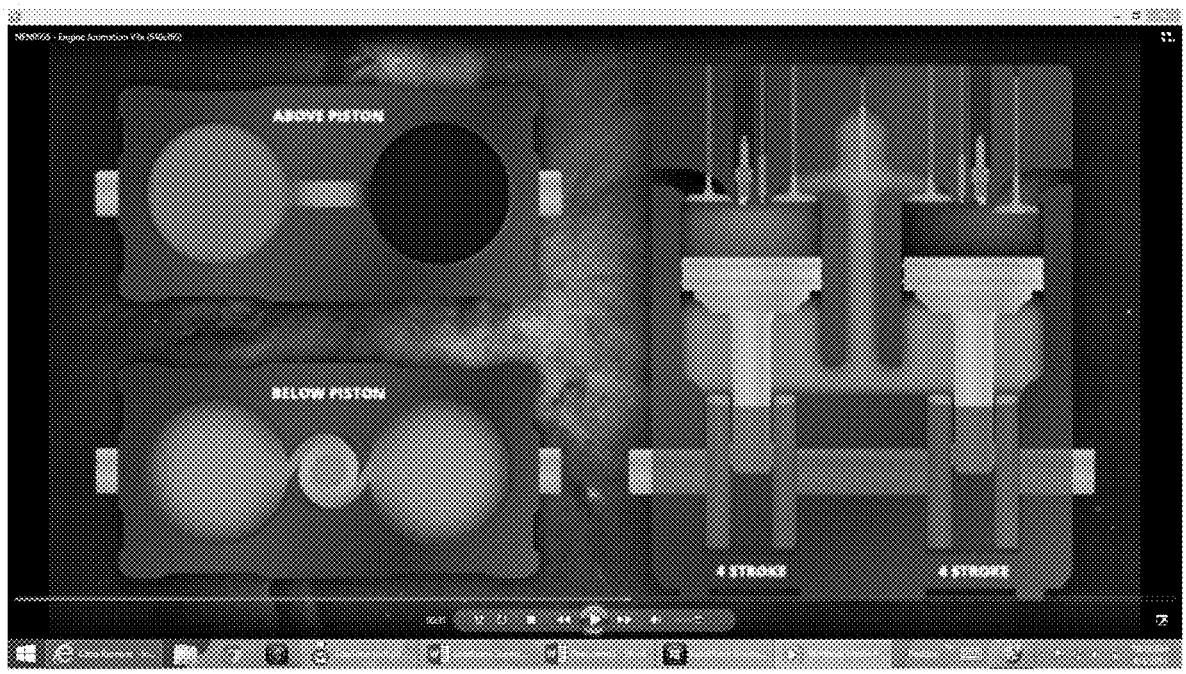
Figure 15F:
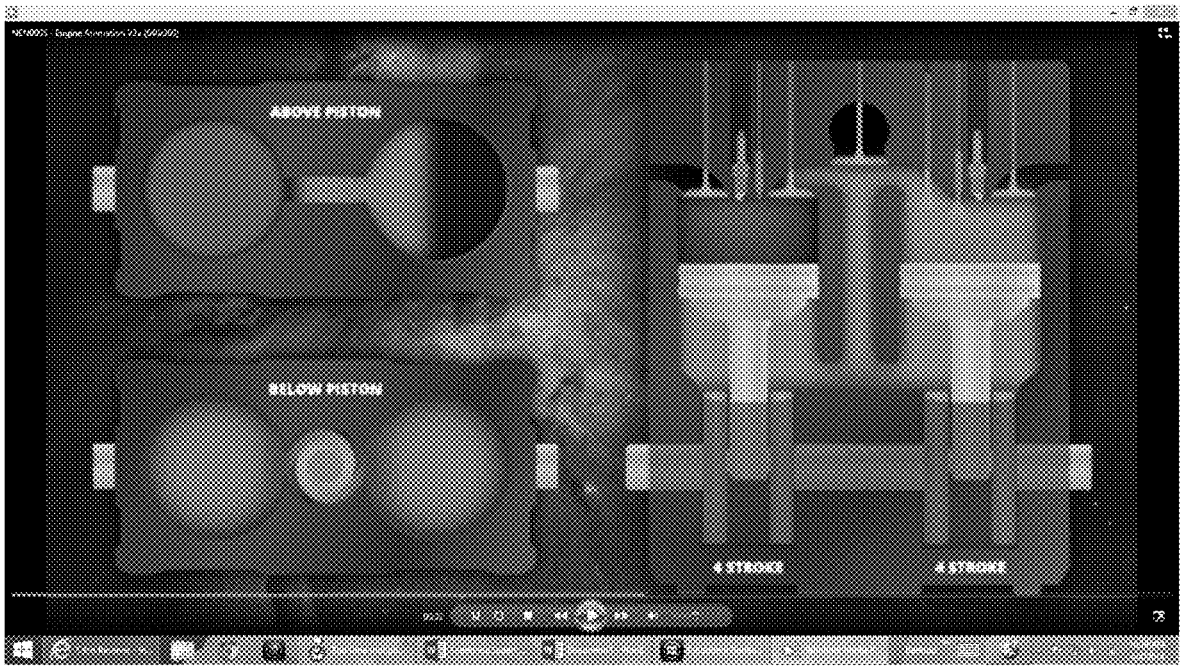
Figure 15G:
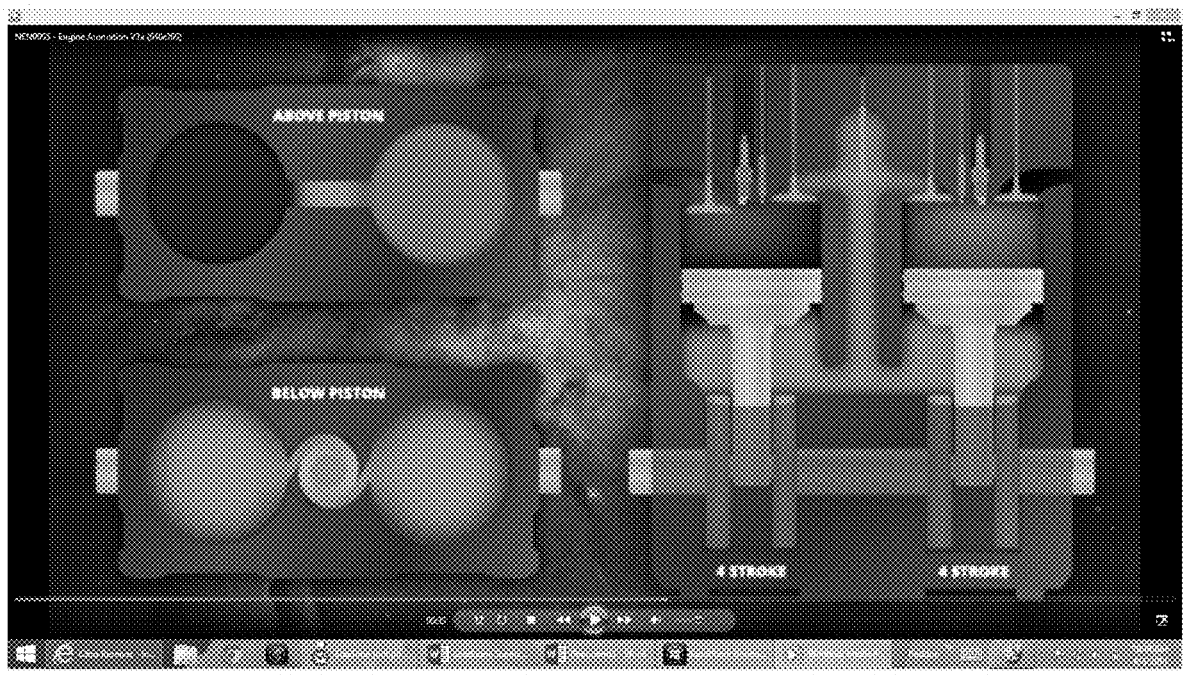
Figure 15H:
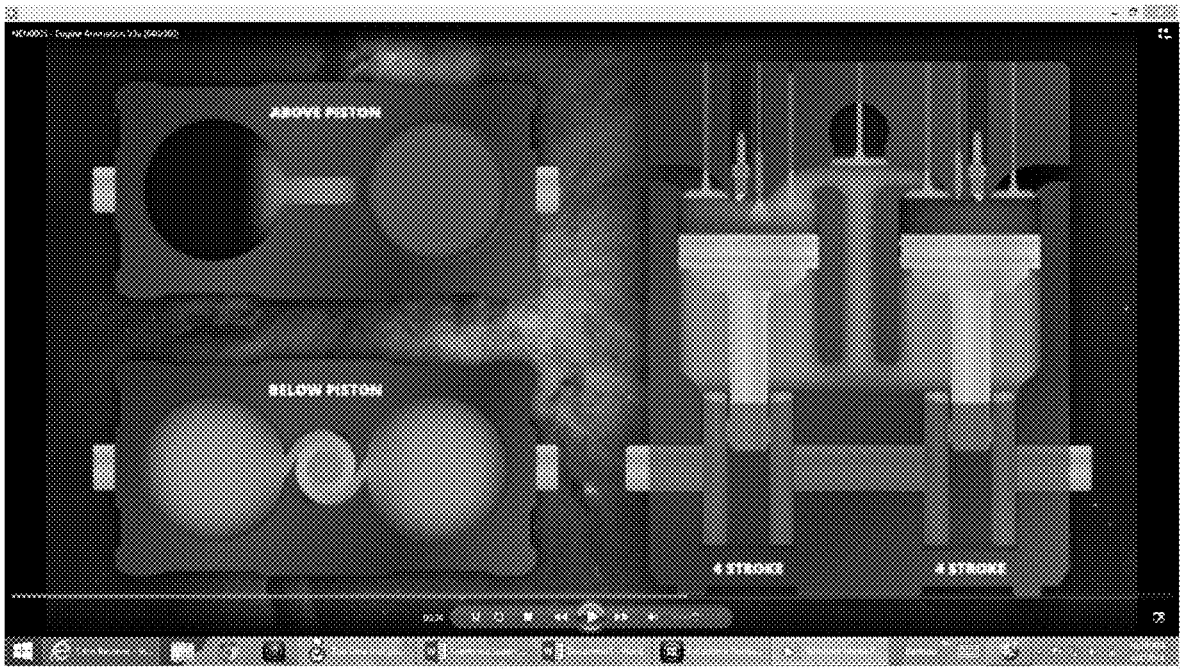
Figure 15I:
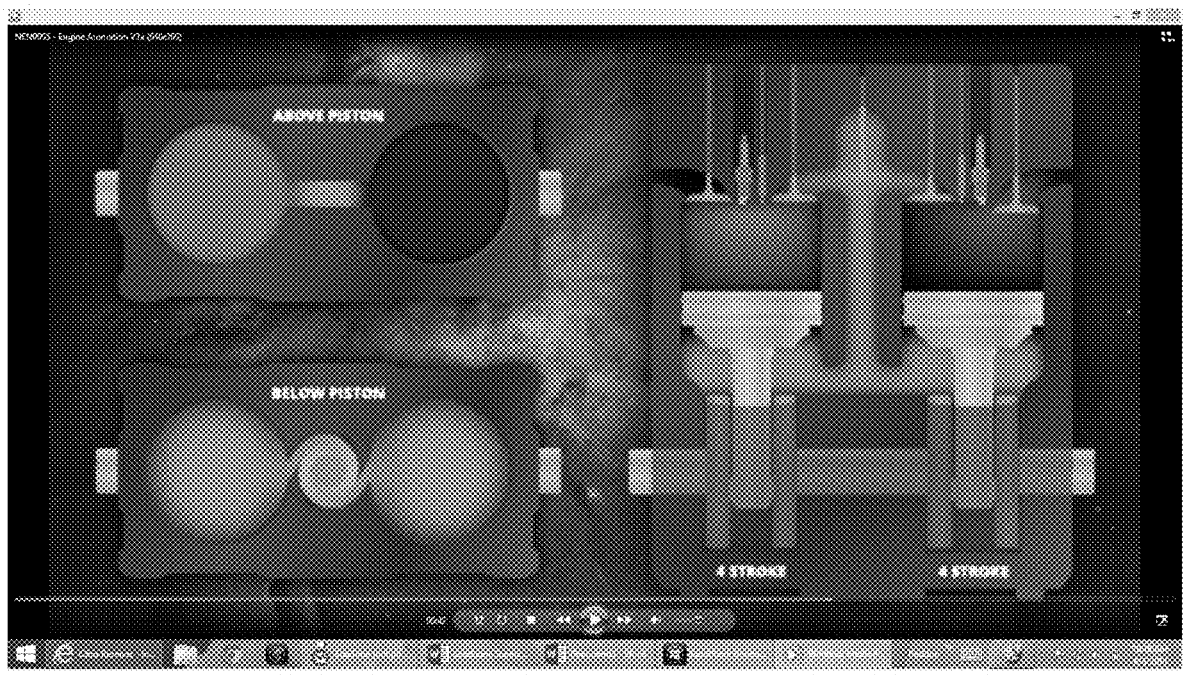
Figure 15J:
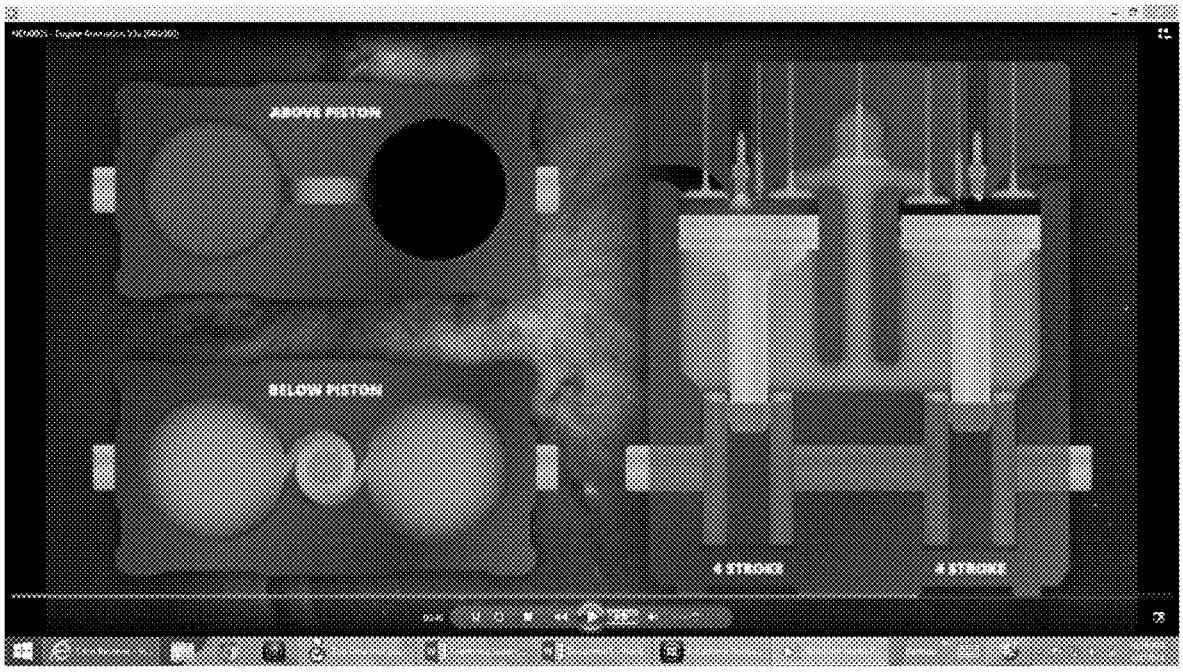
Figure 15K:
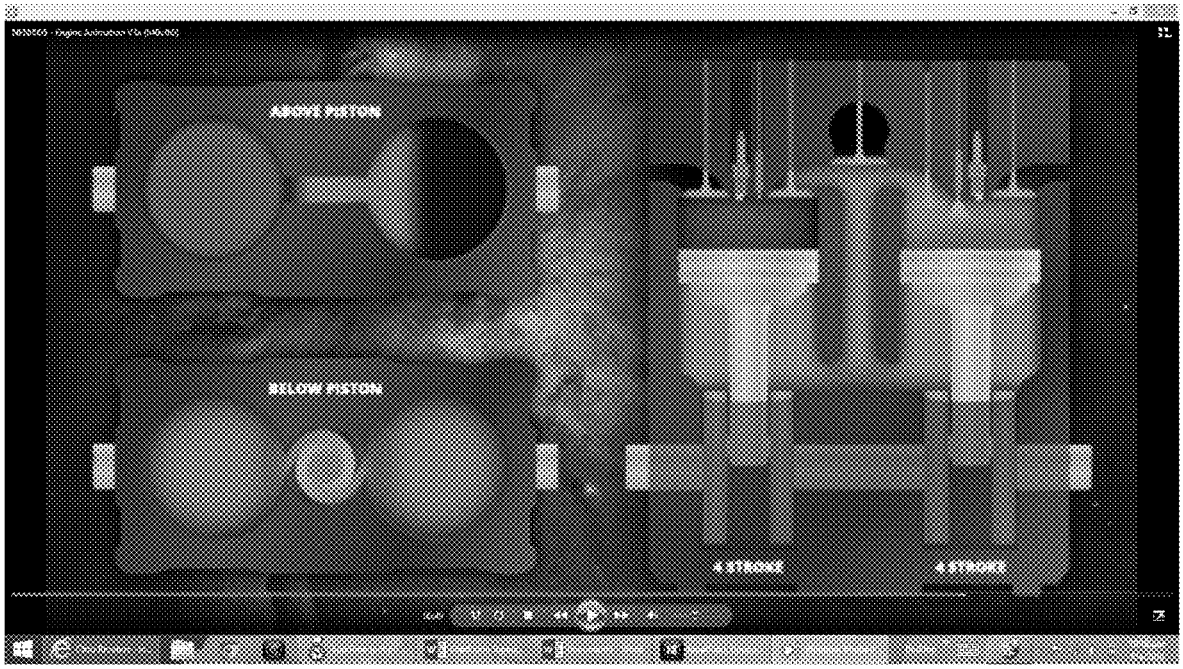
Figure 15L:
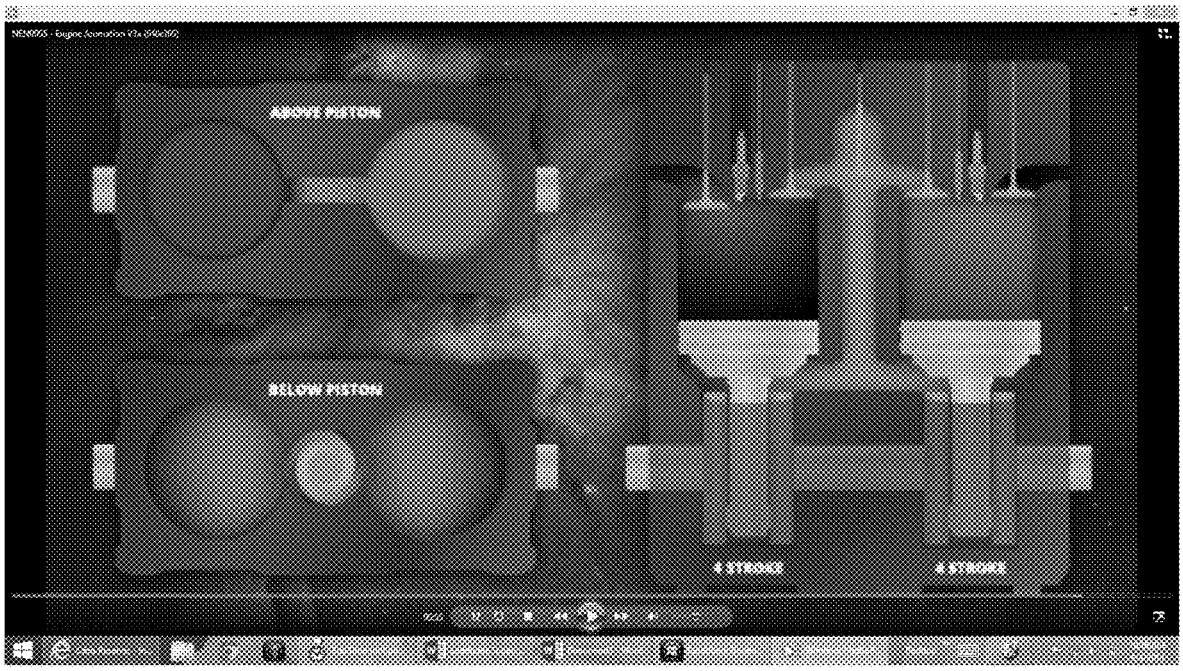
Figure 15M:
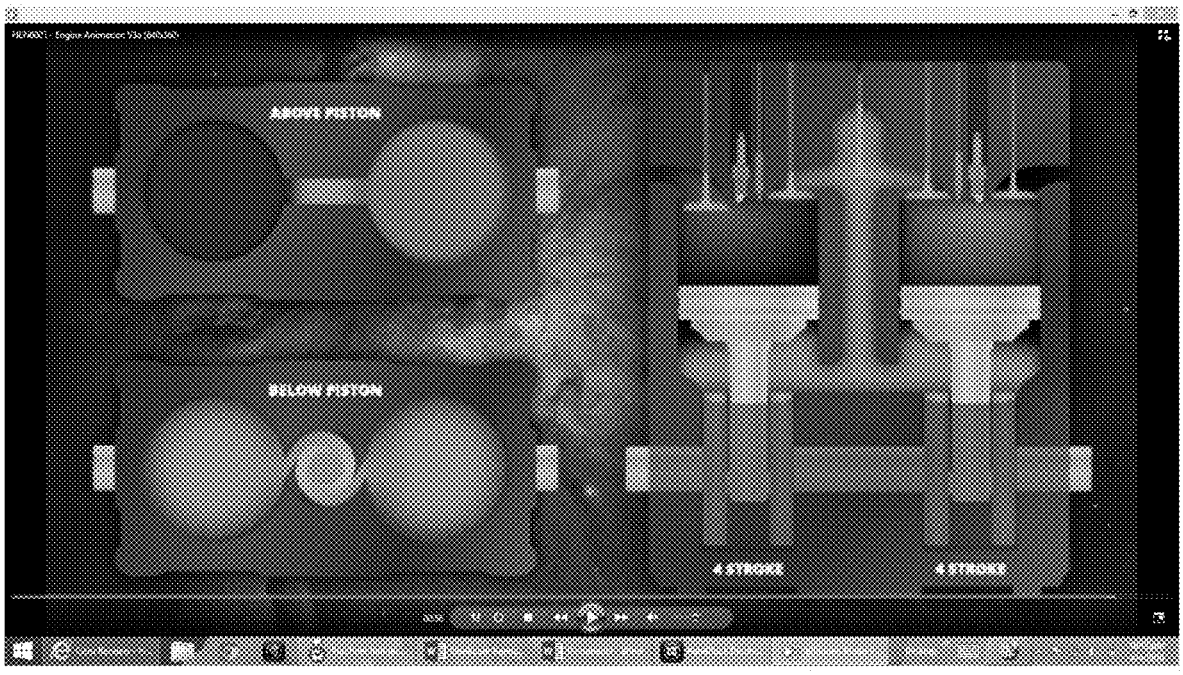
Figure 15N:
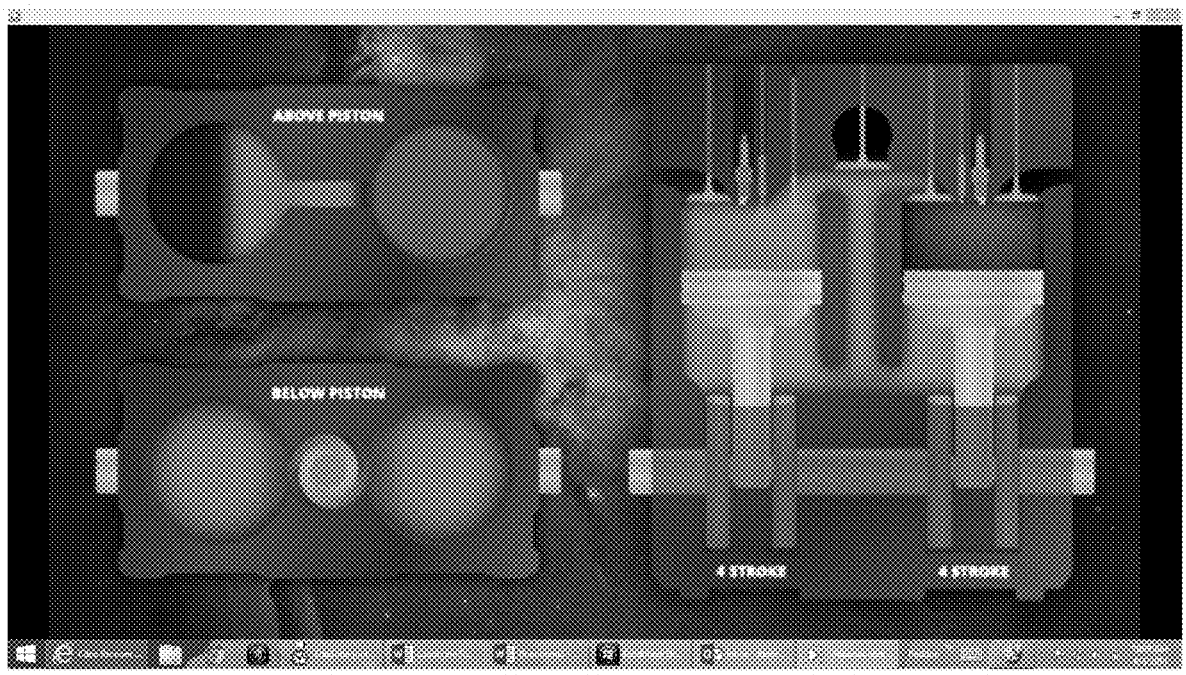
Figure 15O:
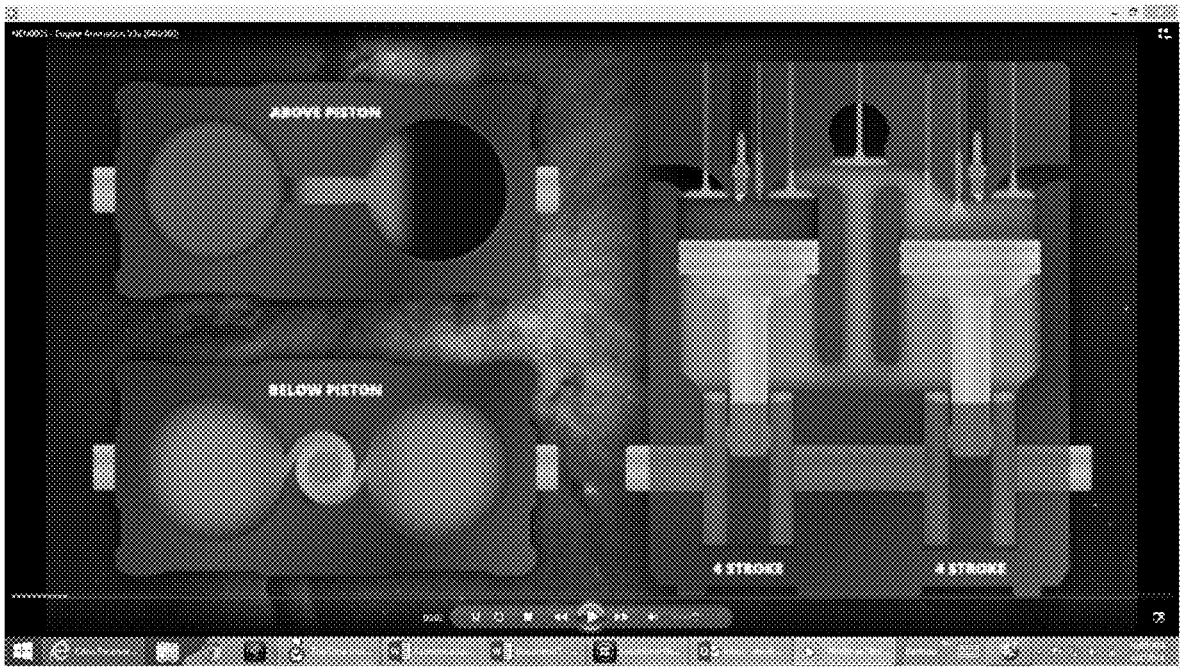
Figure 15P:
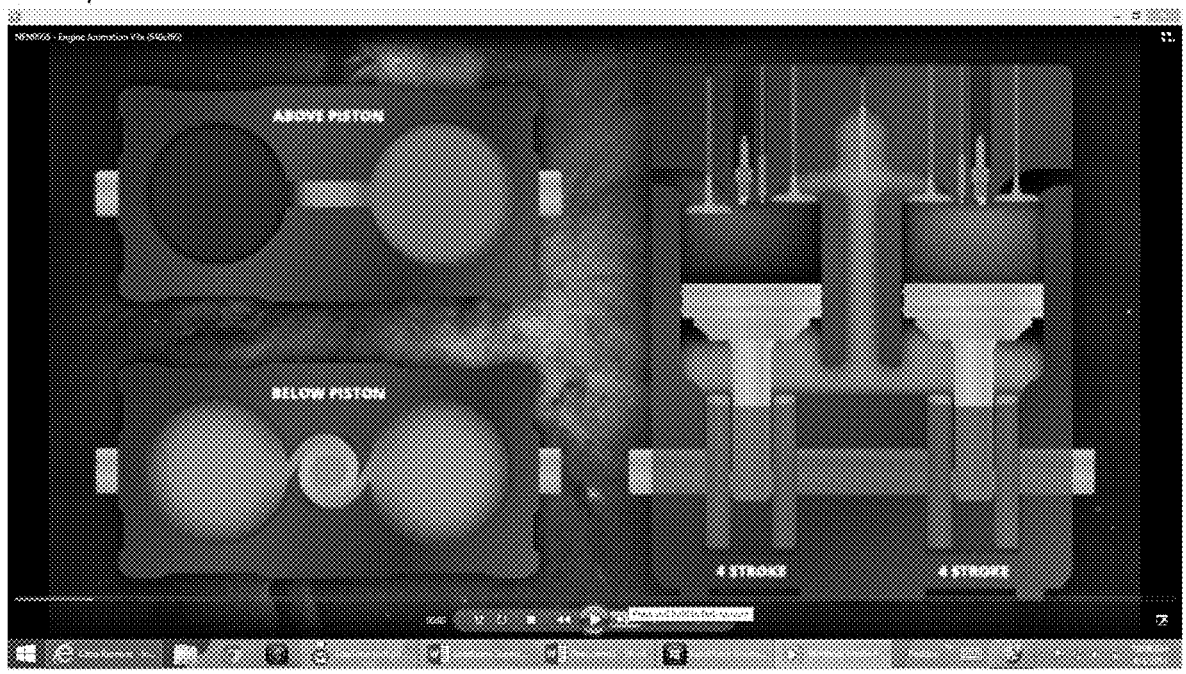
Figure 15Q:
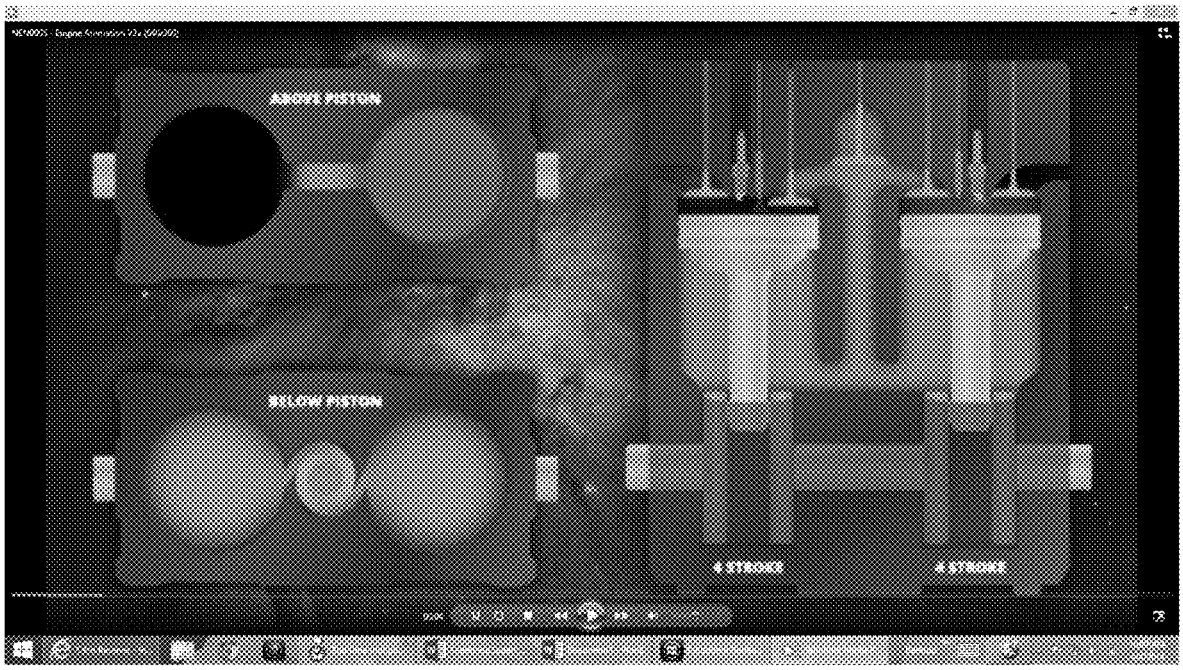
Figure 15R:
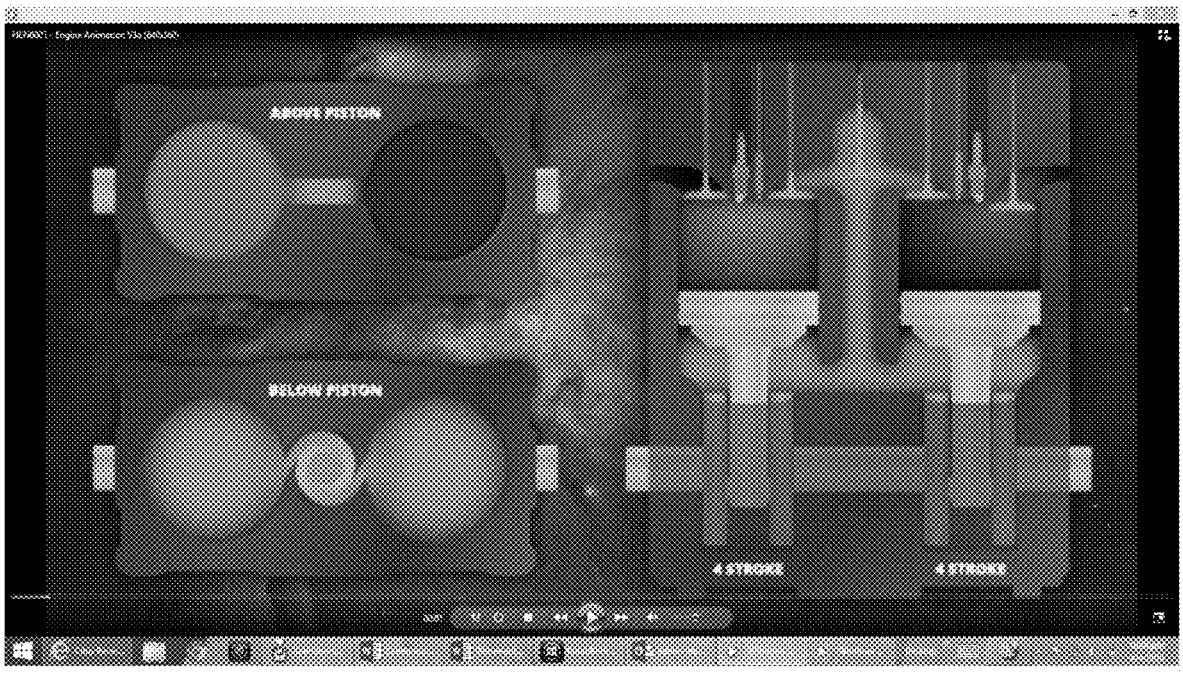

Referring to FIGS. 5, 5*a*, 10 and 13 in particular, the supercharger 29 of the embodiment shown includes an oil return feature configured to intercept oil droplets entrained in air flowing from the crankcase chamber 24 in the induction conduit, and to return intercepted oil droplets to the crankcase chamber 24. This discourages fouling of induction air by oil droplets and avoids loss of separated oil. In the embodiment shown in FIGS. 5 and 5*a*, the oil return feature includes a depression or sump 60 formed in the induction conduit, and a return conduit 62 configured to return intercepted oil to the crankcase chamber 24 from the sump 60. The return conduit 62 includes a unidirectional check valve 64 therein that is configured to enable oil to return to the crankcase by gravity but not to be propelled into the induction conduit from the crankcase chamber 24. Oil would be propelled into the induction conduit by piston compression of crankcase air if not for the check valve 64. In various embodiments, the check valve 64 comprises a ball and spring, a reed valve, or other structures now known or hereinafter developed (none shown). As shown in FIGS. 2, 3, 4, 4*a*, 9, 10, 11, 12 and 13, additional return conduits 63 are provided around the exterior of the curved portion of the induction conduit and continuing into the horizontal portion of the conduit. In some embodiments, the curved portion 56 of the conduit will be positioned within the crankcase chamber 24, with a portion of the induction conduit remaining outside the block 2 and the crankcase 22 of the engine 10. In some embodiments (including embodiments in which the curved portion 56 of the conduit is oriented vertically as shown in FIG. 5, as well as embodiments in which the curved portion 56 of the conduit is oriented horizontally as shown in FIGS. 15*a-r*), the cross-sectional shape of the curved portion 56 of the conduit utilized is a tear drop shape. In some such embodiments, the oil return feature is formed in the narrower portion of the tear drop profile (where fluid flow velocities are generally slowest), aiding in directing separated/intercepted oil to the oil return feature. The horizontal portion of the conduit and the accompanying return conduit(s) pass through the crankcase 22 or the block 2 to connect the curved portion 56 of the first section 36 to the remainder of the first section 36 outside the crankcase 22 and the block 2. In some embodiments, the curved/spiraled separation flow path of the oil separator shown extends through the horizontal portion of the conduit. Because the oil separator isolates and separates oil with pneumatic oscillation centripetal force, the higher the frequency, which is created by the tighter and tighter spiral as the separator continues through the horizontal portion of the conduit, the better the separation. As is shown in the figures, the return conduits 63 are formed in the generally solid cylindrical base in which the curved portion of the conduit is formed.

Figure 13:
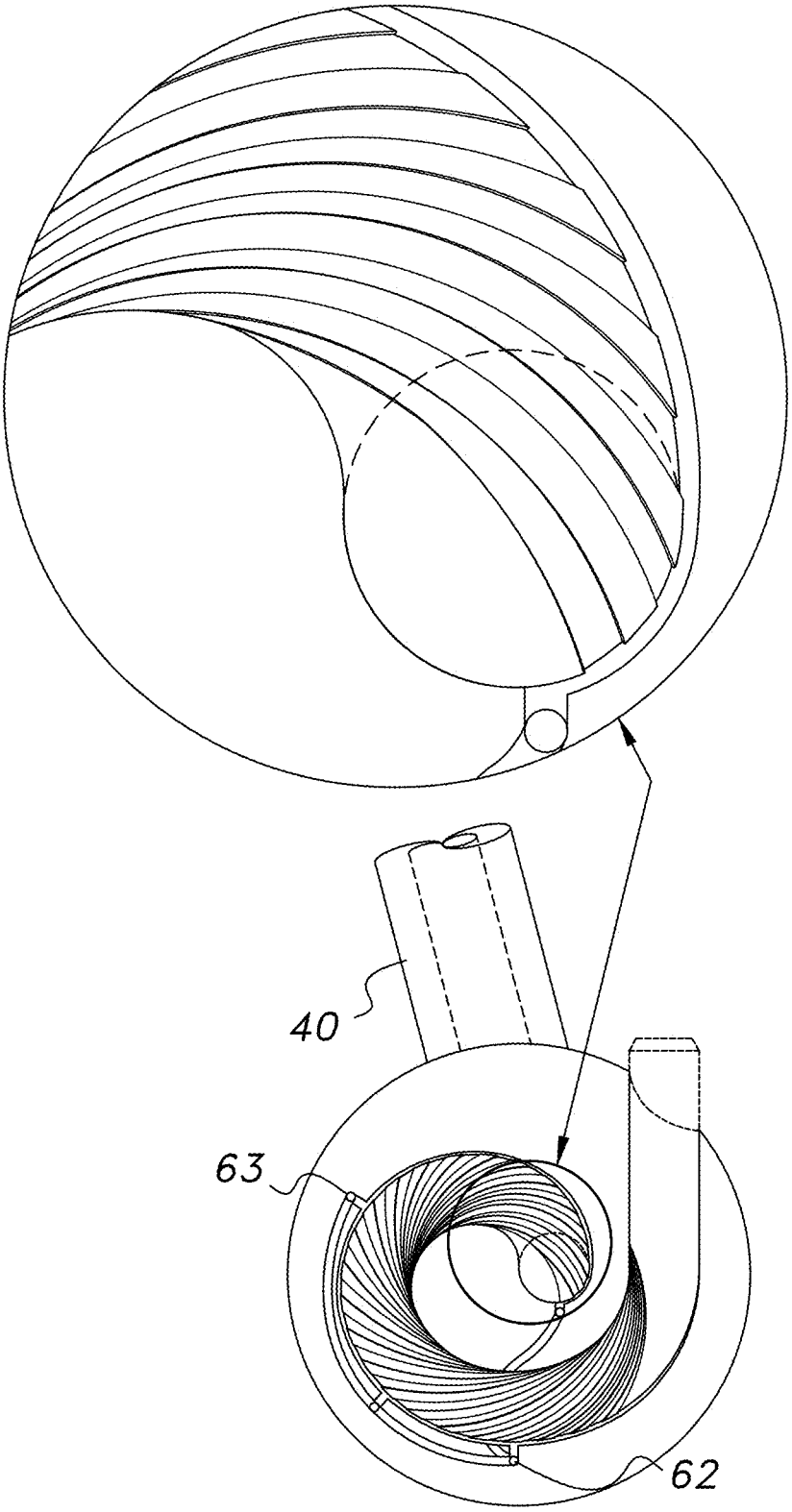
FIG. 13 is a schematic detail cross-section taken along line 12-12 of FIG. 4 and including a detailed view of an outlet end portion of the oil separator/centrifuge section of the conduit.
Figure 14A:
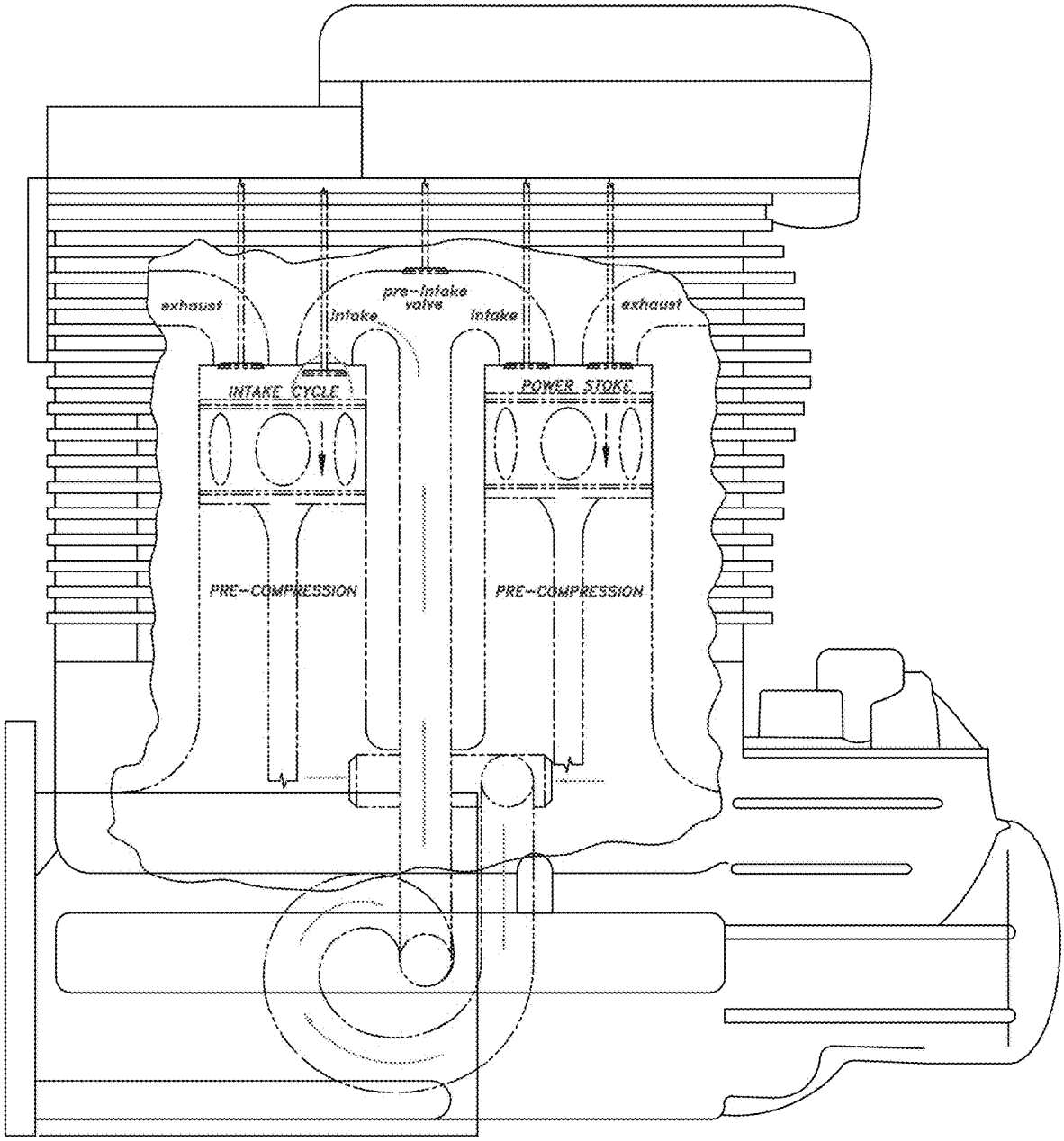
FIG. 14*a* is a partial section side view of an embodiment of an engine of the inventive concept that includes two cylinders in which one cylinder assists the other cylinder with boost. In the embodiment shown in FIG. 14*a* the curved portion/centrifuge of the induction conduit is oriented in a generally vertical arrangement generally or partially between a pair of cylinders.
Figure 14B:
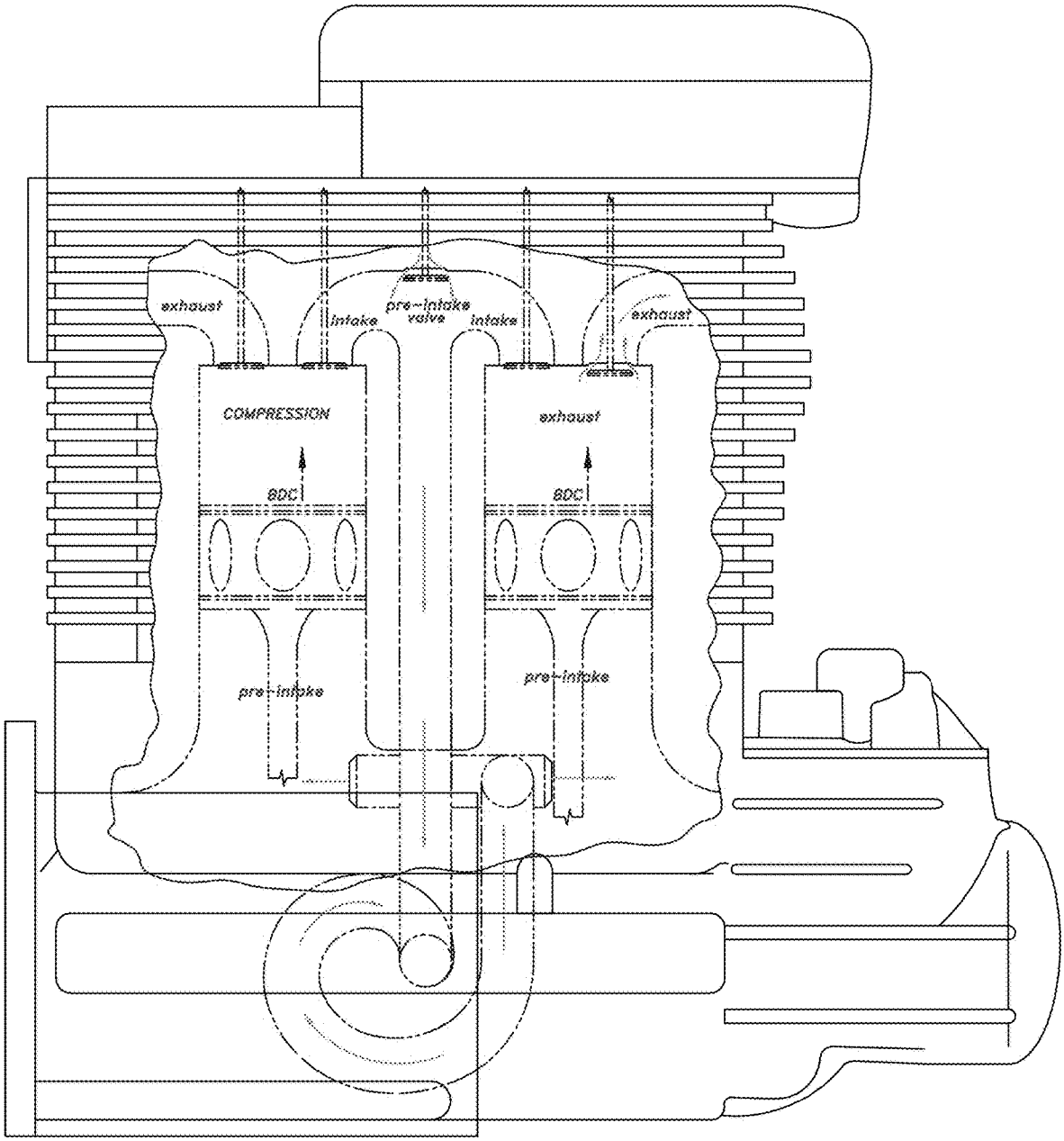
FIG. 14*b* is another partial section side view of the engine of FIG. 14*a* showing the first cylinder in a compression cycle and the second cylinder in an exhaust cycle.
Figure 14C:
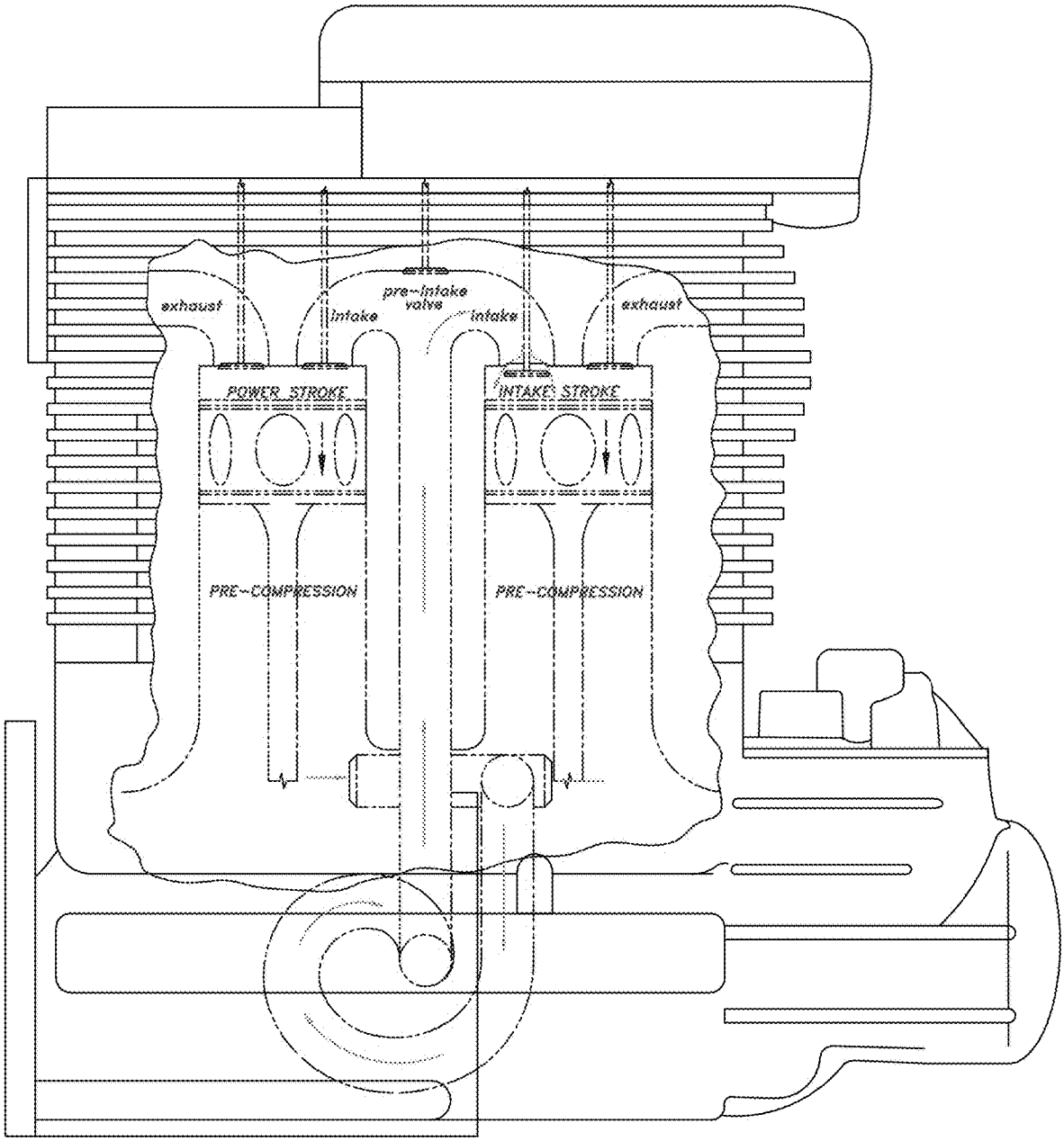
FIG. 14*c* is another partial section side view of the engine of FIG. 14*a* showing the first cylinder in a power stroke cycle and the second cylinder in an intake cycle.
Figure 14D:
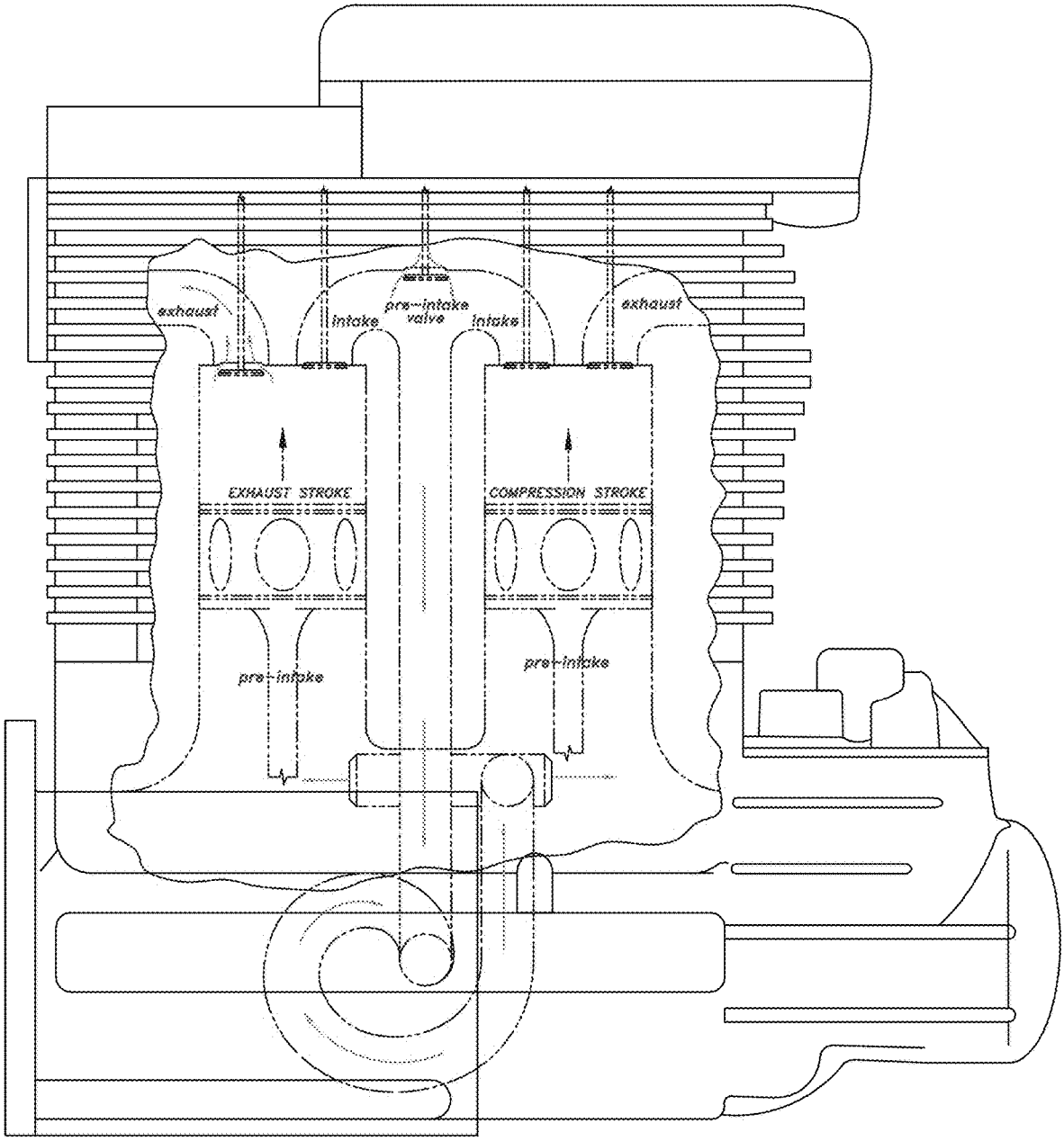
FIG. 14*d* is another partial section side view of the engine of FIG. 14*a* showing the first cylinder in an exhaust cycle and the second cylinder in a compression cycle.
Figure 14E:
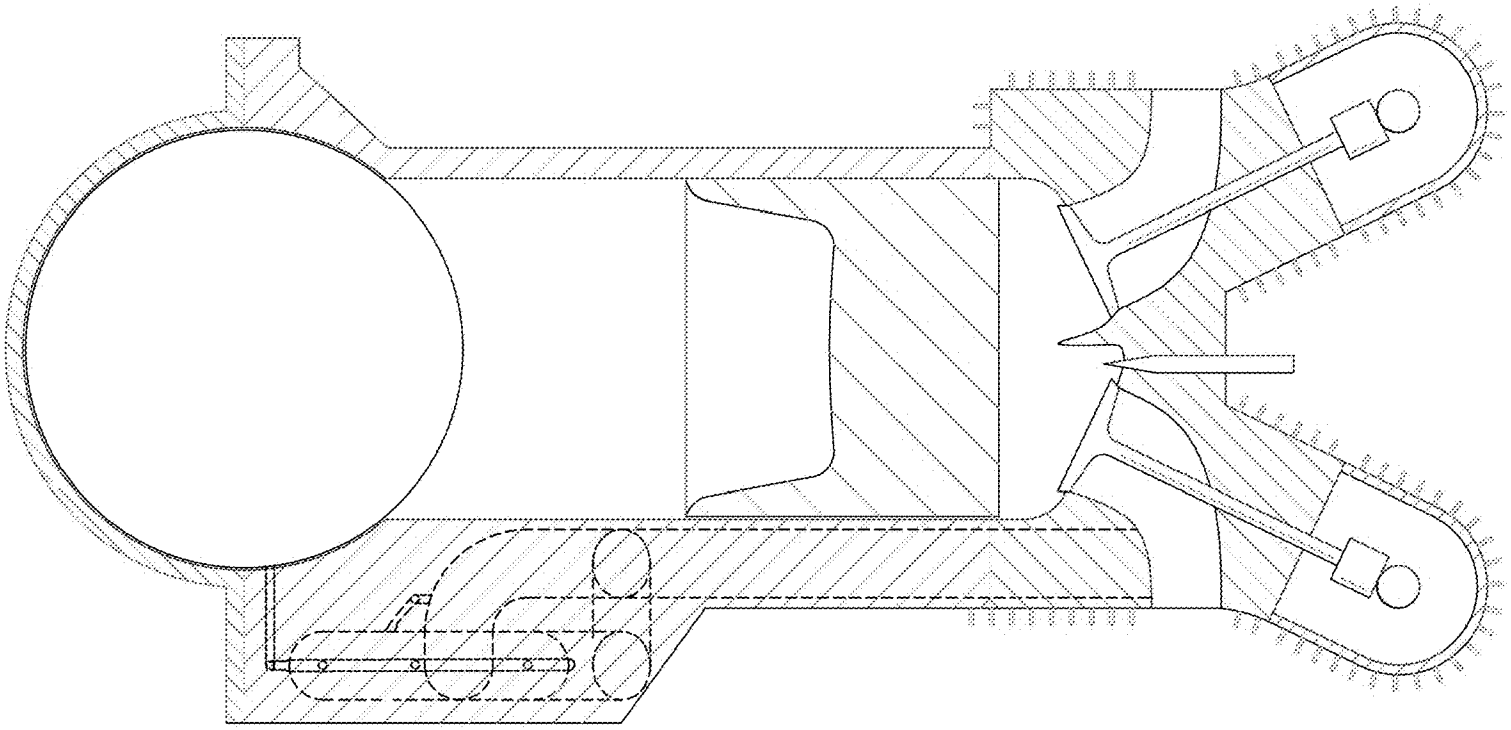
FIG. 14*e* is a front side section view of the engine of FIG. 14*a* showing an embodiment of the supercharger located outside of the engine crankcase with connecting tubes branching from the crankcase intake of the induction conduit through ports in the crankcase and into the crankcase below each of the pistons.

Again referring to FIGS. 4*a*, 5, 5*a*, 10 and 13 in particular, the induction conduit of the embodiment shown includes an oil collection channel 58 formed in a wall (or protruding from the wall further into the generally solid cylindrical base in which the curved portion of the conduit is formed) of the induction conduit. Channel 58 is located generally at the exterior-most portion of the conduit, which is where the centripetal force is generally directed. The oil collection channel 58 includes branch channels 59 which radiate from channel 58 generally around the circumference (in circular embodiments) of the conduit, as is illustrated in detail in FIG. 5*a*. The branch channels extend along the internal surface of the induction conduit at an acute angle such as generally forty-five degrees from the oil collection channel 58. The oil collection channel 58 and the branch channels 59 expedite passage of oil separated from air by centrifugal forces and precipitated on the exterior wall of the induction conduit to the sump 60. As is shown in FIGS. 10 and 13, the collection channel 58 originates generally near the crankcase intake of the induction conduit at the point along the exterior wall where it begins to curve to form the centrifuge. The collection channel 58 continues along the exterior wall to the end of the curved portion of the conduit forming the centrifuge, where it drains into the final return conduit 62 (shown in FIG. 13 in detail). Also, as is shown in FIGS. 10 and 13, the branch channels extend upward along the walls of the conduit forming the generally spiraled pattern shown. As is shown, the ends of the branch channels 59 are spaced closer to one another along the inner wall of the conduit and spaced further apart and angle "downstream" (e.g. further from the crankcase intake end of the conduit) toward the outer wall of the conduit and the collection channel 58. This design increases oil collection from the branch channels and into the collection channel, taking advantage of the shape of the conduit and direction of air flow. It will be appreciated that other embodiments include different channel orientation, design and spacing.

It will be appreciated that FIG. 5*a* is representative of the induction conduit for illustration purposes only. As is discussed herein, in the embodiments shown in the drawings, the induction conduit is formed within a generally solid cylindrical base. As such, the wall thicknesses depicted in FIG. 5*a* are merely for purposes of illustration. Furthermore, it will be appreciated, that although not shown in FIG. 5*a*, in some embodiments channels 58 and 59 protrudes into the generally solid cylindrical base beyond the interior walls of the induction conduit.

Referring to FIG. 4*a*, the induction conduit in the embodiment shown includes a constriction at the end of the conduit inside the crankcase chamber 24 (i.e. the crankcase intake end). The constriction increases vacuum developing during flow of air within the induction conduit responsive to piston travel, which constriction enhances interception of oil droplets by the oil collection channel 58 and the branch channels 59, and return of collected oil to the crankcase 24 through the return conduits 62 and 63. In other embodiments the constriction is located other than at the very end of the induction conduit opening to the crankcase chamber 24 as illustrated in FIG. 4*a*.

Figure 9:
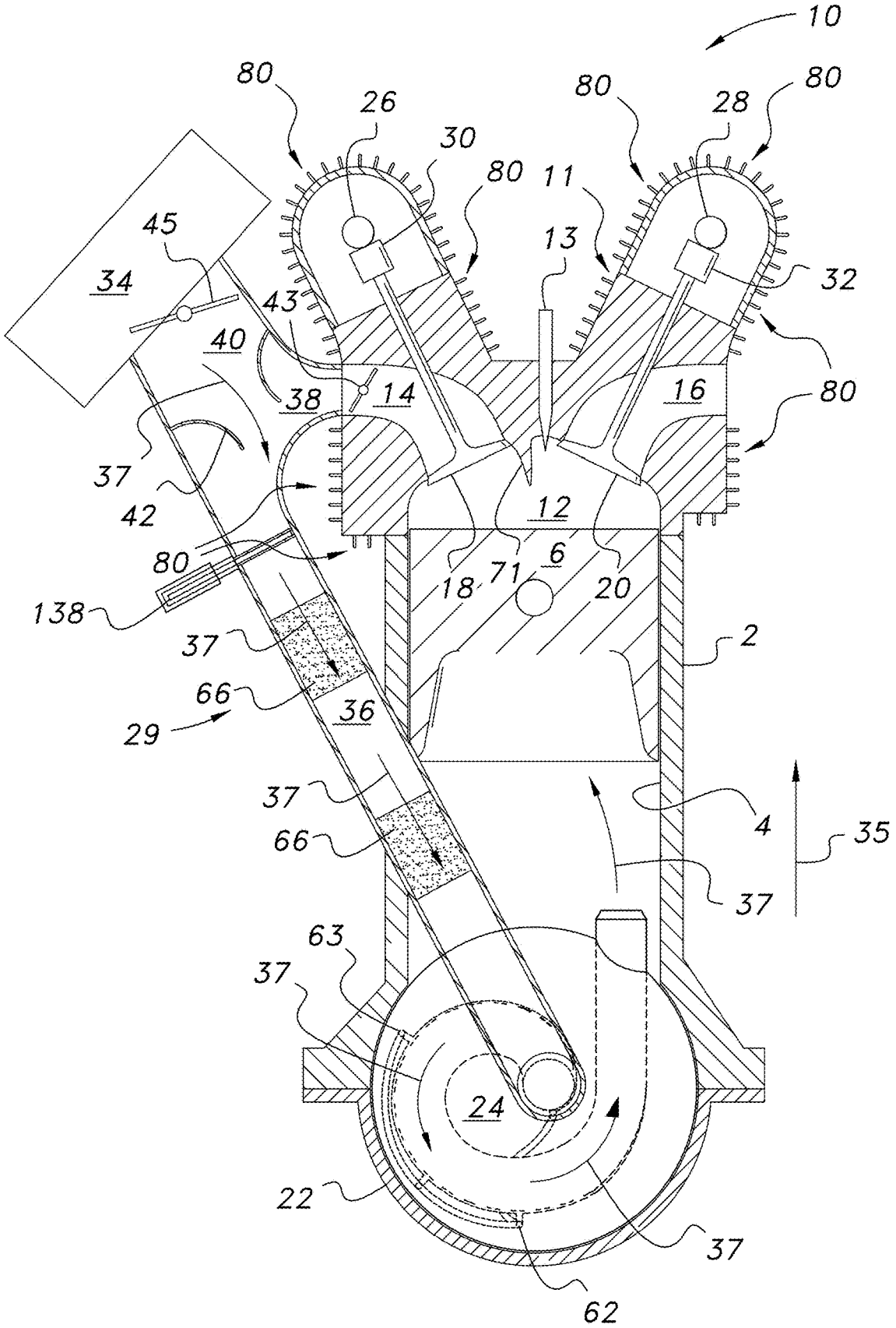
FIG. 9 is a schematic frontal elevation cross-section view of a two-stroke engine in which an embodiment of a crankcase air compression supercharger according to the present inventive concept is implemented.
Figure 11:
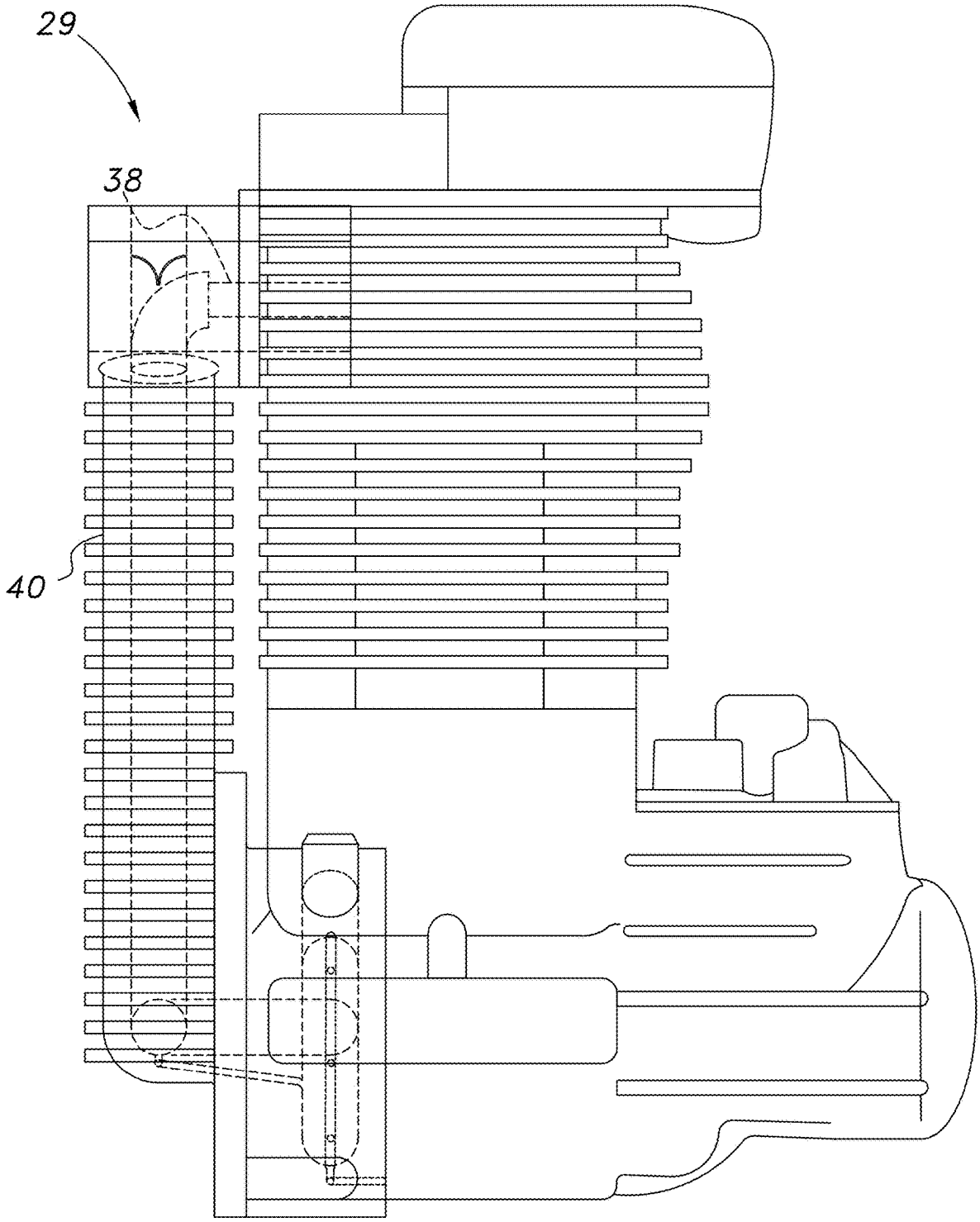
FIG. 11 is a representative side view of the engine of FIG. 2.

Turning now to FIG. 6, the supercharger 29 of the embodiment shown includes at least one flow guide 66 located in the induction conduit and configured to oppose swirl, roll, or tumbling in flow of air in the induction conduit. The flow guide 66 subdivides the cross sectional area of the induction conduit into smaller, parallel paths. Although these parallel paths are shown as being wedge-shaped in FIG. 6, in other embodiments they will be rectangular, circular, or of still other configurations now known or hereinafter developed (none shown). The flow guide 66 occupies a limited extent of the length of the induction conduit as is shown in FIGS. 2, 3 and 9. The flow guide 66 is generally located between the curved portion 56 of the first section 36 and the second section 38. As such the flow guide 66 discourages incoming induction air from mingling with air from the crankcase chamber 24, which could promote cross contamination of induction air with oil droplets.

Referring to FIG. 7, under some conditions of engine operation, it may be desirable to reduce the amount of induction air entering the combustion chamber 12. To this end, the supercharger 29 of the embodiment shown in FIG. 7 includes a bypass feature configured to enable some air propelled under pressure from the crankcase chamber 24 to avoid being inducted into the combustion chamber 12. The bypass feature of the embodiment shown includes a bypass conduit 68 which bypasses the check valve 42, the bypass conduit 68 opening to the first section 36 at one end, and to the third section 40 at an opposing end. In the embodiment shown the bypass conduit 68 is controlled by a valve 70 under the control of an electrical or electronic controller 72 enabling remote control of the bypass function. In some embodiments, the valve 70 will progressively and variably control cross sectional area of the bypass conduit 68, rather than being limited to only the closed position and a fixed open position. It will be appreciated that in other embodiments alternative valve designs will be utilized. In FIG. 7 direction arrows are used to illustrate air flow from the induction conduit through the bypass conduit 68 to the atmosphere. It will be appreciated that in some embodiments the bypass valve 70 is bidirectional, allowing air flow from the atmosphere into the induction conduit as well as from the induction conduit to the atmosphere. In other embodiments the bypass valve 70 is unidirectional, only allowing air to flow from the induction conduit to the atmosphere.

In FIG. 3, the internal combustion engine 10 is a single cylinder internal combustion engine of the four-stroke cycle, liquid cooled type. Alternatively, and referring to the embodiment shown in FIG. 8, the internal combustion engine 10 is a plural cylinder engine including a barrier 74 between every two adjacent cylinders 4A, 4B where the pistons 6A, 6B do not move in tandem. The engine 10 shown in FIG. 8 will include features of the engine 10 of FIG. 1, notably, an engine block 2, a cylinder head 11, combustion chambers 12A, 12B, a crankcase 22, pistons 6A and 6B, and respective connecting rods 9A and 9B, in addition to necessary support systems such as cooling system, ignition system, fuel system, and lubrication system (none shown). The barrier 74 prevents air in the crankcase chamber from shuttling ineffectually from beneath one piston (e.g., the piston 6A) to beneath the other piston (e.g., the piston 6B). Rather, the barrier 74 divides the crankcase chamber into independent crankcase subchambers 24A and 24B, with each crankcase subchamber 24A or 24B effectively establishing partial vacuum and superatmospheric pressure responsive to reciprocation of their respective pistons 6A, 6B. Hence in some embodiments of the inventive concept each cylinder 4A or 4B is provided with an individual induction conduit such as the induction conduit of FIG. 2. For engines having plural cylinders wherein pistons reciprocating in tandem (not shown), a single induction conduit, such as an embodiment of the induction conduit modified to discharge air to the two intake ports of both cylinders 4A, 4B (not shown in FIG. 8, but which is generally equivalent of those shown in FIG. 1) of both cylinders 4A, 4B will be provided and modified to serve the two cylinders 4A, 4B.

FIG. 9 shows a two-stroke, air cooled internal combustion engine 10. The engine 10 shown in FIG. 9 includes similar features of the engine 10 of FIG. 1, notably, an engine block 2, a cylinder head 11, a combustion chambers 12, a crankcase 22, a pistons 6, a connecting rod 9, a crankshaft 8 (not shown in FIG. 9, but similar in function to the crankshaft 8 of FIG. 1), in addition to necessary support systems such as cooling system, ignition system, fuel system, and lubrication system (none shown).

To accommodate two-stroke operation, the camshafts 26 and 28 are arranged to rotate once for each revolution of the crankshaft. A flow guide 71 is provided to prevent immediate loss of incoming induction air through the exhaust port 16. The engine block 2 includes an inlet port 14 and an outlet port 16. An induction conduit is provided, being similar in function and configuration to that of the engine depicted in FIG. 2, having a first section 36, a second section 38, a third section 40, and a check valve 42. A fuel injector 13 is arranged for direct cylinder injection. The fuel injector is generally opposite to a spark plug for the cylinder (not shown). It will be appreciated that some embodiments of the four-stroke engines according to the present disclosure will include direct cylinder injection.

The internal combustion engine 10 of FIG. 9 includes fins 80 for cooling. If desired, more active and effective air cooling is achieved by providing a cooling fan (not shown) which forces atmospheric air between a shroud (not shown) and the fins 80. A liquid cooling system such as that of FIG. 1 is provided if desired in other embodiments. As is shown in FIGS. 4, 4*a*, 11 and 12, the supercharger 29 of the embodiment shown also includes fins for cooling the air as it flows through and/or is compressed within the induction conduit. Although the embodiment shown utilizes an air intercooler, it will be appreciated that other embodiments utilize alternative systems for intercooling, including but not limited to liquid intercoolers.

As is shown in FIGS. 2, 3 and 9, some embodiments of the inventive concept include a safety mechanism that is designed to prevent oil from the crankcase from draining into the combustion chamber and/or into the atmosphere in the event the engine is turned upside down. The safety mechanism of the embodiment shown comprises a slide-type shutoff valve 138, similar to RV gray water and black water dump valves. The valve is controlled by a solenoid to slides open and closed with a solenoid control that is triggered by a switch/sensor, such as a Mercury switch or inertial switch. When the engine turns upside down the switch causes the solenoid to close the valve and prevents any oil from within the crankcase from draining into the engine intake or into the environment.

In some embodiments of the inventive concept the internal combustion engine utilizes a combustion process similar to that of the Miller cycle. The Miller cycle is a thermodynamic combustion process that is utilized with two-stroke, four stroke, diesel fuel, gas fuel or dual fuel engines. A Miller cycle engine operates in very similar manner to traditional two-stroke and four-stroke engines (such as are discussed above) with a major distinction being that the compression stroke in a Miller cycle engine is, in effect, two discrete cycles or stages: 1) an initial stage in which the intake valve is open; and 2) a final stage in which the intake valve is closed. In this two-stage compression stroke, as the piston initially moves upwards in what is traditionally the compression stroke, the charge is partially expelled back out through the open intake valve. This results in increased efficiency because less energy is required to compress the charge during the compression stroke. Notwithstanding, because the loss of charge air would typically result in a loss of power, a supercharger is required to compensate for the power loss and increase compression prior to combustion.

Traditionally in Miller cycle engines, the supercharger will be of the positive displacement (Roots or Screw) type due to their ability to produce boost at relatively low engine speeds. Typically, other types of superchargers are not desirable because of the reduced power of lower RPM's. Notwithstanding, in some embodiments of the instant inventive concept, a crankcase air compression supercharger of the type discussed herein is utilized to provide the additional "boost" required in a combustion process similar to that of the Miller cycle engine without incurring significant (or, in some embodiments, any) power loss at lower RPM's. This is accomplished by utilizing a valve such as bypass valve 70 shown in FIG. 7 (or a poppet valve, or other suitable two-way valve, instead of a one-way reed valve) and variable valve timing and/or valve lift ("VVT") to control the bypass valve, intake valve 18, and/or exhaust valve 20. The bypass valve is controlled to allow air to flow from the induction conduit to the atmosphere during at least a portion of the down stroke of the piston. This results in increased efficiency because less energy is required to move the piston during the down stroke. In some embodiments, as air is being inducted into the combustion chamber (e.g. during each down stroke in a two-cycle engine, or during the intake stroke in a four-cycle engine) the intake valve 18 is closed "early" before the piston reaches bottom dead center of its down stroke. Then the bypass valve 70 is opened to allow air to flow from the induction conduit to the atmosphere during the remainder of the down stroke, reducing the amount of energy required to complete the down stroke. The bypass valve is then closed before the next intake down stroke begins to allow pressure to build within the crankcase air compression supercharger 29 of the inventive concept. It will be appreciated that in some embodiments, the intake valve 18 is closed "late" during the first portion of the piston upstroke, in the same or similar manner to that of a traditional Miller cycle engine.

In some embodiments of the inventive concept in which a combustion process similar to that of the Miller cycle is utilized a combustion compression ratio (i.e. the ratio between the volume of the cylinder and combustion chamber when the piston is at the bottom of its stroke, and the volume of the combustion chamber when the piston is at the top of its stroke) is higher than a crankcase compression ratio (i.e. the ratio between the volume of the cylinder and crankcase when the piston is at the top of its stroke, and the volume of the crankcase when the piston is at the bottom of its stroke) for the engine. In some preferred embodiments, the combustion compression ratio is 11:1 while the crankcase compression ratio is 9:1. In other words, the volume of the combustion chamber is smaller than the volume of the crankcase below the piston. This allows the pressure within the combustion chamber to be boosted when the piston is moving to bottom dead center to the desired pressure utilizing the crankcase air compression supercharger of the inventive concept while at the same time taking advantage of the increased efficiency of the Miller cycle type combustion process. VVT is utilized to control the bypass valve, intake valve and/or exhaust valve to provide the desired pressures and/or dynamic compression ratios. It will be appreciated that the valve sequencing and timing will vary depending upon engine design and desired results as well as the operating RPM. In some embodiments, the crankcase volume is minimized or optimized to increase or optimize pressure within the crankcase air compression supercharger of the inventive concept.

In some embodiments of the inventive concept in which a combustion process similar to that of the Miller cycle is utilized, the engine includes at least two cylinders in which at least one cylinder is capable of assisting another cylinder with boost at any given crank angle or offset crank angle in a manner similar to that discussed above. This is accomplished either for a four stroke, two-stroke, or combination two stroke and four stroke configurations, as well as other stroke configurations now known or hereinafter developed. In some such embodiments, the engine includes two (or more) cylinders that follow the same stroke, moving up and down simultaneously to one another. In some embodiments both cylinders include a curved portion 56 that feeds into a single induction conduit 29. In other embodiments, a single curved portion 56 is located outside of both cylinders, with a connecting tube extending from the crankcase intake of the induction conduit through a port in the crankcase cover and into the crankcase of each cylinder. In still other embodiments, both cylinders include a curved portion 56 that feeds into a separate induction conduit 29 for each cylinder, and which conduits are connected together via a cross-flow conduit. In all such embodiments, the second section 38 of the conduit(s) is split to be in fluidic communication with the intakes 14 for each of the two cylinders. In this manner, pressure created by the down stroke of both pistons is "shared" by the intakes for both pistons. As is discussed above, a valve such as bypass valve 70 shown in FIG. 7 (or a poppet valve, or other suitable two-way valve, instead of a one-way reed valve) and variable valve timing and/or valve lift ("VVT") is used to control the bypass valve, intake valves 18, and/or exhaust valves 20 for the two cylinders. The bypass valve is controlled to allow air to flow from the induction conduit(s) to the atmosphere during at least a portion of the down strokes of the pistons. This results in increased efficiency because less energy is required to move the pistons during at least some portion(s) of the down strokes. In some embodiments, both cylinders operate as four cycle cylinders. In such embodiments, the intake valve of one cylinder is open while the other is closed as air is being inducted into the combustion chamber of the cylinder with the open intake (e.g. during the intake stroke). In this manner the cylinder with the open intake (for purposes of further discussion, "cylinder 1") is operating in the intake cycle while the cylinder with the closed intake (for purposes of further discussion, "cylinder 2") is operating in the combustion cycle. In embodiments in which Miller cycle type process is utilized, the intake valve 18 for cylinder 1, the cylinder in the intake cycle, is closed "early" before the pistons reach bottom dead center of their down strokes. Then the bypass valve 70 is opened to allow air to flow from the induction conduit(s) to the atmosphere during the remainder of the down strokes, reducing the amount of energy required to complete the down strokes. The bypass valve is then closed before the next intake down stroke begins to allow pressure to build within the crankcase air compression supercharger 29 of the inventive concept. In this next intake stroke, the piston's cycles are reversed, such that cylinder 2 is operating in the intake cycle with open intake while cylinder 1 is operating in the combustion cycle with closed intake. The intake valve 18 for cylinder 2, the cylinder in the intake cycle, is closed "early" before the pistons reach bottom dead center of their down strokes. Then the bypass valve 70 is opened to allow air to flow from the induction conduit(s) to the atmosphere during the remainder of the down strokes, reducing the amount of energy required to complete the down strokes. The bypass valve is then closed before the next intake down stroke begins (in which the cylinder cycle stages are again reversed in the manner discussed above) to allow pressure to build within the crankcase air compression supercharger 29 of the inventive concept. In this manner the pressure created in the crank case below both pistons is utilized to increase (essentially up to double depending upon the desired design parameters) the amount of boost created for each intake stroke of each piston as compared to that of a single cylinder design discussed above.

In some embodiments in which the engine includes at least two cylinders in which at least one cylinder is capable of assisting another cylinder with boost at any given crank angle or offset crank angle in a manner similar to that discussed above, a Miller cycle type combustion process is not utilized. In some embodiments, such as that shown in FIGS. 14*a* through 14*e*, both cylinders operate as four cycle cylinders. In such embodiments, the intake valve of one cylinder is open while the other is closed as air is being inducted into the combustion chamber of the cylinder with the open intake (e.g. during the intake stroke). In this manner the cylinder with the open intake (for purposes of further discussion, "cylinder 1") is operating in the intake cycle while the cylinder with the closed intake (for purposes of further discussion, "cylinder 2") is operating in the combustion cycle. Once the pistons reach bottom dead center of their down strokes, the intake valve for cylinder 1 is closed, the exhaust valve for cylinder 2 is open, and the bypass valve 70 (or pre-intake valve, as shown in FIGS. 14*a* through 14*d*) is opened to allow air to flow into the induction conduit(s) from the atmosphere during the piston up strokes. The bypass valve is then closed before the next intake down stroke begins to allow pressure to build within the crankcase air compression supercharger 29 of the inventive concept. In this next intake stroke, the piston's cycles are reversed, such that cylinder 2 is operating in the intake cycle with open intake while cylinder 1 is operating in the combustion cycle with closed intake. The intake valve 18 for cylinder 2, the cylinder in the intake cycle, is closed once the pistons reach bottom dead center of their down strokes, while the exhaust valve for cylinder 1 is open. Then the bypass valve 70 is opened to allow air to flow into the induction conduit(s) from the atmosphere during the piston up strokes. The bypass valve is then closed before the next intake down stroke begins (in which the cylinder cycle stages are again reversed in the manner discussed above) to allow pressure to build within the crankcase air compression supercharger 29 of the inventive concept. In this manner the pressure created in the crank case below both pistons is utilized to increase (essentially up to double depending upon the desired design parameters) the amount of boost created for each intake stroke of each piston as compared to that of a single cylinder design discussed above.

FIGS. 15*a* through *r* shows various views of another embodiment of an engine of the inventive concept, similar to that discussed above with respect to FIGS. 14*a* through 14*e*, that includes two cylinders in which one cylinder assists the other cylinder with boost. The engine of FIGS. 15*a* through 15*r* operates generally in the same manner as is discussed above with respect to FIGS. 14*a* through 14*e*, with the primary difference being the orientation of the centrifuge, which in FIGS. 15*a* through 15*r* is horizontal rather than vertical. In the embodiment shown in FIGS. 15*a* through *r* the curved portion/centrifuge of the induction conduit is oriented in a generally horizontal arrangement between a pair of cylinders. FIGS. 15*a* through *r* show views of a first cylinder in various stages of 4 cycle operation in connection with the various alternative 4 cycle stages of the second cylinder, with all valves controlled by a single cam or other suitable control mechanism.

Figure 16A:
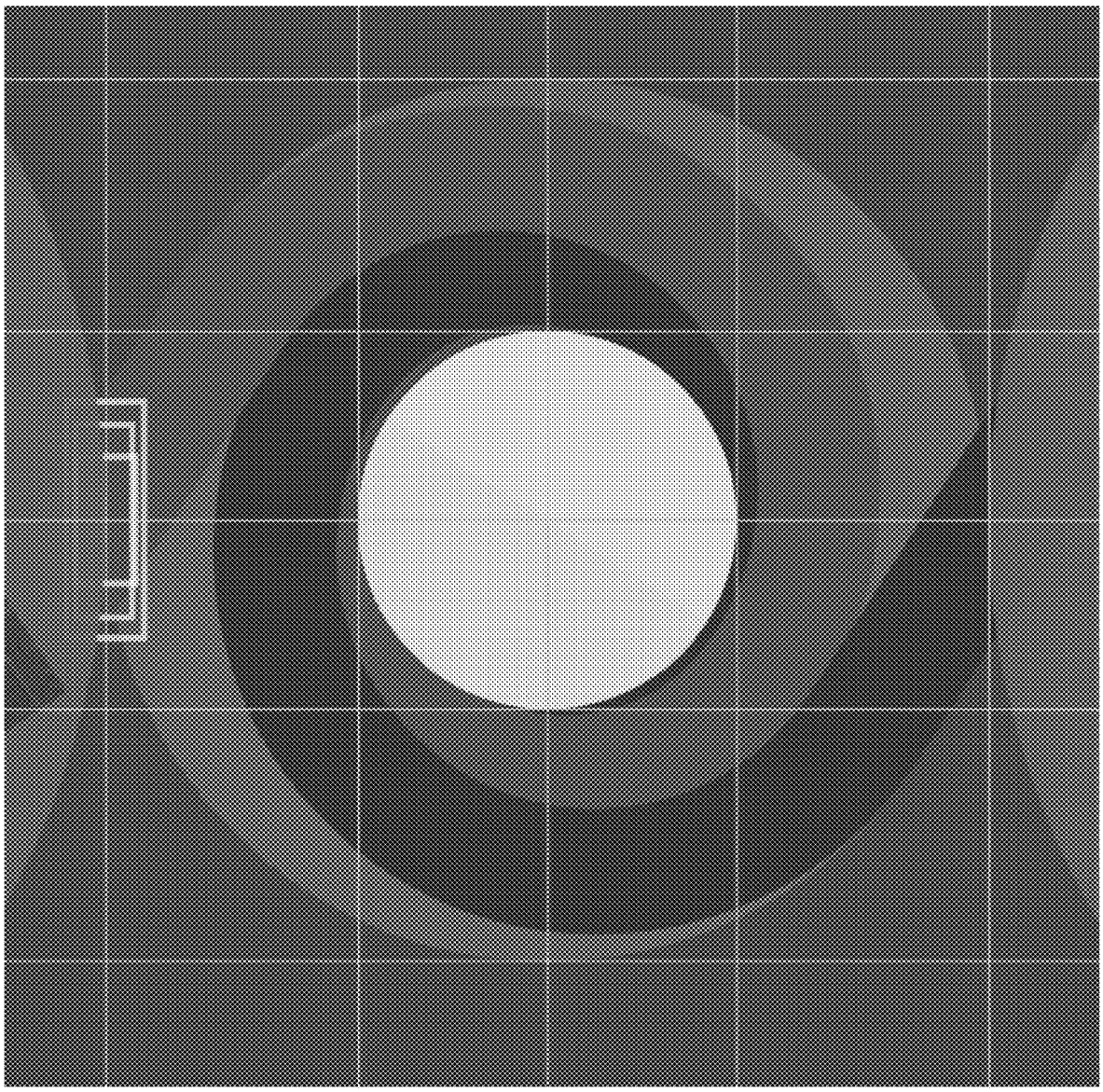
FIGS. 16*a* and 16*b* show two detailed bottom views of the engine of FIGS. 15*a*-15*r*, illustrating the horizontal centrifuge in further detail.
Figure 16B:
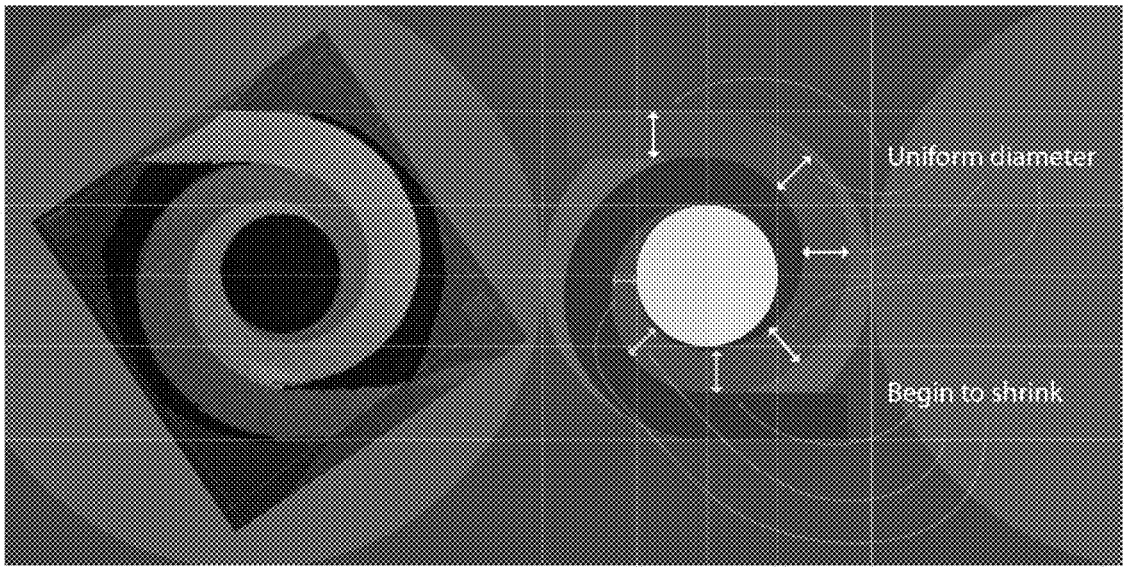

FIGS. 16*a* and 16*b* show two detailed bottom views of the engine of FIGS. 15*a*-15 *r*, illustrating the horizontal centrifuge in further detail. As is seen in FIGS. 16*a* and 16*b*, the centrifuge includes two separate chambers that respectively each receive compressed air/fluid from opposing cylinders. The chambers are initially (e.g. from the inlet at each cylinder) separated from each other, e.g. by a wall, and spiral around each other until they merge together in the middle at a vertical tube leading to the combustion chamber and fresh air intakes.

In other alternative embodiments in which the engine includes at least two cylinders in which at least one cylinder is capable of assisting another cylinder with boost at any given crank angle or offset crank angle in a manner similar to that discussed above, one cylinder operates as a two stroke cylinder while the other operates as a four stroke cylinder. In some such embodiments each down stroke of the four stroke cylinder is utilized to create additional boost (in the manner discussed above) for the two stroke cylinder. In other embodiments in which one cylinder operates as a two stroke cylinder while the other operates as a four stroke cylinder, the additional boost of the four stroke cylinder is utilized by the four stroke cylinder during the intake cycle for that cylinder. In some such embodiments the boost is utilized solely by the four stroke cylinder. In other such embodiments the boost is shared by both cylinders for intake.

Figure 17:
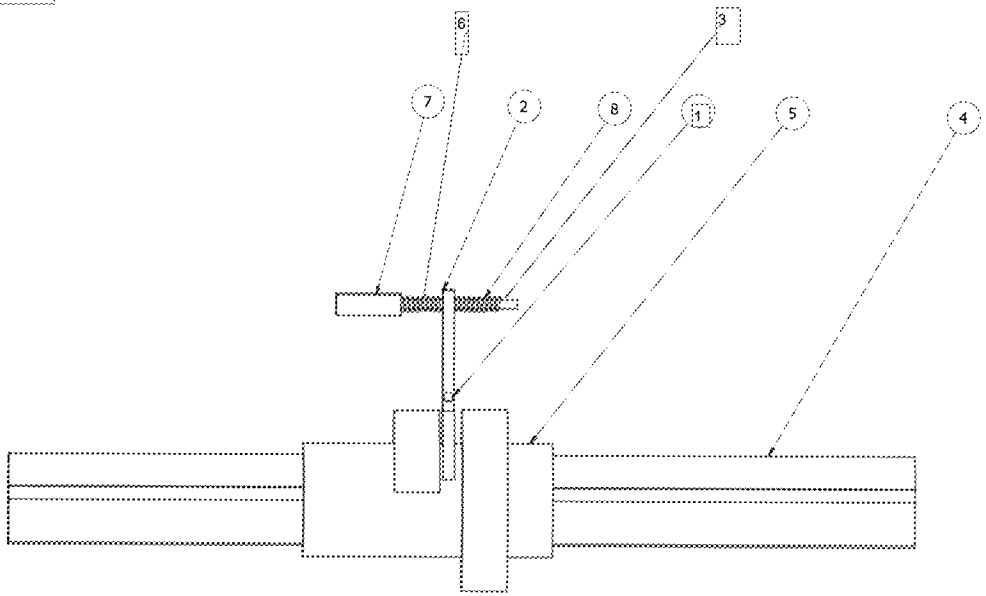
FIG. 17 shows a front view of a cam actuator assembly of an embodiment of the inventive concept.

FIG. 17 shows a front view of a cam actuator assembly of an embodiment of the inventive concept. The cam actuator shown operates to vary the valve timing between two different options (an inventive form of VVT). Notwithstanding, it will be appreciated that in other embodiments, similar structures are utilized to provide more than two valve timing options. The cam actuator shown is for a single valve assembly (not shown). Nevertheless, it will be appreciated that in other embodiments, multiple similar assemblies are includes on a single cam shaft to provide variable valve timing to multiple valves within an engine. In the embodiment shown, a 2-stage cam 5 of the inventive concept is positioned about a splined cam shaft 4, the cam 5 including structural features that mate with the splined shaft 4 such that the cam 5 can slide along shaft 4 and rotate in unison with shaft 4. Cam 5 shown in FIG. 17 includes two different lobes to provide the two timing options. A first lobe is located to the right of a fork end of pusher rod 2, and a second lobe is located to the left of the fork. The fork allows the cam 5 to rotate within the fork fingers, in the same/similar manner as an automobile manual transmission clutch. The cam 5 thus functions in the same/similar manner as the throw out bearing of a clutch assembly. The pusher rod 2 is allowed to pivot about fulcrum pin 2, causing cam 5 to slide left and right about shaft 4. The pusher rod is pivoted about fulcrum pin 1 through actuation of a solenoid 7 which causes the pusher rod to slide left and right about a shaft extending from the solenoid. Springs 6 and 8 are positioned on opposing sides of the pusher rod along the solenoid shaft to maintain constant tension between the fork and whichever of the two cam lobes to which the fork is engaged. The springs are held in place by a set pin located at reference point 3. In the embodiment shown, the valve assembly (not shown) is located below the cam assembly, opposite the solenoid. In operation, the assembly slides the left lobe of the cam in communication with the valve for normal valve operation, and slides the right lobe in communication with the valve to leave the valve open during the entire rotation of the shaft. This is accomplished by the differing lobe shapes. As is shown in FIG. 17, the left lope is generally half of the circumference of the shaft, while the right lobe is along the entire circumference, cause the valve to stay open throughout the entire rotation. Generally, when it is necessary/desired to adjust the valve timing, the solenoid will be actuated at a time in which the left lobe is on its high side with respect to the valve being controlled, to allow the valve to float over generally a flat surface between the two lobes. In some embodiments tapering or other structural features are provided along the adjacent edges of the two lobes to aid in allowing for a smoother transition between lobes. It will be appreciated that alternative lobe shapes will be utilized in other embodiments to provide other varying timing options. In addition, it is appreciated that various bearings, set pins, shims and other structures generally utilized in connection with cam assemblies are not illustrated herein for purposes of clarity. Nevertheless, various embodiments of the inventive concept include such addition structure.

Figure 18A:
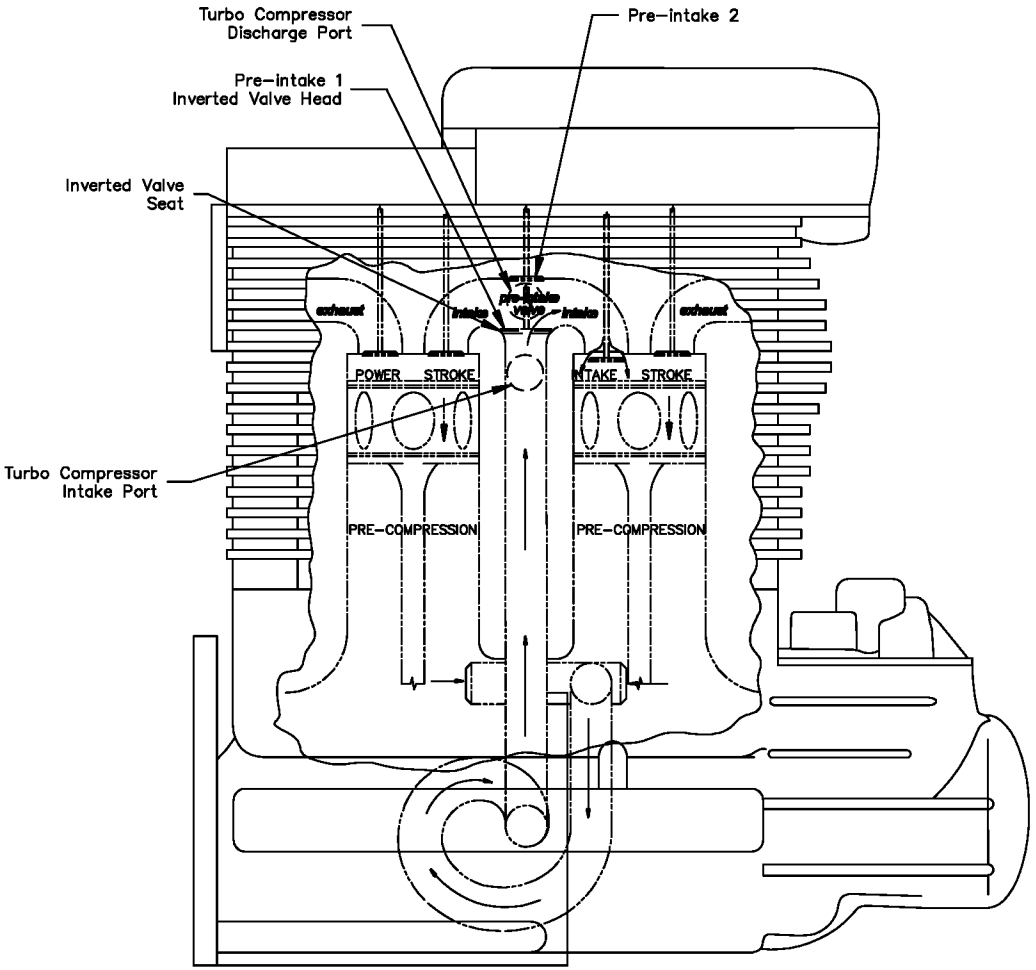
FIG. 18*a* is a partial section side view of an embodiment of an engine of the inventive concept that includes two cylinders in which one cylinder assists the other cylinder with boost, and further includes a turbo charger that is capable of assisting with boost (when desired). In the embodiment shown in FIG. 18*a* the curved portion/centrifuge of the induction conduit is oriented in a generally vertical arrangement generally or partially between a pair of cylinders. In other embodiments, the centrifuge is oriented in a generally horizontal arrangement.
Figures 1, 18A:
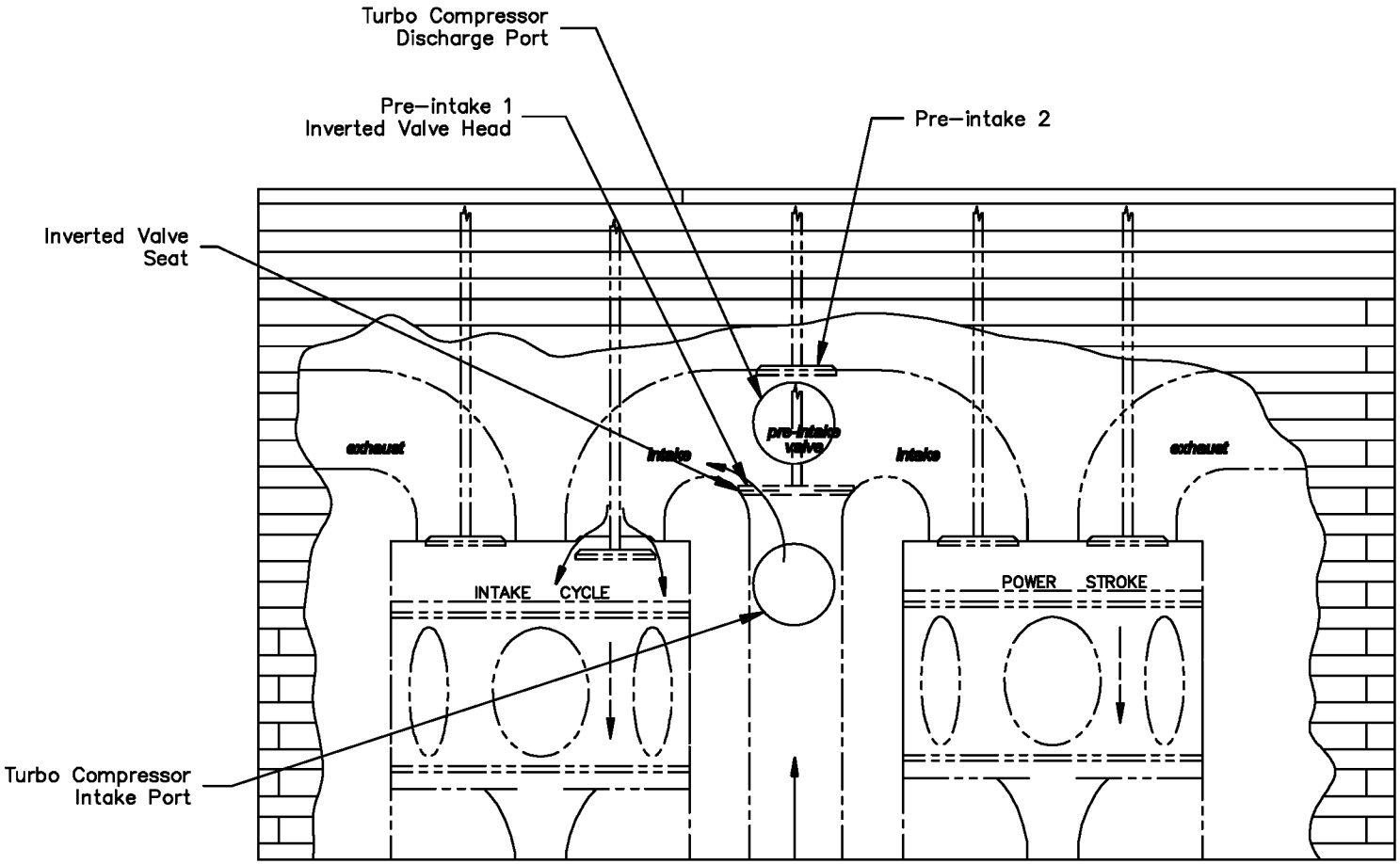
Figure 18B:
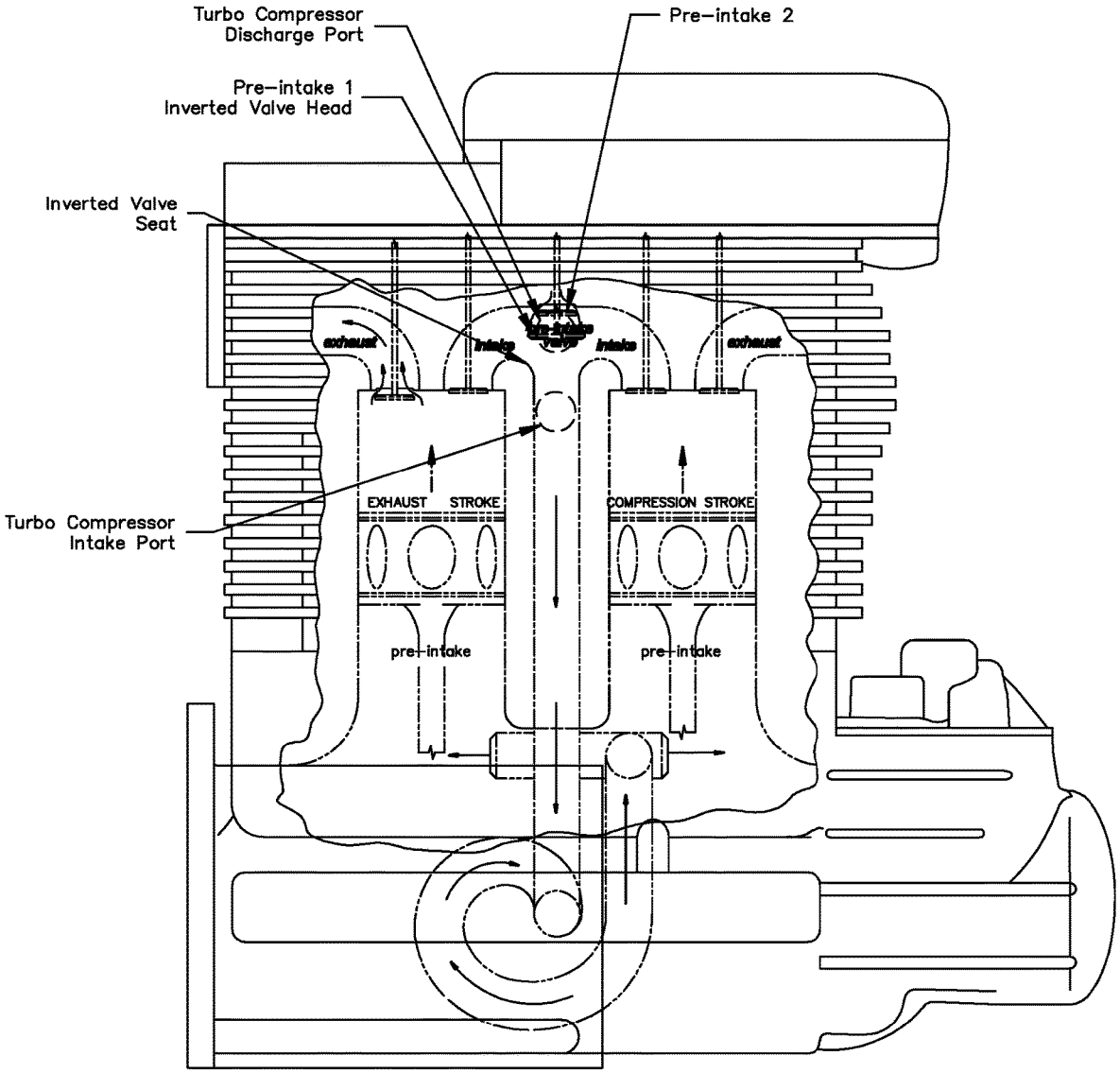
FIG. 18*b* is another partial section side view of the engine of FIG. 18*a* showing the first cylinder in an exhaust cycle and the second cylinder in a compression cycle. Note that the turbo itself, an exhaust path through the turbo turbine, and any associated manifolding, are not shown; only turbo compressor ports are shown through the induction conduit (compressor intake port) and back into the intake area (compressor discharge port).
Figure 18C:
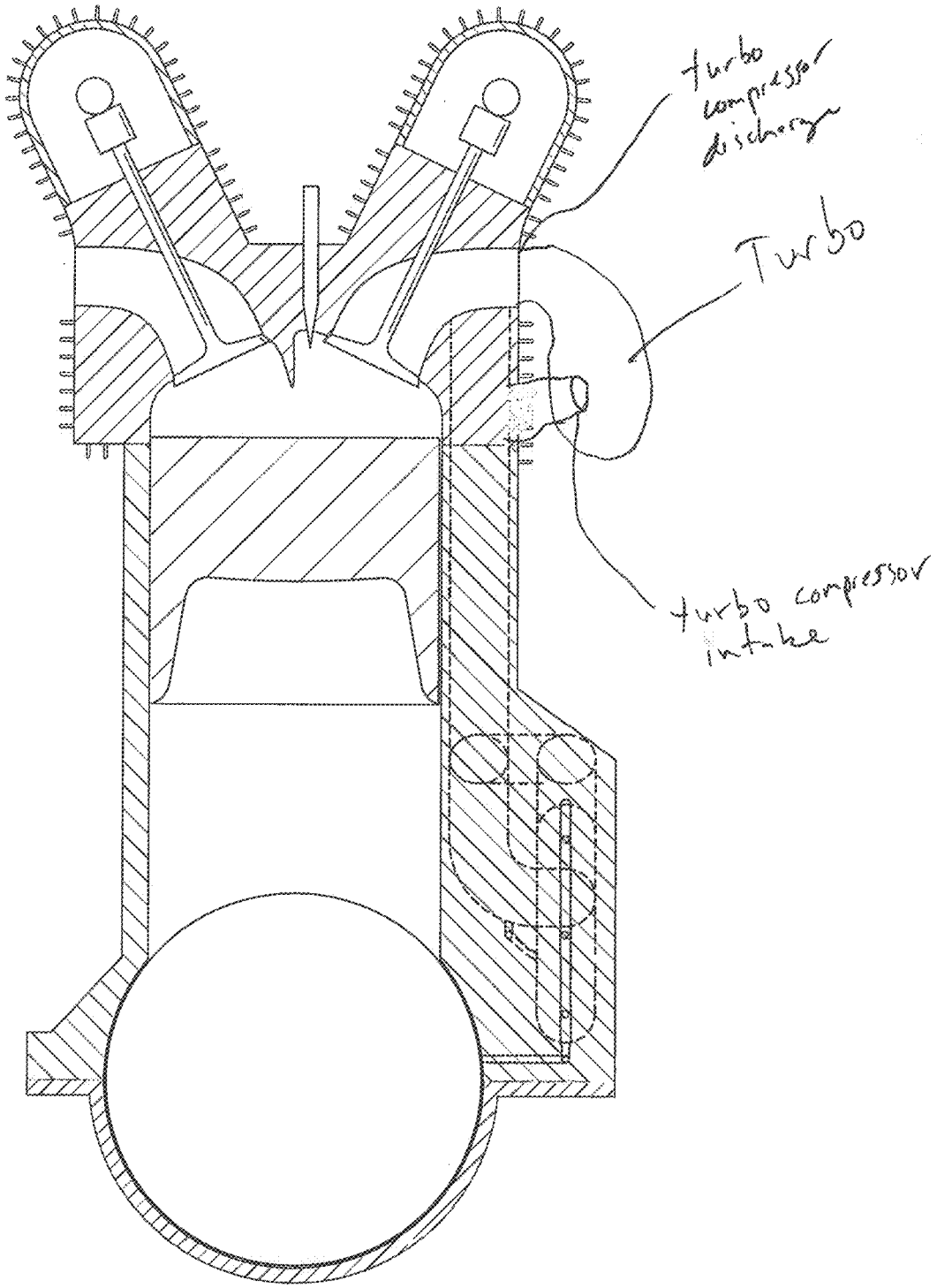
FIG. 18*c* is a front side section view of the engine of FIG. 18*a* showing an embodiment of the supercharger located outside of the engine crankcase with connecting tubes branching from the crankcase intake of the induction conduit through ports in the crankcase and into the crankcase below each of the pistons, and further showing a turbo compressor intake extending from the induction conduit into a turbo charger compressor and turbo charger compressor discharging back into the intake area for the engine. Note that an exhaust path through the turbo turbine (and associated manifolding) is not shown in FIG. 18*c*.

In some embodiments of the inventive concept the crankcase air compression supercharger 29 of the inventive concept is utilized in combination with a turbo charger. One such embodiment is shown in FIGS. 18*a* through 18*c*, in an engine that includes at least two cylinders in which at least one cylinder is capable of assisting another cylinder with boost at any given crank angle or offset crank angle in a manner similar to that discussed above. The embodiment shown in FIGS. 18*a* through 18*c* is structured and operates in a manner similar to that discussed above with respect to FIGS. 14*a* through 14*e*, with the primary difference being the inclusion of the turbo assembly and associated pre-intake valve assembly (as shall be discussed below in further detail). In the embodiment shown in FIGS. 18*a* through 18*c*, both cylinders operate as four cycle cylinders. In such embodiments, the intake valve of one cylinder is open while the other is closed as air is being inducted into the combustion chamber of the cylinder with the open intake (e.g. during the intake stroke). In this manner the cylinder with the open intake (for purposes of further discussion, "cylinder 1") is operating in the intake cycle while the cylinder with the closed intake (for purposes of further discussion, "cylinder 2") is operating in the combustion cycle. Once the pistons reach bottom dead center of their down strokes, the intake valve for cylinder 1 is closed, the exhaust valve for cylinder 2 is open, and the bypass valve 70 (or pre-intake valve #1, as shown in FIGS. 18*a* and 18*b*) is opened to allow air to flow into the induction conduit(s) from the atmosphere during the piston up strokes. In addition, Turbo Bypass valve (pre-intake valve #2, as shown in FIGS. 18*a* and 18*b*) is opened to allow air to flow freely into the induction conduit (s) without being forced through the Turbo compressor assembly. The bypass valves (pre-intake valve #1 and pre-intake valve #2) are then closed before the next intake down stroke begins to allow pressure to build within the crankcase air compression supercharger 29 of the inventive concept. As pressure builds within the crankcase air compression supercharger 29, the pressure causes air to flow through the turbo compressor intake and be further compressed by the compressor of the turbo charger. In some embodiments, the turbo charger is powered by exhaust gas from one or more of the engine cylinders, in the same or similar manner of conventional turbo chargers. In such embodiments, the exhaust gas from the cylinder(s) spools the turbo charger turbine which in turn powers/spools the compressor. The exhaust gas exits the turbo turbine outlet and exhausts through exhaust manifolding of the engine. The compressed air pressure (that originated from the crankcase) is then diverted from the turbo compressor back into the engine intake (e.g. pre-intake area as shown in FIGS. 18*a* and 18*b*. In this manner the crankcase air compression supercharger 29 creates engine boost through the supercharger in the same manner as discussed in previous embodiments, but also is further compressed by the turbo charger without utilizing any energy off of the crank shaft. In the next intake stroke, the piston's cycles are reversed, such that cylinder 2 is operating in the intake cycle with open intake while cylinder 1 is operating in the combustion cycle with closed intake. The intake valve 18 for cylinder 2, the cylinder in the intake cycle, is closed once the pistons reach bottom dead center of their down strokes, while the exhaust valve for cylinder 1 is open. Then the bypass valve 70 (pre-intake 1) is opened to allow air to flow into the induction conduit(s) from the atmosphere during the piston up strokes, and the turbo bypass valve (pre-intake 2) is also opened. The bypass valves are then closed before the next intake down stroke begins (in which the cylinder cycle stages are again reversed in the manner discussed above) to allow pressure to build within the crankcase air compression supercharger 29 of the inventive concept. In this manner the pressure created in the crank case below both pistons is utilized to increase (essentially up to double depending upon the desired design parameters) the amount of boost created for each intake stroke of each piston as compared to that of a single cylinder design discussed above, and also is further compressed by the turbo charger. It will be appreciated that the turbo of the inventive embodiment is capable of being by-passed by opening the turbo by-pass valve (pre-intake valve 2).

Although the embodiments of FIGS. 18*a* through 18*c* are discussed herein in connection with a multiple cylinder and four stroke engine, it will be appreciated that the turbo charger assembly discussed herein is also utilized in other embodiments of the inventive concept including 1 or any number of cylinders, and also including two stroke engines as well as any other engine cycles discussed herein, now known or hereinafter developed. It will further be appreciated that in various embodiments all volumes are optimized to control pre-compression pressures as desired.

Although the embodiment of FIGS. 18*a* through 18*c* is discussed above in connection with a turbo charger that is powered by exhaust gas from the engine, it will be appreciated that in other embodiments the turbo charger compressor is powered electrically, hydraulically, or by any other methods now known or hereinafter developed. In some embodiments the turbo charger will also function as a regenerative source that generates electricity for charging a battery or for other purposes.

In the embodiment shown in FIGS. 18*a* through 18*c*, the turbo bypass valve includes an inverted valve head that mates with an inverted valve seat. In the embodiment shown, the valve is controlled by the same cam as the other valves. Nevertheless, it will be appreciated that other embodiments include other valve structures and control mechanisms. In some embodiments, the turbo bypass valve is structured and arranged such that when it is in the open position it blocks off the turbo compressor discharge port such that all pre-compression air flow coming from below the piston(s) is directed through the open valve and not through the turbo charger compressor.

Figures 19A, 19B, 19C, 19D, 19E:
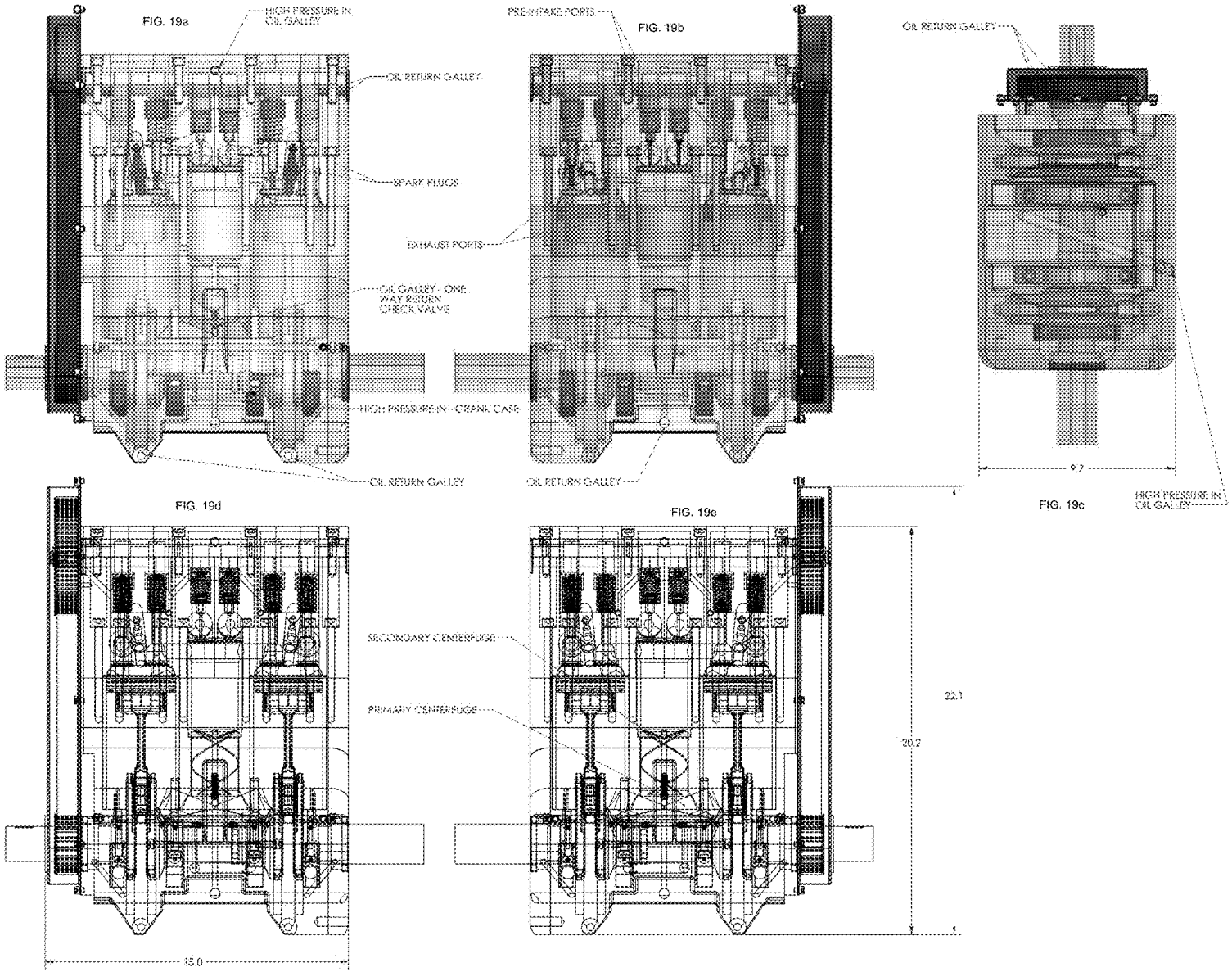
FIGS. 19*a* through 19*p* include various views of another embodiment of an engine of the inventive concept that includes two cylinders in which one cylinder is capable of assisting the other cylinder with boost. The embodiment shown in FIGS. 19*a* through 19*p* is similar to the embodiment shown in FIGS. 15*a* through *r*, in that the curved portion/centrifuge of the induction conduit is oriented in a generally horizontal arrangement between a pair of cylinders. The embodiment of the engine in FIGS. 19*a* through 19*p* includes two intake and two exhaust valves for each cylinder, as well as a separate pre-intake valve associated with each cylinder, with (in some embodiments) all valves controlled by a single cam.
Figure 19F:
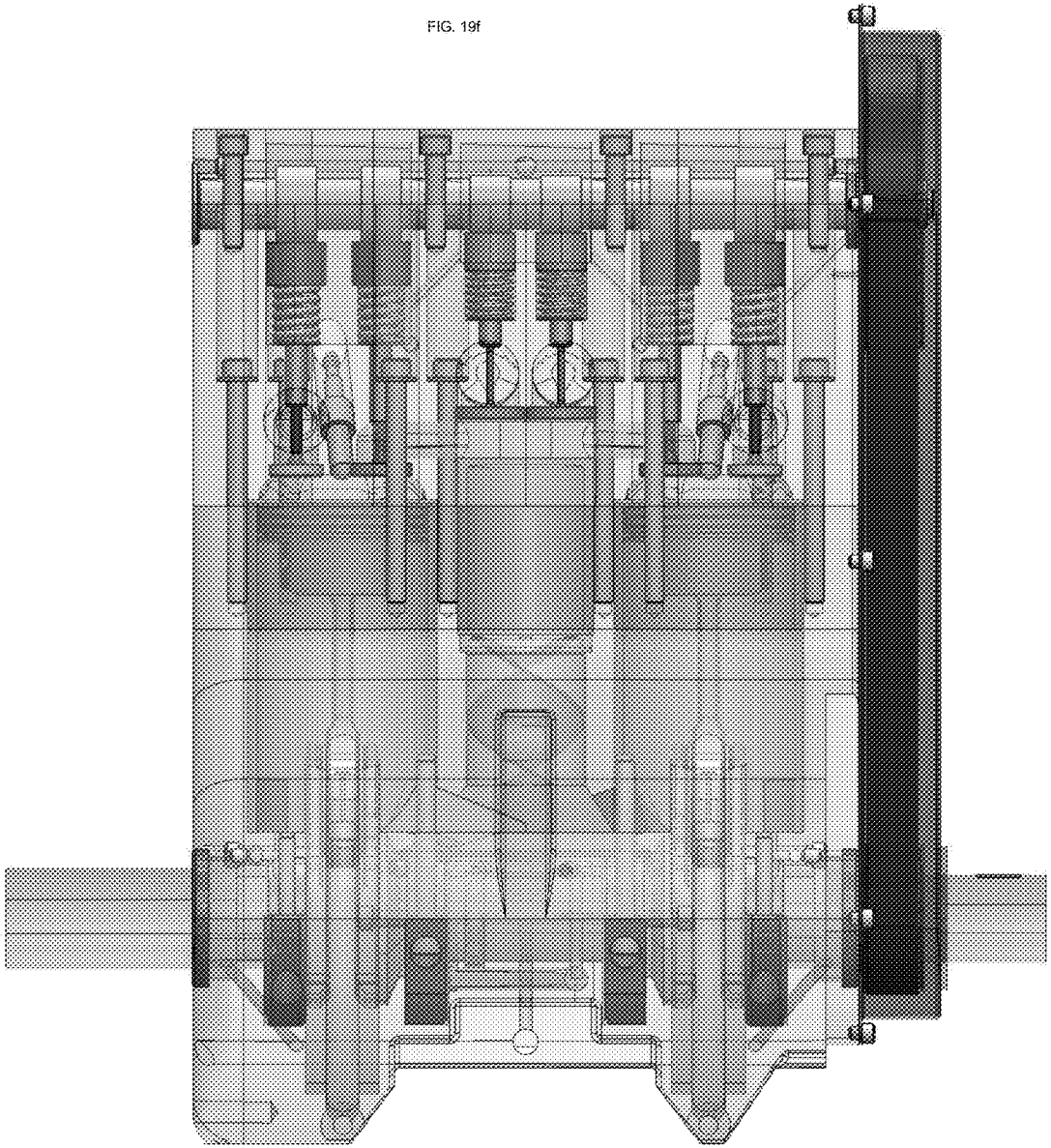
Figure 19I:
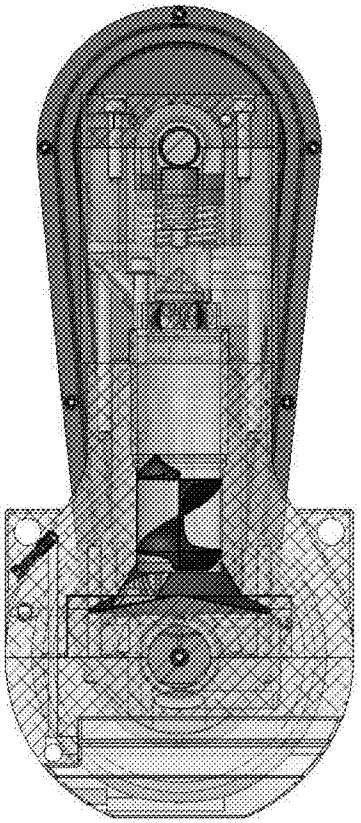
Figure 19G:
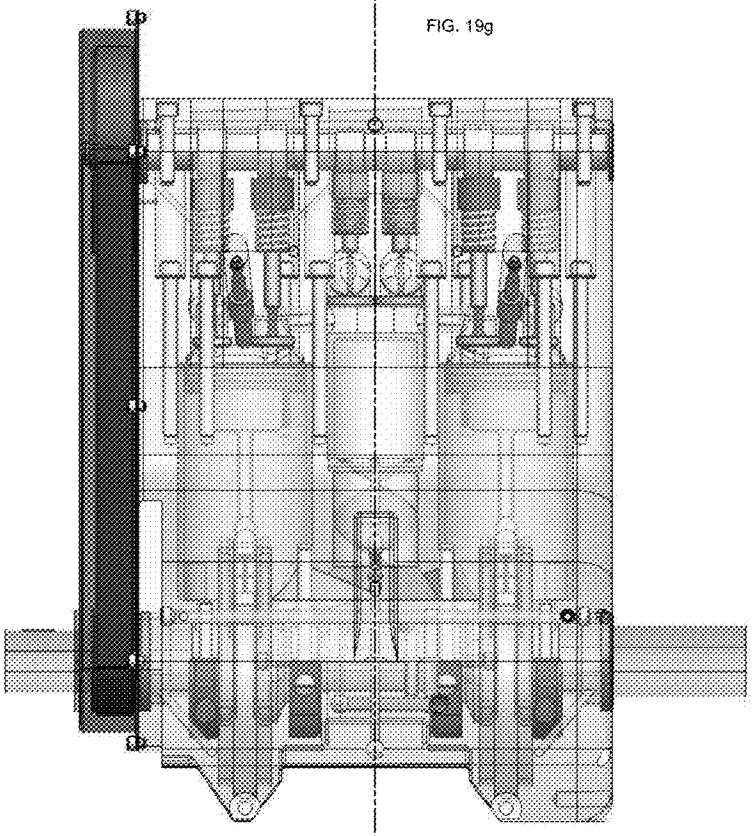
Figure 19H:
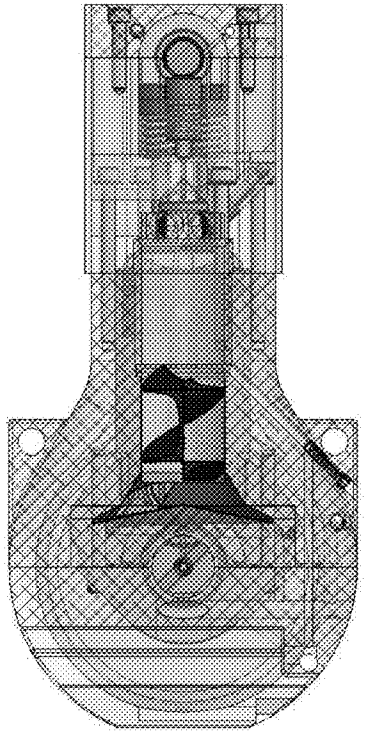
Figure 19J:
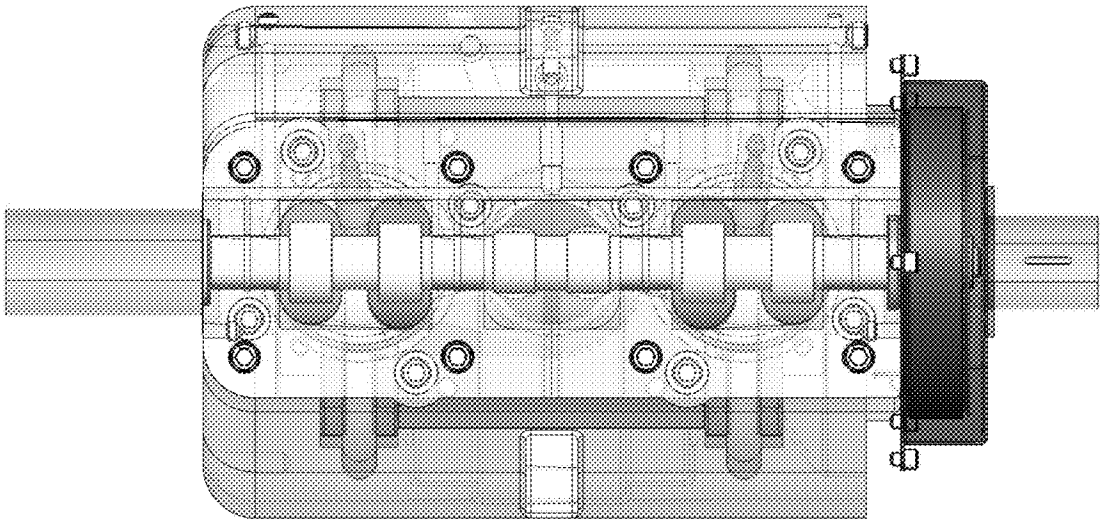
Figure 19K:
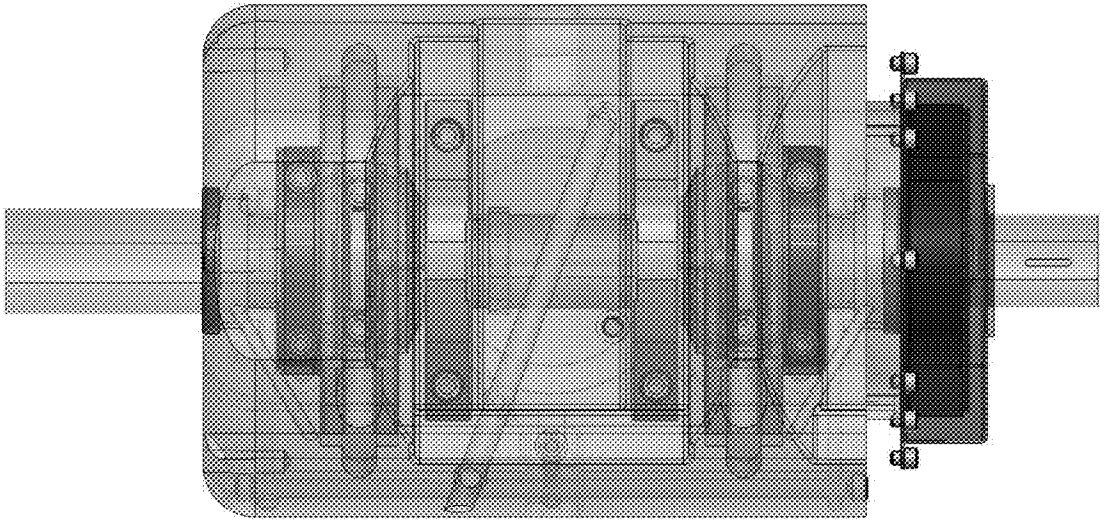
Figure 19I:
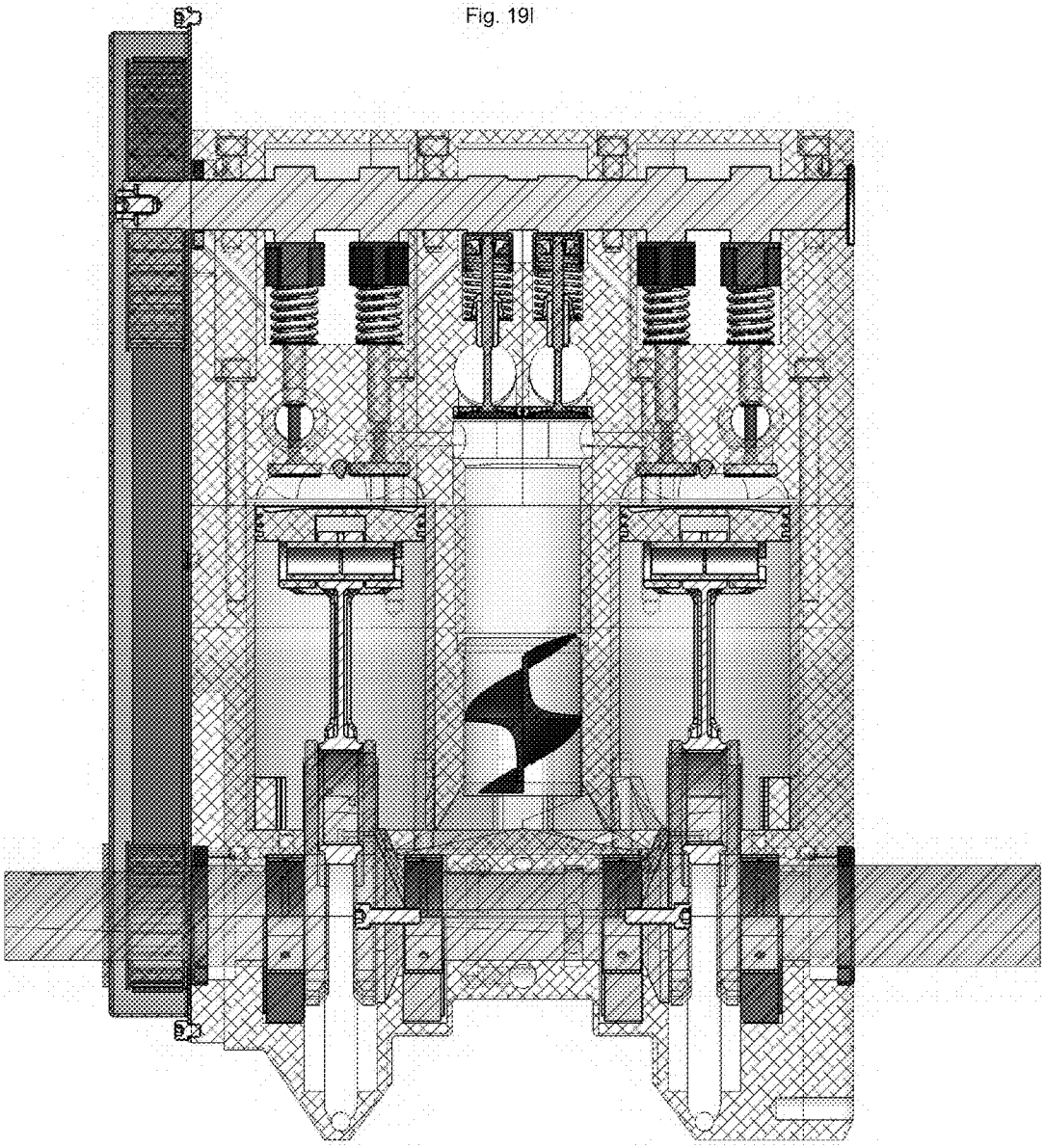
Figure 19M:
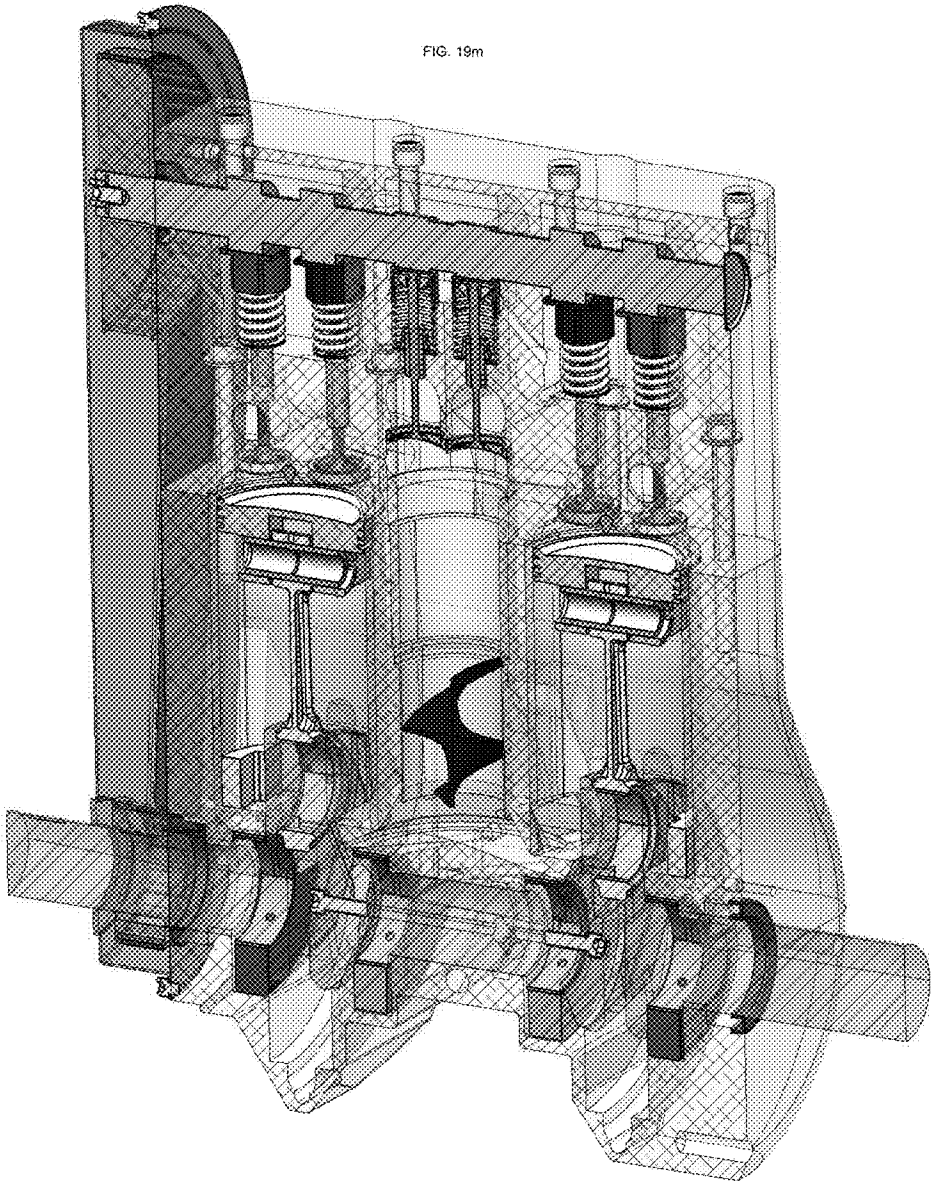
Figure 19N:
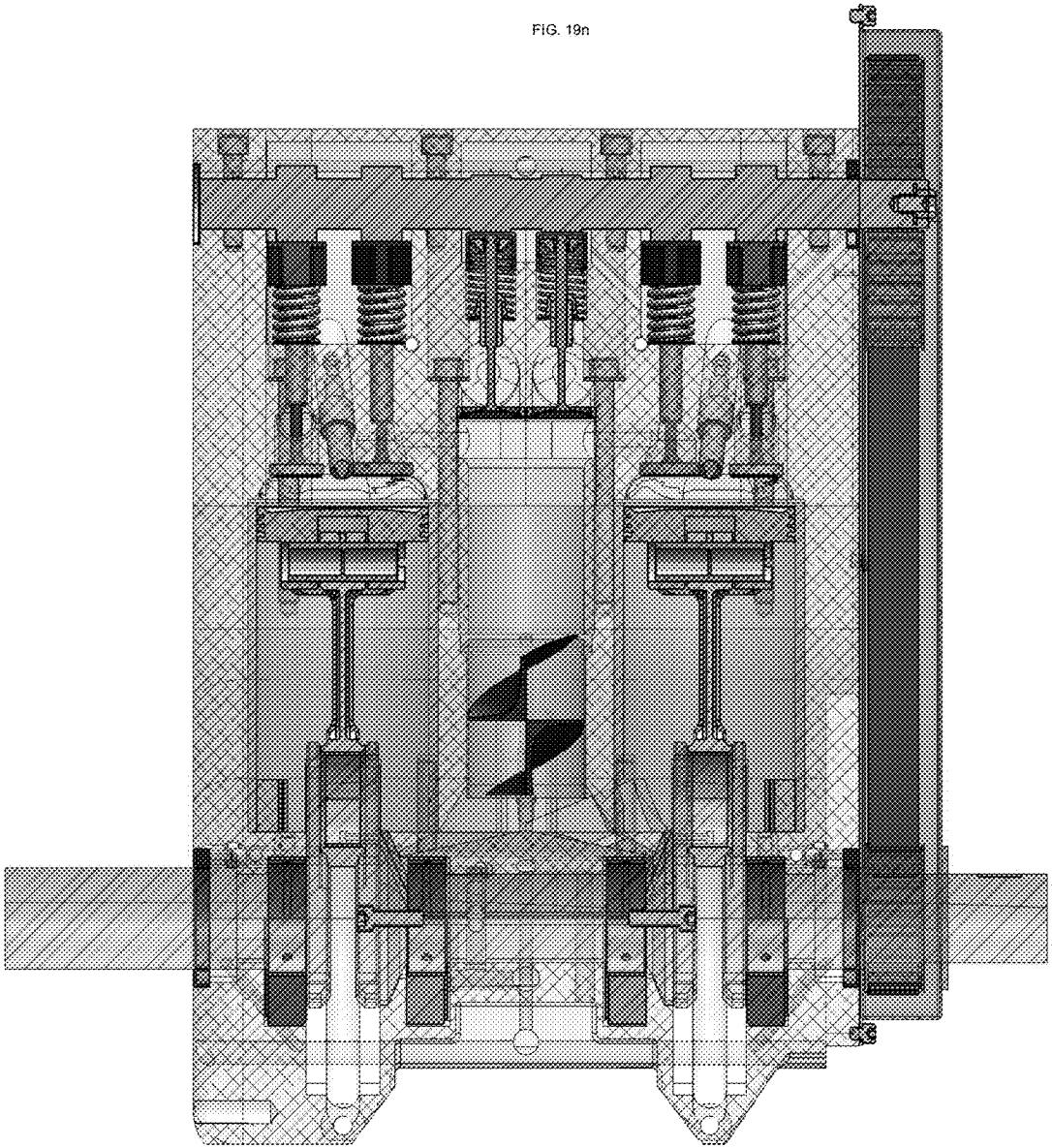
Figure 19B:
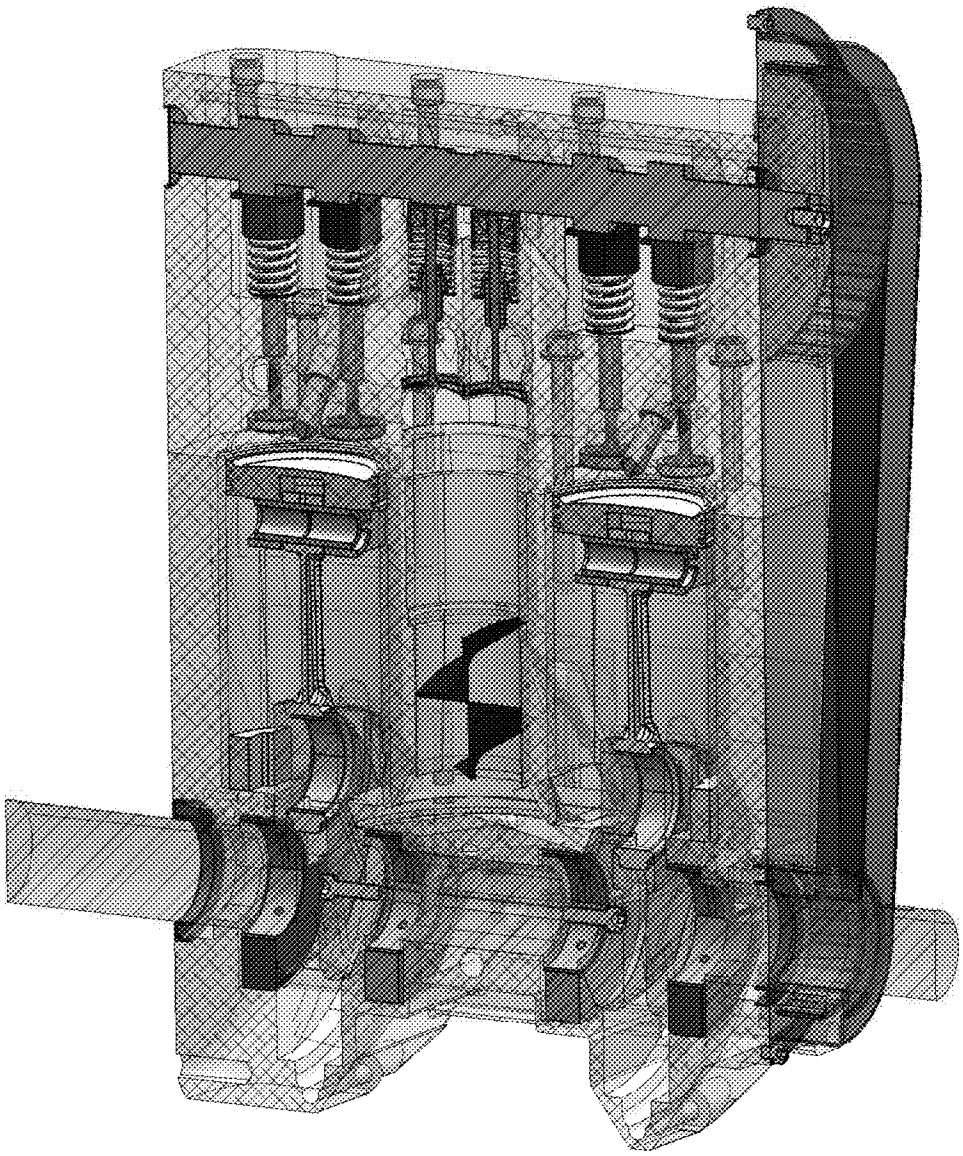
Figure 19P:
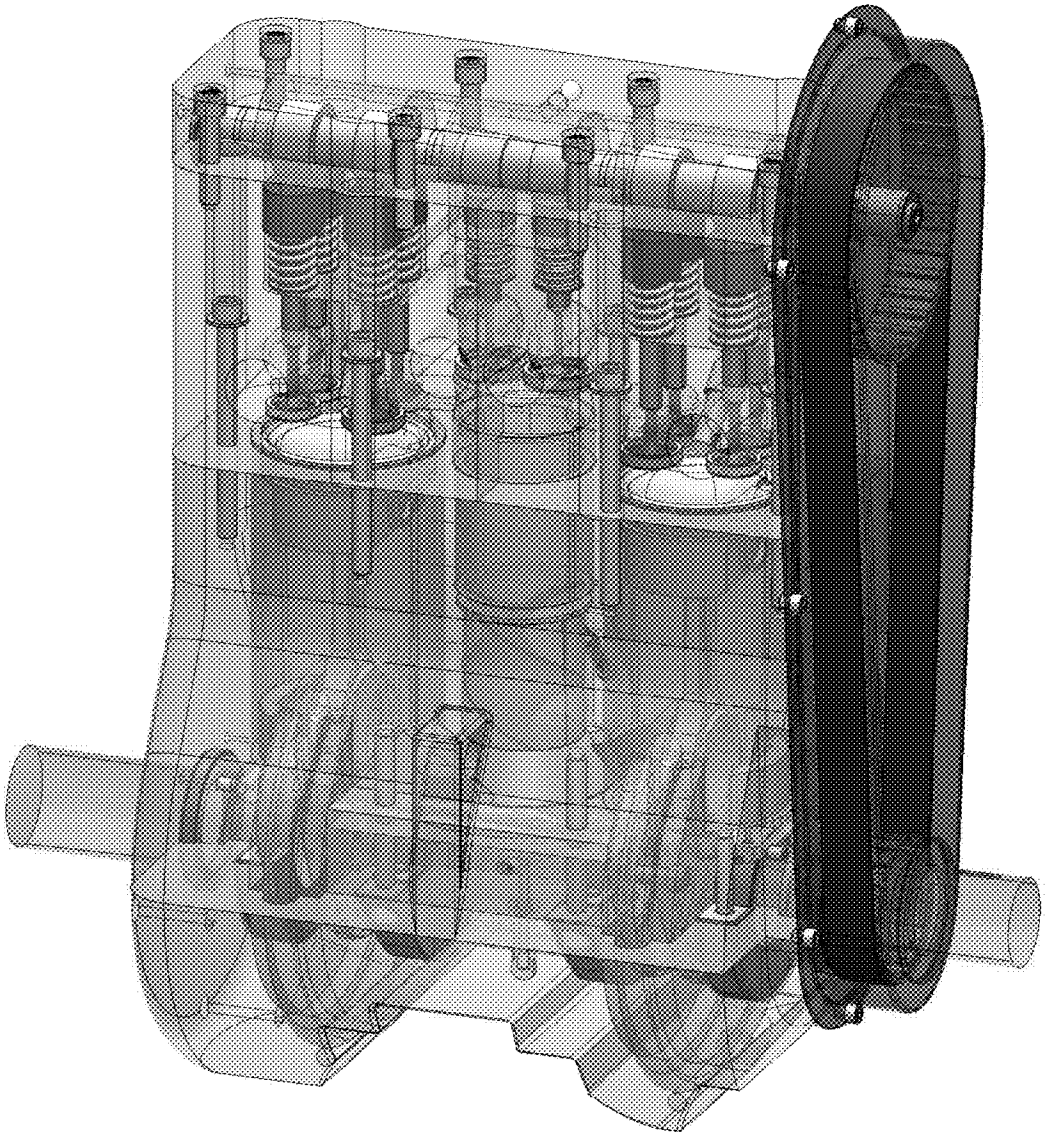

FIGS. 19*a* through 19*p* show various views of another embodiment of an engine of the inventive concept, similar to that discussed above with respect to FIGS. 14*a* through 14*e*, and FIGS. 15*a* through *r*, that includes two cylinders in which one cylinder is capable of assisting the other cylinder with boost. The engine of FIGS. 19*a* through 19*p* operates generally in the same manner as is discussed above with respect to FIGS. 15*a* through *r*, with the orientation of a primary portion of the centrifuge being horizontal. In the embodiment shown in FIGS. 19*a* through 19*p* the primary centrifuge portion of the curved portion/centrifuge of the induction conduit is oriented in a generally horizontal arrangement between a pair of cylinders. A secondary centrifuge portion of the induction conduit extends upward from the primary portion and includes a helical interior auger that connects the primary centrifuge to the engine intake(s).

In the embodiment shown in FIGS. 19*a* through 19*p* the primary centrifuge includes a central chamber that includes an inlet from each of the two cylinders of the engine. The inlets are offset from one another on opposing sides of the engine. In this manner, when/if both cylinders are moving downward in unison with one another, as air is compressed by the downward stroke of the first cylinder and forced into the primary centrifuge through the inlet to the first cylinder, that air is forced toward the opposing wall of the primary centrifuge, which is adjacent to the inlet port of the second cylinder (as opposed to being forced directly to the inlet to the second cylinder). Likewise, as air is compressed by the downward stroke of the second cylinder and forced into the primary centrifuge through the inlet to the second cylinder, that air is forced toward the opposing wall of the primary centrifuge, which is adjacent to the inlet port of the first cylinder (as opposed to being forced directly to the inlet to the first cylinder). This simultaneous action created by both cylinders, combined with the generally curved shape of the outer wall of the primary centrifuge, cause the air within the primary centrifuge to rotate, forcing oil droplets within the air toward the outer wall of the primary centrifuge. The interior of the centrifuge includes a generally conical shape, with the tip of the cone extend upward from the bottom of the centrifuge, to further assist in the rotation of the air within the centrifuge. The conical shape also urges the air upwards toward the secondary centrifuge (when the pistons are moving downward, given that air movement through the centrifuge is bi-directional). The helical shape of the auger within the secondary centrifuge continues to rotate the air forcing oil droplets toward the outer wall of the secondary centrifuge as the air moves up (when the pistons are moving downward) the auger. Oil return galleys are located along the outer walls of the primary and secondary centrifuges to return oil separated from the air through the centrifuges back to the crankcase in a manner similar to the centrifuges discussed above.

It will be appreciated that in various embodiments of the inventive concept, alternative primary and/or secondary centrifuge structures will be utilized. In some embodiments two or more augers are utilized in connection with the secondary centrifuge. In some embodiments, a spiral type centrifuge similar to those discussed in embodiments above is utilized in place of the cone-style centrifuge.

The embodiment of the engine shown in FIGS. 19*a* through 19*p* includes two intake valves and two exhaust valves for each cylinder, as well as a separate pre-intake valve for each cylinder. The valves are all oriented straight up and down providing a non-interference engine design, and are all controlled by a single cam. The cylinder head of the embodiment shown in FIGS. 19*a* through 19*p* is a two-piece design that aids in manufacturing. In some embodiments, adjustable or hydraulic lifters are utilized.

In other alternative embodiments in which the engine includes at least two cylinders in which at least one cylinder is capable of assisting another cylinder with boost at any given crank angle or offset crank angle in a manner similar to that discussed above, one cylinder operates as a two stroke cylinder while the other operates as a four stroke cylinder. In some such embodiments each down stroke of the four stroke cylinder is utilized to create additional boost (in the manner discussed above) for the two stroke cylinder. In other embodiments in which one cylinder operates as a two stroke cylinder while the other operates as a four stroke cylinder, the additional boost of the four stroke cylinder is utilized by the four stroke cylinder during the intake cycle for that cylinder. In some such embodiments the boost is utilized solely by the four stroke cylinder. In other such embodiments the boost is shared by both cylinders for intake.

In some embodiments of the inventive concept, the supercharger and/or supercharger combined with turbo charger (discussed above with respect to FIGS. 18*a* to 18*c*) of the inventive concept is used in combination with a Gasoline Direct-Injections Compression Ignition (GDCI) engine, similar to that currently under development by Hyundai and Delphi. Such engines utilize direct injection, variable valve timing (which in some embodiments includes the cam actuator variable valve timing of or similar to that discussed above in FIG. 17), a turbo and supercharger, and deep bowl style pistons (deep bowls cast into the piston crowns). In some such embodiments, no spark plugs, allowing injectors to be exactly centered above each bowl. In some embodiments, GDCI obtain auto-ignition. In some embodiments, glow plugs are including to aid in ignition.

In will be appreciated that various embodiments of the inventive concept described herein utilize and take advantage of the use of counterbalancing. In various embodiments counterbalances are provided at any of virtually unlimited positions and arrangements now known or hereafter developed. In the embodiments discussed above, because a full circular crank shaft is utilized, in some embodiments counterbalancing is accomplished dynamically by removing (e.g. drilling out) material from the shaft and replacing the removed material with lighter material to fill the voids and maintain constant air volume within the crank.

In some embodiments of the inventive concept, an energy storage system is utilized to capture and temporarily store air pressure created by the engine crankcase supercharger of the inventive concept. In some embodiments, the energy storage system comprises an air cylinder or other suitable storage tank (or tanks) that is connected to the conduit. As air is compressed by the down stroke of the piston (or pistons) at least some of the air pressure is routed into the storage tank. In some embodiments, all air pressure created during the down stroke of a piston, or multiple pistons in multiple cylinder engines, is routed into the storage tank when no boost is being provided. A valve is included at the opening of the storage tank to allow air to flow into and out of the storage tank. When additional boost is desired, the valve is opened during the intake stroke of one or more cylinders to provide additional boost in addition to any boost already being provided by the crankcase supercharger of the inventive concept during the same intake stroke. In some such embodiments the storage tank is utilized as a regenerative braking system for capturing the exhaust pressure off the backside of the cylinders, backwards through the intake, or otherwise via a port into the combustion chamber connected with a suitable storage tank(s), when there is no fuel being injected into the cylinder from air braking. In some such embodiments, a separate storage tank(s) is used for pressure captured from the combustion chamber vs. pressure captured/stored that is generated from the crankcase below the piston(s). In this manner, the system is capable of capturing and storing pressure created at both top and bottom of the piston(s). It will be appreciated that energy storage and/or regenerative braking systems discussed above will in various embodiments be utilized in connection with any of the embodiments of the inventive concept discussed above, including systems in which boost is created by a single cylinder for the cylinder's intake as well as embodiments in which multiple cylinders create the boost through the crankcase supercharge of the inventive concept. Also, it will be appreciated that in some embodiments the valves will be controlled by solenoid controls for the recapturing of air and in other embodiments electronic valve control will be utilized, as well as mechanical valve control in still other embodiments.

In some embodiments of the inventive concept an idle air control motor (or other similar device), electric motor or other valve is utilized to allow boost created from underneath the piston(s) to bypass the pre-intake valve(s) and/or to actuate appropriate valves to allow air pressure created within the conduit from underneath the pistons to flow out toward or into the atmosphere. It will be appreciated that other embodiments will include alternative methods and/or structure for providing adjustable boost.

FIG. 10 shows an embodiment of the configuration of the curved portion 56 of the first section 36 of the induction conduit 29. Notably, the curved portion 56 is configured to have decreasing radius curvature, seen as including representative radii $R_1$, $R_2$, and $R_3$, the radii $R_1$, $R_2$, and $R_3$ generally being progressively decreasing in magnitude. This varies from a traditional logarithmic spiral in which the radii would generally be progressively increasing in magnitude. This variation is made to better fit the curved portion 56 within the space available. In alternative embodiments, the radii will be generally progressively increasing.

Some embodiments of the inventive concept includes an injector located in the induction conduit for injecting fuel, EGR (exhaust gas recirculation), or other desirable combustibles into the airflow (and ultimately into the engine intake). In some such embodiments, the injector is located at the "outlet" of the centrifuge, between the between the curved portion 56 of the first section 36 of the induction conduit and straight section of the first section 36 of the induction conduit that extends to the second section 38 of the induction conduit.

Some embodiments of the inventive concept comprise a method of utilizing crankcase compression in operation of an internal combustion engine, such as the internal combustion engine 10. Some embodiments of the method include drawing induction air into a conduit (such as the induction conduit 29) in a first direction towards a crankcase (such as the crankcase 22) of the internal combustion engine 10 responsive to partial vacuum developed within the crankcase chamber by piston movement; causing the induction air to flow in the conduit towards an intake port (such as the intake port 14) of the internal combustion engine 10 in a second direction opposite the first direction; blocking egress of air flowing in the second direction from the conduit, and constraining the air to flow into the intake port; and maintaining the conduit entirely open and unobstructed at all times by, other than one check valve (such as the check valve 42), any solid mechanical object located in the conduit when air flows in the first direction and in the second direction. Some embodiments of the method further include causing the air to flow in a spiraled separation flow path (such as the curved portion 56 of the first section 36 shown in FIG. 4*a*) in the second direction, while continuing to maintain the conduit entirely open and unobstructed by, other than one check valve, any solid mechanical object located in the conduit when air flows along the spiraled path in the second direction.

Other embodiments of present inventive concept comprise a method of retrofitting to an internal combustion engine having a crankcase chamber (such as the internal combustion engine 10), a crankcase compression air induction system which is entirely open and unobstructed at all times by, other than one check valve (such as the check valve 42), any solid mechanical object located in the crankcase compression air induction system when air flows in the crankcase compression air induction system. In some embodiments, the method will include providing an internal combustion engine having a crankcase chamber (such as the crankcase chamber 24) and an intake port (such as the intake port 14), the internal combustion engine not including a crankcase compression air induction system which is entirely open and unobstructed at all times by, other than one check valve (such as the check valve 42), any solid mechanical object located in the crankcase compression air induction system when air flows in the crankcase compression air induction system. The method contemplates both engines which never included a crankcase compression air induction system, and also engines which have a crankcase compression air induction system but which include a barrier separating crankcase air from freshly drawn induction air. In some embodiments, the method will include providing an induction conduit associated with each cylinder (such as the cylinder 4) of the internal combustion engine, wherein the induction conduit is configured to enable atmospheric air to enter the induction conduit, to flow towards a crankcase chamber (such as the crankcase chamber 24), and to flow into the intake port, and a check valve (such as the check valve 42) configured to constrain air flowing from the crankcase chamber to flow only into the intake port. In some embodiments, the method will include providing the check valve configured to enable air to flow into the induction conduit from the atmosphere outside the internal combustion engine, and to prevent air from flowing from induction conduit to the atmosphere outside the internal combustion engine, and maintaining the induction conduit entirely open and unobstructed at all times by any solid mechanical object therein, other than by the check valve.

Embodiments of the inventive concept will be realized as or in connection with an operating power plant for a mobile vehicle or piece of equipment, such as an automobile, truck, bus, train, boat or ship, item of construction, farming, repair, maintenance, or mining equipment, material moving vehicles such as fork lifts, aircraft, railway vehicles, and multi-media vehicle such as hybrid automobiles/boats, and equipment such as lawn mowers, trimmers, leaf and snow blowers, among other possible vehicles and/or equipment. Vehicles may be manned or unmanned. In some embodiments, the internal combustion engine of the inventive concept, or including a supercharger of the inventive concept will be a stationary engine, for example, for a liquid pump, vacuum pump, air compressor, generator, an engine for powering an elevator, escalator, conveyor, or any powered apparatus. In other embodiments, the engine will be used in models, demonstration devices, and toys.

Embodiments of the inventive concept include and/or are utilized in connection with all types of internal combustion engines now known or hereinafter developed, including but not necessarily limited to two-stroke, four stroke, 5 or 6 cycle engine models; diesel fuel, gas fuel, JP8 fuel, natural gas fuel, dual or combination multi-fuel engines; and water injection engines.

In some embodiments, the engine block and the cylinder head, although depicted herein as two separate components, will be unitary if desired. Similarly, the crankcase will be unitary with the engine block in some embodiments.

Features described individually herein or in combination with any other features may be present in any other combination where feasible.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventive concept is by way of example, and the scope of the inventive concept is not limited to the exact details shown or described.

Although the foregoing detailed description of the present inventive concept has been described by reference to an exemplary embodiment, and the best mode contemplated for carrying out the present inventive concept has been shown and described, it will be understood that certain changes, modification or variations may be made in embodying the above inventive concept, and in the construction thereof, other than those specifically set forth herein, may be achieved by those skilled in the art without departing from the spirit and scope of the inventive concept, and that such changes, modification or variations are to be considered as being within the overall scope of the present inventive. Therefore, it is contemplated to cover the present inventive and any and all changes, modifications, variations, or equivalents that fall within the true spirit and scope of the underlying principles disclosed and claimed herein. Consequently, the scope of the present inventive is intended to be limited only by any claims, all matter contained in the above description and shown in the accompanying drawings shall be interpreted as illustrative and not in a limiting sense.

Having now described the features, discoveries and principles of the inventive concept, the manner in which the inventive concept is constructed and used, the characteristics of the construction, and advantageous, new and useful results obtained; the new and useful structures, devices, elements, arrangements, parts and combinations, are set forth in any appended claims.

It is also to be understood that any following claims are intended to cover all of the generic and specific features of the inventive concept herein described, and all statements of the scope of the inventive which, as a matter of language, might be said to fall therebetween.

I claim:

1. A supercharger for an internal combustion engine, the supercharger comprising:

a conduit, said conduit including:

a first inlet that is in fluidic communication with a crankcase chamber of the engine;

a second inlet that is in fluidic communication with an intake port to a combustion chamber of the engine;

a third inlet that is in fluidic communication with an atmosphere; and a centrifuge section positioned at least partially within said crankcase chamber proximate to said first inlet, said centrifuge section defined by a spiral shaped portion including at least one oil return port and configured to utilize centrifugal force to remove lubricant, fuel, and/or contaminants from an airflow as said airflow travels from within the crankcase chamber to the intake port of the combustion chamber, wherein said first and second inlets are positioned at respective first and second ends of said conduit, and said third inlet is positioned along a length of said conduit, such that a fluid flowing from said first inlet to said second inlet flows through said centrifuge section and past said third inlet.

2. The supercharger as claimed in claim 1, wherein said spiral shaped portion of said centrifuge section defines a first cross-section that is constant along a length of said centrifuge section, wherein said second inlet defines a second cross-section, wherein said third inlet defines a third cross-section, and wherein said second cross-section is smaller in dimension than each of said first and said third cross-sections.

3. The supercharger as claimed in claim 1, wherein said spiral shaped portion of said centrifuge section is defined by a logarithmic spiral.

4. The supercharger as claimed in claim 1, wherein said centrifuge section is a primary centrifuge section, and wherein said primary centrifuge section is operatively connected to at least one secondary centrifuge section.

5. The supercharger as claimed in claim 1, wherein the at least one oil return port comprises a plurality of oil return ports.

6. The supercharger as claimed in claim 5, further comprising a one-way valve operatively connecting said plurality of oil return ports to the crankcase chamber of the engine.

7. The supercharger as claimed in claim 1, wherein an entirety of said spiral shaped portion of said centrifuge section is positioned within the crankcase chamber of the engine.

8. The supercharger as claimed in claim 1, wherein said centrifuge section functions as an oil separator.

9. The supercharger as claimed in claim 1, wherein said centrifuge section is bi-directional, thereby allowing fluid to oscillate back and forth through said centrifuge section.

10. The supercharger as claimed in claim 6, wherein said centrifuge section functions as an oil separator.

11. The supercharger as claimed in claim 1, wherein the second inlet defines a cross-section that is smaller in dimension than a cross-section of at least one of said first inlet and said third inlet.

12. The supercharger as claimed in claim 1, further comprising a valve at said third inlet, wherein said valve is configured to restrict a flow of fluid from said conduit to the atmosphere.

13. The supercharger as claimed in claim 12, wherein said valve is configured to prevent any fluid from flowing from said conduit to the atmosphere.

14. The supercharger as claimed in claim 13, wherein said valve is a one-way valve.

15. The supercharger as claimed in claim 12, wherein said valve is operable to allow the flow of fluid from said conduit to the atmosphere so as to reduce or eliminate boost pressure created by said supercharger.

16. An internal combustion engine, the internal combustion engine comprising:

an intake port to a combustion chamber, a piston, a crankcase chamber; and a supercharger comprising:

a conduit, said conduit including:

a first inlet that is in fluidic communication with the crankcase chamber;

a second inlet that is in fluidic communication with the intake port to the combustion chamber;

a third inlet that is in fluidic communication with an atmosphere; and a centrifuge section positioned at least partially within said crankcase chamber proximate to said first inlet, said centrifuge section defined by a spiral shaped portion including at least one oil return port and configured to utilize centrifugal force to remove lubricant, fuel, and/or contaminants from an airflow as said airflow travels from within the crankcase chamber to the intake port of the combustion chamber, wherein said first and second inlets are positioned at respective first and second ends of said conduit, and said third inlet is positioned along a length of said conduit, such that a fluid flowing from said first inlet to said second inlet flows through said centrifuge section and past said third inlet, wherein said spiral shaped portion of said centrifuge section defines a first cross-section that is constant along a length of said centrifuge section, wherein said second inlet defines a second cross-section, wherein said third inlet defines a third cross-section, and wherein said second cross-section is smaller in dimension than at least one of said first and said third cross-sections.

17. The engine as claimed in claim 16, wherein said spiral shaped portion of said centrifuge section is defined by a logarithmic spiral.

18. The engine as claimed in claim 16, further comprising two intake valves and two exhaust valves corresponding to the combustion chamber.

19. The engine claimed in claim 16, wherein said intake port to said combustion chamber is a first intake port to a first combustion chamber and said crankcase chamber is a first crankcase chamber, and wherein said first intake port to said first combustion chamber is operatively connected to a second intake port to a second combustion chamber and said first crankcase chamber is operatively connected to a second crankcase chamber; and wherein said first combustion chamber is provided with a first intake valve and said second combustion chamber is provided with a second intake valve, each of said first intake valve and said second intake valve being operable to facilitate selective fluidic communication between the respective crankcase chamber and the respective combustion chamber.

20. The engine as claimed in claim 19, wherein said first intake valve is capable of being closed when said second intake valve is opened such that all fluid pressure created within said conduit by said supercharger is directed into said second combustion chamber.

21. The engine as claimed in claim 20, wherein said first intake valve is capable of being opened when said second intake valve is closed such that all fluid pressure created within said conduit by said supercharger is directed into said first combustion chamber.

22. The engine as claimed in claim 21, wherein said first intake valve and said second intake valve are controlled using a single camshaft.

23. The engine as claimed in claim 16, further comprising a turbocharger, wherein said conduit further includes a turbocharger intake port, a turbocharger discharge port, and a valve positioned between said turbocharger intake port and said turbocharger discharge port such that said conduit is configured to selectively direct fluid flow through the turbocharger via said turbocharger intake port and back into said conduit via said turbocharger discharge port.

* * * * *